US008661997B2

(12) United States Patent
Sakuma et al.

(10) Patent No.: US 8,661,997 B2
(45) **Date of Patent: *Mar. 4, 2014**

(54) METHOD AND SEWING MACHINE FOR FORMING SINGLE-THREAD LOCKED HANDSTITCHES

(75) Inventors: Kouichi Sakuma, Yamagata (JP); Tohru Sakuma, Yamagata (JP)

(73) Assignee: Suzuki Manufacturing, Ltd., Yamagata-Shi, Yamagata (JP)

( * ) Notice: Subject to any disclaimer, the term of this patent is extended or adjusted under 35 U.S.C. 154(b) by 1071 days.

This patent is subject to a terminal disclaimer.

(21) Appl. No.: 12/671,382

(22) PCT Filed: Apr. 9, 2008

(86) PCT No.: PCT/JP2008/000919

§ 371 (c)(1),
(2), (4) Date: Jan. 29, 2010

(87) PCT Pub. No.: WO2009/019807

PCT Pub. Date: Feb. 12, 2009

(65) Prior Publication Data

US 2010/0199899 A1 Aug. 12, 2010

(30) Foreign Application Priority Data

Aug. 8, 2007 (JP) ..... 2007-207215

(51) Int. Cl.
*D05B 57/14* (2006.01)

(52) U.S. Cl.
USPC ..... 112/475.17

(58) Field of Classification Search
USPC ..... 112/170, 171, 181, 183, 184, 185, 189, 112/191, 193, 201, 154, 173, 475.17
See application file for complete search history.

(56) References Cited

U.S. PATENT DOCUMENTS

| | | | | |
|---|---|---|---|---|
| 3,207,107 | A | 9/1965 | Castany Ferré | |
| 3,808,994 | A * | 5/1974 | Kuhn | 112/199 |
| 4,122,787 | A | 10/1978 | Conti | 112/170 |
| 4,366,765 | A * | 1/1983 | Hoekstra | 112/429 |
| 4,580,514 | A * | 4/1986 | Hanyu et al. | 112/162 |
| 4,590,878 | A | 5/1986 | Conti | 112/266 |
| 5,881,658 | A * | 3/1999 | Nozaki et al. | 112/192 |
| 6,314,899 | B1 * | 11/2001 | Ballantyne | 112/475.17 |
| 7,891,307 | B2 * | 2/2011 | Sakuma et al. | 112/475.17 |
| 2009/0007830 | A1 | 1/2009 | Sakuma et al. | 112/475.17 |

FOREIGN PATENT DOCUMENTS

| | | |
|---|---|---|
| DE | 603983 | 10/1934 |
| JP | 55-99473 | 7/1980 |
| JP | 55-35481 | 9/1980 |
| JP | 2687950 | 12/1997 |
| JP | 11-047472 | 2/1999 |
| JP | 2006-068380 | 3/2006 |

* cited by examiner

*Primary Examiner* — Tejash Patel
(74) *Attorney, Agent, or Firm* — Bacon & Thomas, PLLC

(57) ABSTRACT

A thread can be captured surely by the thread capturing open eye of a needle and a stitch can be formed in the space within a machine bed. A handstitch on the front surface of a fabric workpiece and a locked stitch on the back surface are formed as a skip-stitch set by cooperation of a open eye needle (13), a rotary hook (200) comprising a rocking bobbin casing (205) loaded in a rotative outer rotary hook (202), and a thread draw out actuator (401). In the first stroke of the open eye needle (13), a stitch length feed of the fabric workpiece for handstitch is performed by a feed dog (601). In the second stroke of the open eye needle (13), an inter-stitch pitch feed of fabric workpiece for inter-handstitch is performed by a feed dog (601).

18 Claims, 47 Drawing Sheets

Reversible figure

First stroke (0° )

First stroke (75° )

First stroke (110° )

First stroke (120° )

First stroke (140° )

First stroke (150° )

First stroke (160° )

First stroke (180° )

First stroke (230° )

Second stroke (380° )

Second stroke (400° )

Second stroke (450° )

Second stroke (510° )

Second stroke (540° )

Second stroke (700° )

METHOD AND SEWING MACHINE FOR FORMING SINGLE-THREAD LOCKED HANDSTITCHES

FIELD OF THE ART

The present invention relates to a method and sewing machine for forming single-thread locked handstitches. Particularly, the present invention relates to the method and sewing machine for forming single-thread locked handstitches that a thread is captured to a thread capturing open eye of a needle certainly, a formation of the stitch can be performed in an inner space of a sewing machine bed and it is suitable to a quasi-handstitch called pinpoint/saddle stitch.

BACKGROUND OF THE ART

The stitches which form the pinpoint stitch appearing and disappearing on one side of a fabric workpiece alternately by one thread and project an atmosphere of the handstitch is standardized as ISO 4915 Stitch Type 104 (chain stitch) and ISO 4915 Stitch Type 209 (saddle stitch/handstitch) of the international standard.

Heretofore, a pinpoint stitch sewing machine which forms "104" stitch as the pinpoint stitch (quasi-handstitch) and prevents a cloth misalignment of such a pinpoint stitch sewing by using the sewing needle that one thread which is pierced to the needle is pierced, an open eye needle that the thread capturing open eye is equipped laterally, a looper and a spreader is known (for example, refer to Patent document No. 1).

Because this pinpoint stitch sewing machine uses the sewing needle that one thread is pierced and the open eye needle that the thread capturing open eye is equipped laterally, there is a disadvantage that a stitch length is limited to a distance between the sewing needle and the open eye needle. And, in this pinpoint stitch sewing machine, when sewing, a balloon stitch is formed on the upper side of the cloth. However, because the pinpoint stitch to be stitched intrinsically is formed in the lower side of the cloth, sewing work is forced to in the state that it cannot watch for a worker. Therefore, it is difficult to confirm the position of the pinpoint stitch and there is also a disadvantage that an exact sewing is not possible. Besides, in the "104" stitch of this pinpoint stitch sewing machine, because the stitch comes loose easily by pulling the thread which forms the stitch, there is also a disadvantage that a function to prevent the above described cloth misalignment of such the pinpoint stitch sewing is lost.

In order to solve these disadvantages, the quasi-handstitch sewing machine which forms, a quasi-pinpoint stitch similar to the "104" stitch by using the open eye needle that one thread capturing open eye is equipped laterally, a thread grapple hook, a guide spreader of the thread to the thread capturing open eye and a thread take-up lever by one thread which is wound around a bobbin arranged in an inside of a rotary hook is proposed (for example, refer to Patent document No. 2).

Patent document No. 1: Toku-Kou-Shou 55-35481 (FIG. 5, FIG. 6, FIG. 7)

Patent document No. 2: Toku-Kou-Hei 4-3234 (U.S. Pat. No. 4,590,878) (FIG. 11, FIG. 13, FIG. 14)

DISCLOSURE OF THE INVENTION

Problem to be Solved by the Invention

In this quasi-handstitch sewing machine, when sewing, the thread which became double is formed like handstitch on the upper side of the cloth, and the locked stitch is formed in the lower side of the cloth. However, in this quasi-handstitch sewing machine, though the thread guide spreader to the thread capturing open eye of the needle is necessary to be arranged between a throat plate which supports the cloth and the rotary hook, functionally, the thread take-up lever must be installed just beneath the throat plate and arranged between the throat plate and the rotary hook, and a drive mechanism to drive the thread guide spreader must be arranged. Therefore, in the limited space of the inside of the machine bed, such arrangement was not able to be actualized concretely.

Besides, in this quasi-handstitch sewing machine, because the thread which was guided into the inside of the rotary hook has to pull up the thread which was guided out from the rotary hook to the upper direction of the cloth by the thread grapple hook, it is extremely dangerous that the worker takes his hand to such a position on the cloth, and there was a difficult point that an obstacle occurs in the sewing work which moves the cloth. Therefore, it is impossible to perform this quasi-handstitch sewing machine.

In addition, in making a quilt, a quilting or a patchwork, the sewing work is performed by hand since ancient times. This needs extremely great labor hour, and this is the work that hard labor is forced to. Therefore, by using the sewing machine which perform the sewing with a lockstitch (ISO 4915 Stitch Type 301) and using transparent thread for one of two threads which are used, the technique which projects the handstitch sewing at first glance is also adopted. However, in the stitch which was sewn by this technique, because the thread is sewn continuously by using lockstitch sewing machine basically, there is a difficult point that the atmosphere of original handstitch sewing by pursuing the softness accompanied by the convexo-concave which is produced on the surface of the fabric workpiece after sewing which is needed in the quilt, the quilting or the patchwork is not obtained.

This invention was conducted to solve these hitherto known difficult points. And this invention aims to provide the method and sewing machine for forming single-thread locked handstitches which are suitable to the quasi-handstitch which is called pinpoint/saddle stitch that the thread is certainly captured to the thread capturing open eye of the needle, and that the formation of the stitch is performed in the inner space of the sewing machine bed.

And, this invention aims to provide the method and sewing machine for forming single-thread locked handstitches that the thread is captured certainly to the thread capturing open eye of the needle, and the formation of the stitch is performed in the inner space of the sewing machine bed, and the stitch length and the inter-stitch pitch can be set freely.

Besides, this invention aims to provide the method and sewing machine for forming single-thread locked handstitches which are suitable to the quilt, the quilting or the patchwork by forming the handstitch on the front surface and the locked stitch on the back surface of the fabric workpiece as a skip stitch set, and by varying the feed direction, namely, the sewing direction of the fabric workpiece every one skip stitch set.

Means for Solving the Problems

The gist of this invention aims to form the handstitch on the front surface and the locked stitch on the back surface of the fabric workpiece respectively by letting the open eye needle that the thread capturing open eye is provided laterally and which performs the linear reciprocating motion vertically, the rotary hook which is composed by the rocking bobbin casing which is loaded in the rotative outer rotary hook, the thread draw out actuator which performs the reciprocating motion, and the feed dog which performs the elliptical motion cooperate, and by capturing the thread to the thread capturing open eye of the needle certainly, and by performing the formation of the stitch in the inside of the sewing machine bed. Besides, the gist of this invention aims to be able to set the stitch length and the inter-stitch pitch freely by changing the feed quantity of the fabric workpiece by the feed dog depending on the stitch length feed and the inter-stitch pitch feed when forming the handstitch on the front surface and the locked stitch on the back surface of the fabric workpiece as the skip stitch set by cooperation of the open eye needle, the rotary hook which is composed by the rocking bobbin casing which is loaded in the rotative outer rotary hook and the thread draw out actuator.

The method for forming single-thread locked handstitches of this invention in order to achieve this purpose comprises the steps of (a) contacting circumferentially on an open eye needle and tightening a thread which is drawn out from a thread exit by rocking the thread exit of a bobbin case which houses a bobbin that the thread which is incorporated in a bobbin casing is wound by rocking the bobbin casing which is loaded in the rotative outer rotary hook of a rotary hook positioned under a throat plate by the time the open eye needle which is provided with the thread capturing open eye laterally and performs a linear reciprocating motion vertically comes down from an upper dead center, pierces a fabric workpiece which is placed on the throat plate, and goes up from the brink of reaching a lower dead center in a first stroke, (b) capturing the thread which is contacted circumferentially on the open eye needle and is tightened by the thread capturing open eye when the open eye needle goes up from the lower dead center, (c) feeding the fabric workpiece with one stitch length while the open eye needle slips out from the fabric workpiece, goes up, and passes through the upper dead center in the first stroke, (d) scooping the thread which is captured by the thread capturing open eye by a loop-taker point of the rotative outer rotary hook, and releasing the captured thread by the rotation of the rotary hook from the thread capturing open eye when the open eye needle comes down from the upper dead center, pierces the fabric workpiece, and goes up from the lower dead center in a second stroke, (e) guiding in the thread which is scooped by the loop-taker point of the rotary hook and released by the further rotation of the rotary hook to the rotary hook, interlacing the thread to the thread which is wound in the bobbin, and tightening the thread which guides out from the rotary hook, (f) feeding the fabric workpiece with one inter-stitch pitch while the open eye needle slips out from the fabric workpiece, goes up, and passes through the upper dead center in the second stroke, and (g) forming a handstitch on a front surface and a locked stitch on a back surface of the fabric workpiece by repeating the steps from the (a) to (f).

In this method for forming single-thread locked handstitches, the thread exit is provided at the bobbin case so that it rocks to the direction in parallel with the opening part direction of the thread capturing open eye astride a needle dropping position of the open eye needle.

In this method for forming single-thread locked handstitches, the thread which is scooped by the loop-taker point is guided in to the rotary hook after the thread which is captured by the thread capturing open eye is scooped by the loop-taker point of the outer rotary hook, the thread which is drawn out from the thread exit of the bobbin case is hooked just before guiding out from the rotary hook, the thread which is guided out from the rotary hook is tightened, and the thread which is hooked is released after the thread is captured by the thread capturing open eye.

In this method for forming single-thread locked handstitches, the thread captured by the thread capturing open eye is shifted to the unopened direction of the thread capturing open eye between a tip of the open eye needle and the fabric workpiece when the open eye needle comes down from the upper dead center in the second stroke.

In this method for forming single-thread locked handstitches, the thread tightness quantity is adjusted depending on the feed quantity of the fabric workpiece when tightening the thread which guides out from the rotary hook.

And, the method for forming single-thread locked handstitches of this invention in order to achieve the above-mentioned purpose comprises the steps of forming a handstitch on a front surface and a locked stitch on a back surface of a fabric workpiece as a skip stitch set by cooperation of an open eye needle which is provided with a thread capturing open eye laterally, a rotary hook which is composed by a rocking bobbin casing which is loaded at a rotative outer rotary hook and a thread draw out actuator, setting a stitch length feed quantity of a stitch length feed and an inter-stitch pitch feed quantity of an inter-stitch pitch feed respectively, when the stitch length feed of the fabric workpiece for the handstitch is performed by a feed mechanism in a first stroke of the open eye needle, and the inter-stitch pitch feed of the fabric workpiece for the inter-handstitch is performed by the feed mechanism in a second stroke of the open eye needle, changing over to each fabric workpiece feed mode corresponding to the stitch length feed and the inter-stitch pitch feed respectively every one skip stitch set in sequence, transmitting the set stitch length feed quantity and inter-stitch pitch feed quantity to a feed drive mechanism in each fabric workpiece feed mode respectively, and feeding the fabric workpiece by the feed mechanism.

Besides, a single-thread locked handstitch sewing machine of this invention in order to achieve the above-mentioned purpose comprises an open eye needle, which is provided with a thread capturing open eye laterally which captures a thread in a first stroke which performs a linear reciprocating motion vertically by coming down from the upper dead center, piercing the fabric workpiece which is placed on a throat plate, slipping out from the fabric workpiece from the lower dead center, going up when coming down from an upper dead center, piercing a fabric workpiece, and going up from a lower dead center, and which releases the captured thread when coming down from the upper dead center, piercing the fabric workpiece, and going up from the lower dead center in a second stroke, a rotary hook, which is the rotary hook which contacts circumferentially on an open eye needle and tightens a thread which is drawn out from a thread exit by rocking the thread exit of a bobbin case which houses a bobbin that the thread which is incorporated in a bobbin casing is wound by rocking the bobbin casing which is loaded in the rotative outer rotary hook of the rotary hook positioned under a throat plate by the time the open eye needle goes up from the brink of reaching a lower dead center, and that the fabric workpiece is fed with one stitch length while the open eye needle slips out from the fabric workpiece, goes up and passes through the upper dead center in the first stroke, and that the open eye needle has a loop-taker point of the rotative outer rotary hook for scooping the thread which is captured by the thread capturing open eye when the open eye needle comes down from the upper dead center, pierces the fabric workpiece, and goes up from the lower dead center in the second stroke, and that the captured thread is released from the thread capturing open eye by the rotation of the rotary hook, and the released thread which is scooped by the loop-taker point of the rotary hook is guided in to the rotary hook by the further rotation of the rotary hook and is interlaced to the thread which is wound in the bobbin, a thread draw out actuator, which tightens the thread which guides out from the rotary hook by the further rotation of the rotary hook, a feed mechanism, which feeds the fabric workpiece with one stitch length while the open eye needle slips out from the fabric workpiece, goes up, and passes through the upper dead center in the first stroke, and feeds the fabric workpiece with one inter-stitch pitch while the open eye needle slips out from the fabric workpiece, goes up, and passes through the upper dead center in the second stroke, and thereby a handstitch on a front surface and a locked stitch on a back surface of the fabric workpiece are formed respectively.

In this single-thread locked handstitch sewing machine, the outer rotary hook is provided with a outer rotary hook deviator which deviates the thread of the brink of guiding out from the rotary hook to the direction of letting go from the plane of rotation of the loop-taker point, and avoids that the loop-taker point hooks the thread which guides out from the rotary hook.

In this single-thread locked handstitch sewing machine, a bobbin casing rocking mechanism which drives swingably the bobbin casing by a rocking actuator is provided.

In this single-thread locked handstitch sewing machine, the thread exit is provided at the bobbin case so that it rocks to the direction in parallel with the opening part direction of the thread capturing open eye astride a needle dropping position of the open eye needle.

In this single-thread locked handstitch sewing machine, the thread draw out actuator has functions for guiding in the thread which is scooped by the loop-taker point to the rotary hook after scooping the thread which is captured by the thread capturing open eye by the loop-taker point of the outer rotary hook, hooking the thread which is drawn out from the thread exit of the bobbin case just before guiding out from the rotary hook, tightening the thread which is guided out from the rotary hook, and releasing the thread which is hooked after capturing the thread by the thread capturing open eye.

In this single-thread locked handstitch sewing machine, a thread shifting mechanism which shifts the thread which is captured by the thread capturing open eye to the unopened direction of the thread capturing open eye between a tip of the open eye needle and the fabric workpiece when the open eye needle comes down from the upper dead center in the second stroke is provided.

In this single-thread locked handstitch sewing machine, an open eye needle-latch wire drive mechanism for driving a latch wire which closes the thread capturing open eye in the period that the thread capturing open eye of the open eye needle comes down from the upper dead center of the open eye needle, pierces the fabric workpiece, and passes through the throat plate, and in the period that the thread capturing open eye passes through the throat plate, slips out from the fabric workpiece, and reaches the upper dead center after the thread capturing open eye goes up from the lower dead center and captures the thread is provided.

Besides, in a single-thread locked handstitch sewing machine of this invention in order to achieve the above-mentioned purpose, the single-thread locked handstitch sewing machine which forms a handstitch on a front surface and a locked stitch on a back surface of a fabric workpiece as a skip stitch set by cooperation of an open eye needle which is provided with a thread capturing open eye laterally, a rotary hook which is composed by a rocking bobbin casing which is loaded at a rotative outer rotary hook and a thread draw out actuator, and performs a stitch length feed of the fabric workpiece for the handstitch by a feed mechanism in a first stroke of the open eye needle and performs an inter-stitch pitch feed of the fabric workpiece for the inter-handstitch by the feed mechanism in a second stroke of the open eye needle comprises a feed quantity setting mechanism which sets a stitch length feed quantity of the stitch length feed and an inter-stitch pitch feed quantity of an inter-stitch pitch feed respectively, a feed mode changeover mechanism which changes over to each fabric workpiece feed mode corresponding to the stitch length feed and the inter-stitch pitch feed respectively every one skip stitch set in sequence, and a feed drive mechanism which transmits the set stitch length feed quantity and inter-stitch pitch feed quantity in each fabric workpiece feed mode respectively, and feeds the fabric workpiece by the feed mechanism.

In this single-thread locked handstitch sewing machine, a thread tightness adjusting mechanism which adjusts a thread tightness quantity of the thread draw out actuator depending on the feed quantity which is set by the feed quantity setting mechanism is provided.

In this single-thread locked handstitch sewing machine, the thread tightness adjusting mechanism is provided with a thread draw out actuator eccentric shaft which rotates depending on the feed quantity of the fabric workpiece, and a thread draw out actuator drive rod which expands and contracts by the rotation of the thread draw out actuator eccentric shaft and adjusts the stroke of the thread draw out actuator.

In this single-thread locked handstitch sewing machine, the feed quantity setting mechanism, comprises a reverse T-shaped feed adjuster which is pivotally attached to a supporting am which is pivotally supported to an intermediate shaft that one-half is decelerated from an upper shaft which drives the open eye needle, and a stitch length feed quantity operating member and an inter-stitch pitch feed quantity operating member are pivotally attached to both arms of the reverse T-shaped feed adjuster respectively.

In this single-thread locked handstitch sewing machine, the feed mode changeover mechanism comprises a feed changeover cam which is firmly fixed to the intermediate shaft and has at least two even-numbered deviating points and a feed changeover rod which contacts to the outside of the feed changeover cam, and a connecting end of the feed changeover rod is pivotally attached to one end of a stitch length changeover link, and another end is pivotally attached to a vertical arm end of the reverse T-shaped feed adjuster.

EFFECT OF THE INVENTION

According to the method and sewing machine for forming single-thread locked handstitches of this invention, the thread is certainly captured to the thread capturing open eye of the needle, and the formation of the single-thread locked stitch is performed in the inner space of the sewing machine bed, and the sewing which is suitable to the quasi-handstitch called pinpoint/saddle stitch is possible.

In addition, according to the method and sewing machine for forming single-thread locked handstitches of this invention, because the handstitch on the front surface and the locked stitch on the back surface of the fabric workpiece are formed respectively, the sewing work is performed in the state that the handstitch can be seen on the surface for the worker, and it is possible to confirm the position of the handstitch. Therefore, the accurate sewing is possible.

And, according to the method and sewing machine for forming single-thread locked handstitches of this invention, because the handstitch on the front surface and the locked stitch on the back surface of the fabric workpiece are formed respectively, it does not come loose easily by pulling the thread which forms single-thread locked stitch. Therefore, the firm sewing can be obtained.

Besides, according to the method and sewing machine for forming single-thread locked handstitches of this invention, because the single-thread locked stitch is formed by cooperation of the open eye needle, the rotary hook which is composed by the rocking bobbin casing which is loaded in the rotative outer rotary hook, and the thread draw out actuator, the stitch length and the inter-stitch pitch can be set freely.

And, according to the method and sewing machine for forming single-thread locked handstitches of this invention, the waiting position before hooking the thread that the thread draw out actuator is drawn out from the thread exit of the bobbin case can be uniformed by the thread tightness adjusting mechanism even if the stitch length and the inter-stitch pitch fluctuate. And from this uniform passing position, the thread tightness quantity of the thread draw out actuator is adjusted corresponding to the set feed quantity. Therefore, the beautiful handstitches finish.

BRIEF DESCRIPTION OF THE DRAWINGS

FIG. 3 (B) A perspective view showing the open eye needle-latch wire drive mechanism in the single-thread locked handstitch sewing machine of this invention, wherein (B) is a view that the open eye needle is in the lower dead center.

FIG. 16 (B) An exploded perspective view showing the thread draw out actuator drive mechanism and the thread tightness adjusting mechanism in the single-thread locked handstitch sewing machine of this invention.

FIG. 17 (B) A schematic view showing the movement state when viewing the thread tightness adjusting mechanism of FIG. 16 (A) and FIG. 16 (B) from the lower side of the sewing machine.

FIG. 18 (B) A movement explanatory view showing the method for forming single-thread locked handstitches about the movement of the single-thread locked handstitch sewing machine by this invention.

FIG. 18 (C) A movement explanatory view showing the method for forming single-thread locked handstitches about the movement of the single-thread locked handstitch sewing machine by this invention.

FIG. 18 (D) A movement explanatory view showing the method for forming single-thread locked handstitches about the movement of the single-thread locked handstitch sewing machine by this invention.

FIG. 18 (E) A movement explanatory view showing the method for forming single-thread locked handstitches about the movement of the single-thread locked handstitch sewing machine by this invention.

FIG. 18 (F) A movement explanatory view showing the method for forming single-thread locked handstitches about the movement of the single-thread locked handstitch sewing machine by this invention.

FIG. 18 (G) A movement explanatory view showing the method for forming single-thread locked handstitches about the movement of the single-thread locked handstitch sewing machine by this invention.

FIG. 18 (H) A movement explanatory view showing the method for forming single-thread locked handstitches about the movement of the single-thread locked handstitch sewing machine by this invention.

FIG. 18 (I) A movement explanatory view showing the method for forming single-thread locked handstitches about the movement of the single-thread locked handstitch sewing machine by this invention.

FIG. 18 (J) A movement explanatory view showing the method for forming single-thread locked handstitches about the movement of the single-thread locked handstitch sewing machine by this invention.

FIG. 18 (K) A movement explanatory view showing the method for forming single-thread locked handstitches about the movement of the single-thread locked handstitch sewing machine by this invention.

FIG. 18 (L) A movement explanatory view showing the method for forming single-thread locked handstitches about the movement of the single-thread locked handstitch sewing machine by this invention.

FIG. 18 (M) A movement explanatory view showing the method for forming single-thread locked handstitches about the movement of the single-thread locked handstitch sewing machine by this invention.

FIG. 18 (N) A movement explanatory view showing the method for forming single-thread locked handstitches about the movement of the single-thread locked handstitch sewing machine by this invention.

FIG. 18 (O) A movement explanatory view showing the method for forming single-thread locked handstitches about the movement of the single-thread locked handstitch sewing machine by this invention.

FIG. 20 (B) An explanatory view showing the state of the open eye needle which captures the thread when viewing the rotary hook which is described in FIG. 18 (H) from the upper side.

FIG. 23 (B) A view showing the feed quantity setting mechanism, the mode changeover mechanism, the cloth feed mechanism and the cloth feed drive mechanism schematically in the single-thread locked handstitch sewing machine of this invention.

FIG. 25 (B) An exploded perspective view showing the thread shifting mechanism in the single-thread locked handstitch sewing machine of this invention.

BEST MODE FOR CARRYING OUT THE INVENTION

Hereinafter, the example of the best mode of embodiment of the method and sewing machine for forming single-thread locked handstitches of this invention is explained based on the drawings.

Figure 1:
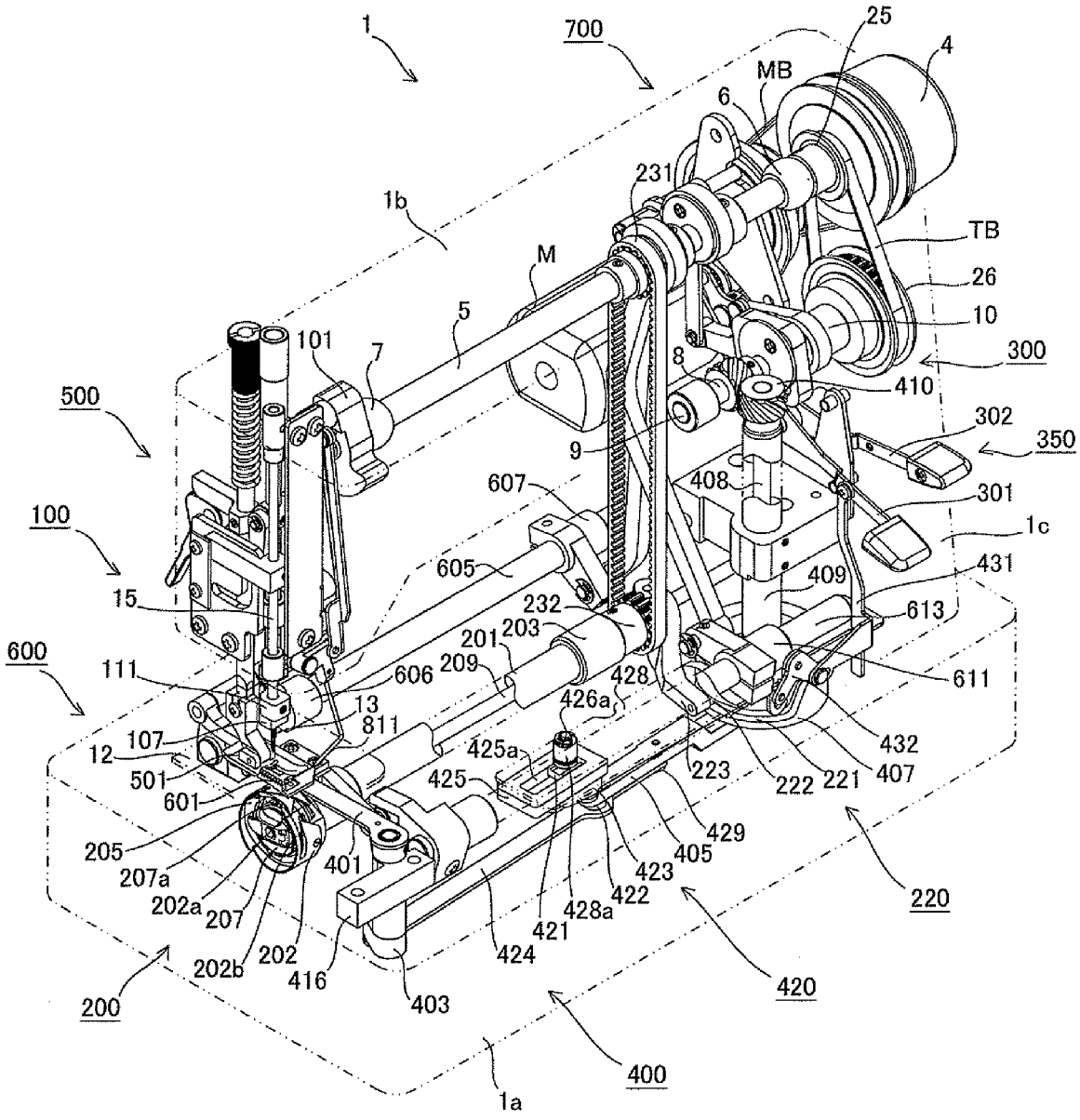
FIG. 1 An overall perspective view showing the example of the preferable mode of embodiment by the single-thread locked handstitch sewing machine of this invention.
Figure 2:
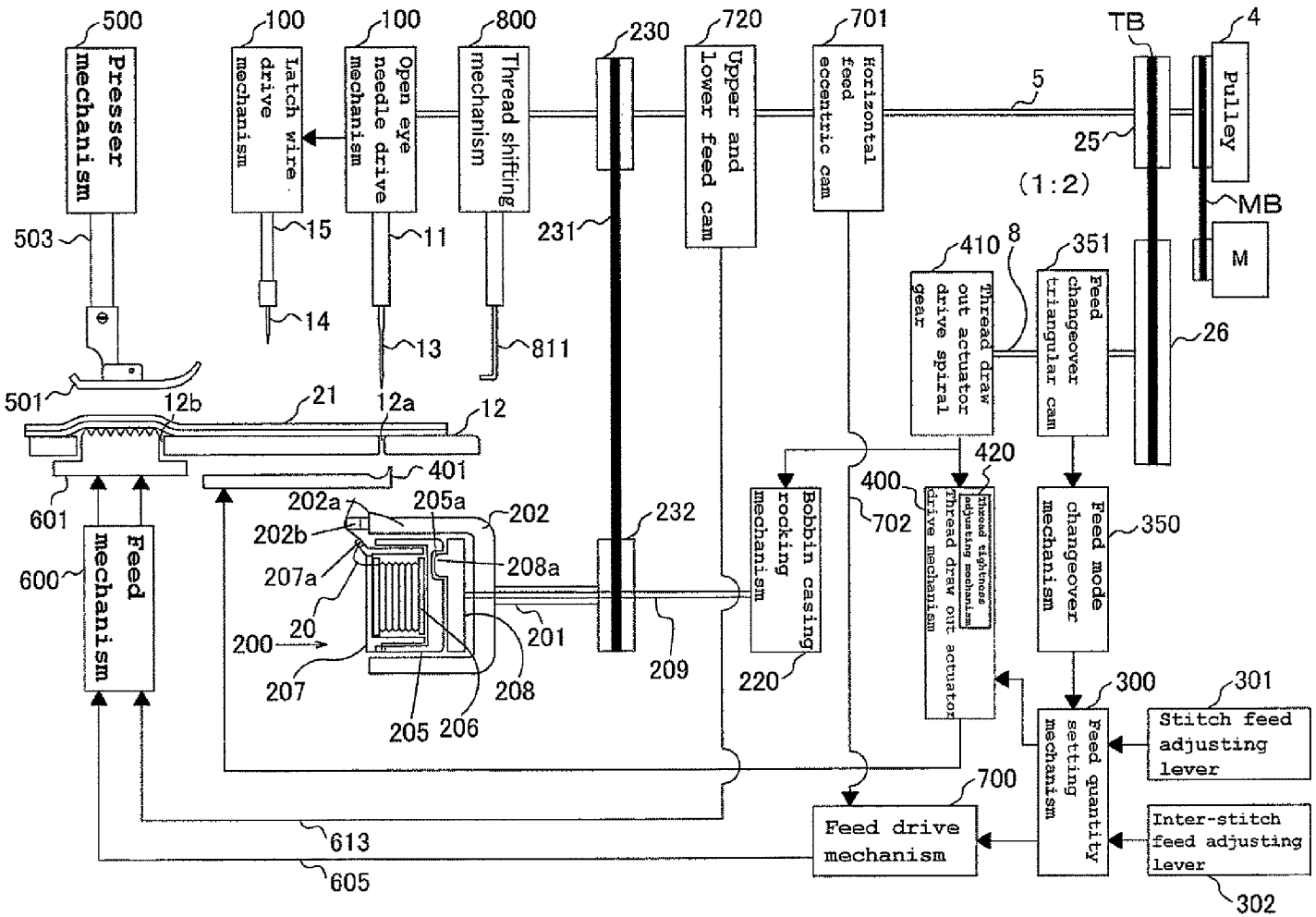
FIG. 2 A block diagram showing the drive system of the single-thread locked handstitch sewing machine of this invention.
Figure 6:
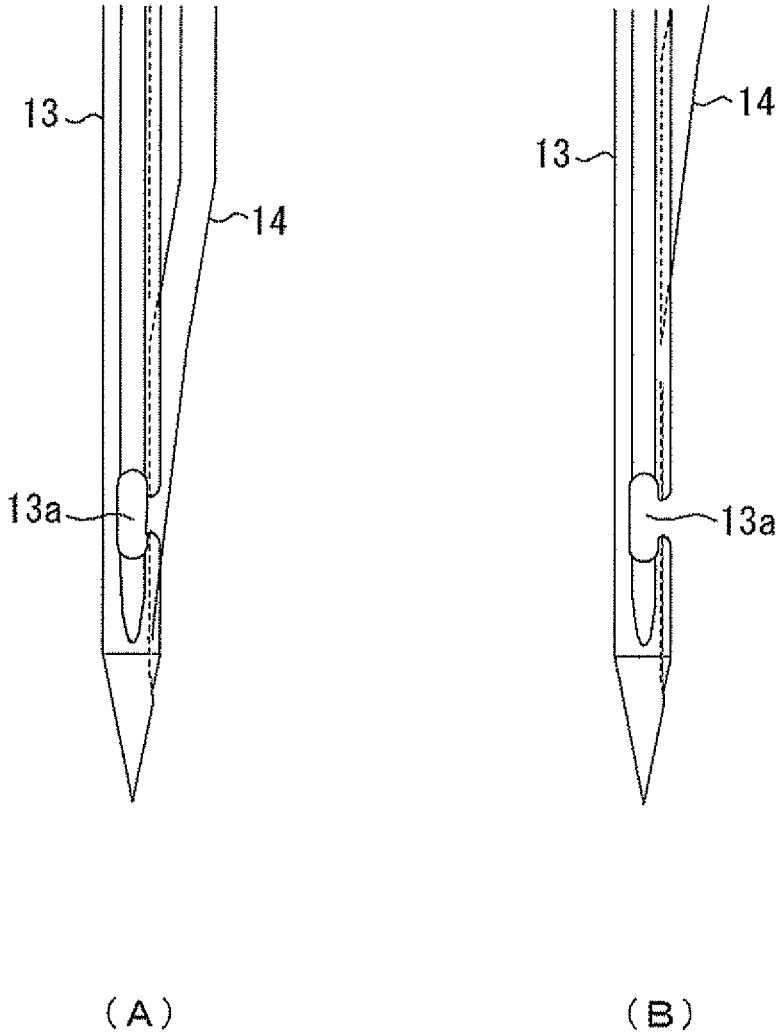
FIG. 6 A partial perspective view showing the relation between the open eye needle and the latch wire, wherein (A) is a view that the thread capturing open eye of the open eye needle is closed state by the latch wire, (B) is a view that the thread capturing open eye of the open eye needle is open state.

As shown in FIG. 1 and FIG. 2, the single-thread locked handstitch sewing machine of this invention is provided with an open eye needle 13 which pierces one thread 20 to a fabric workpiece 21 by providing a thread capturing open eye 13*a* (FIG. 6) laterally and by performing the linear reciprocating motion vertically, a rotary hook 200 which is loaded in a rotative outer rotary hook 202 and composed by an rocking bobbin casing 205 and forms the stitch by letting the thread 20 intersect, a thread draw out actuator 401 which gives the slack to the thread 20 and tightens the stitch by performing the reciprocating motion, and a feed mechanism 600 which feeds the fabric workpiece 21 by the elliptical motion in a frame 1 consisting of abed 1*a*, an arm 1*b* and a support pedestal portion 1*c*. And a handstitch are formed on the front surface of the fabric workpiece 21 and a locked stitch are formed on the back surface respectively by using the thread 20 which is wound in a bobbin 206 which is housed in a bobbin case 207 which is incorporated in the bobbin casing 205.

An upper shaft 5 is installed in the arm 1*b*, an intermediate shaft 8 is installed in the support pedestal portion 1*c* and a horizontal feed shaft 605, an upper and lower feed shaft 613 and a rotary hook shaft 201 are installed in the bed 1*a*, and as for these, the direction of the shafts are installed in horizontal direction respectively.

The upper shaft 5 is rotatably installed in the support pedestal portion 1*c* by an upper shaft former bushing 7 and an upper shaft rear bushing 6, and the intermediate shaft 8 is rotatably installed in the support pedestal portion 1*c* by an intermediate shaft front bushing 9 and an intermediate shaft rear bushing 10, respectively.

A driven pulley 4 is provided at one end of the upper shaft 5, and the driven pulley 4 is driven by a motor M through a drive belt MB which is an endless belt. And, a needle bar crank 101 of the open eye needle-latch wire drive mechanism 100 for driving the open eye needle 13 is provided to another end of the upper shaft 5. The cloth feed drive mechanism 700 for driving the cloth feed mechanism 600 by letting the elliptical motion perform to the feed dog 601 is connected to the intermediate portion of the upper shaft 5. An upper shaft drive pulley 25 for driving the feed quantity setting mechanism 300 of the stitch length and the inter-stitch pitch is provided to the neighborhood of the driven pulley 4 of the upper shaft 5.

The horizontal feed shaft 605 is rotatably installed by a horizontal feed shaft former bushing 606 and a horizontal feed shaft rear bushing 607 in the bed 1*a*, and the upper and lower feed shaft 613 is rotatably installed by an upper and lower feed shaft former bushing 614 and an upper and lower feed shaft rear bushing 611 in the bed 1*a*, respectively.

The rotary hook shaft 201 is rotatably installed by a rotary hook shaft rear bushing 203 and a rotary hook shaft former bushing 204 in the bed 1*a*, and in addition, the rotary hook shaft 201 is driven by a timing belt 231 which is tightened between a rotary hook drive pulley 230 which is provided at the upper shaft 5 and a rotary hook shaft pulley 232 which is provided at the rotary hook shaft 201. Thereby, the outer rotary hook 202 of the rotary hook 200 is rotated and driven by the rotation number ratio of 1:1 with the upper shaft 5.

The open eye needle-latch wire drive mechanism 100 has the following mechanism composition. The open eye needle 13 comes down from the upper dead center, and it pierces to the fabric workpiece 21 which is placed on a throat plate 12, and it slips out from the fabric workpiece 21 from the lower dead center and goes up, and it comes down from the upper dead center during the first stroke which performs the linear reciprocating motion vertically and pierces to the fabric workpiece 21, and it captures the thread 20 by the thread capturing open eye 13*a* when it goes up from the lower dead center, and it pierces to the fabric workpiece 21 by coming down from the upper dead center during the second stroke, and it releases the thread 20 which was captured by the thread capturing open eye 13*a* when it goes up from the lower dead center. In this specification, "the first stroke of the open eye needle 13" means the first stitch that the open eye needle 13 reaches the upper dead center of needle→the lower dead center of needle→the upper dead center of needle, and "the second stroke of the open eye needle 13" means the second stitch that the open eye needle 13 reaches the upper dead center of needle →the lower dead center of needle→the upper dead center of needle.

Figure 3:
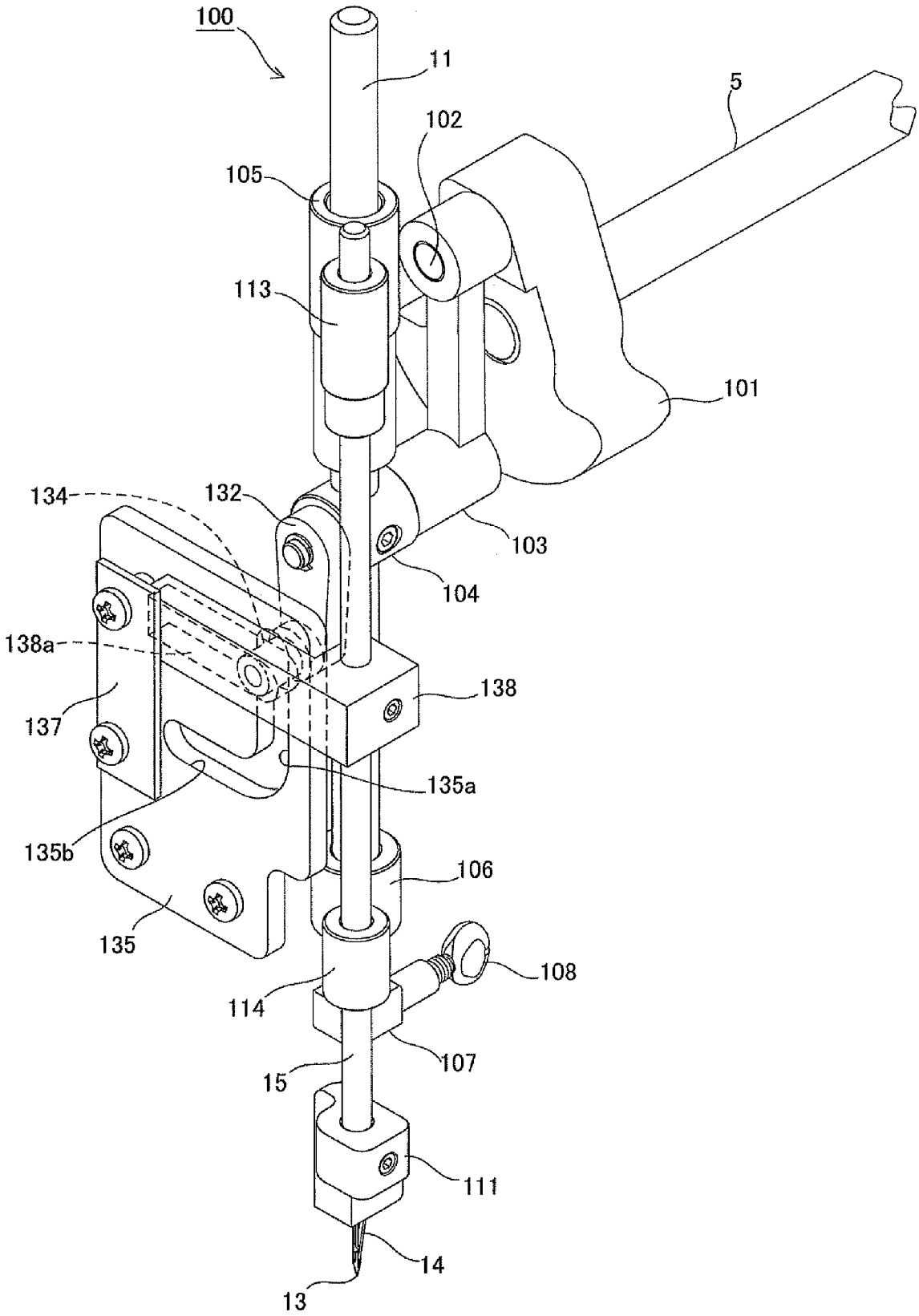
FIG. 3 (A) A perspective view showing the open eye needle-latch wire drive mechanism in the single-thread locked handstitch sewing machine of this invention, wherein (A) is a view that the open eye needle is in the upper dead center.
Figure 3:
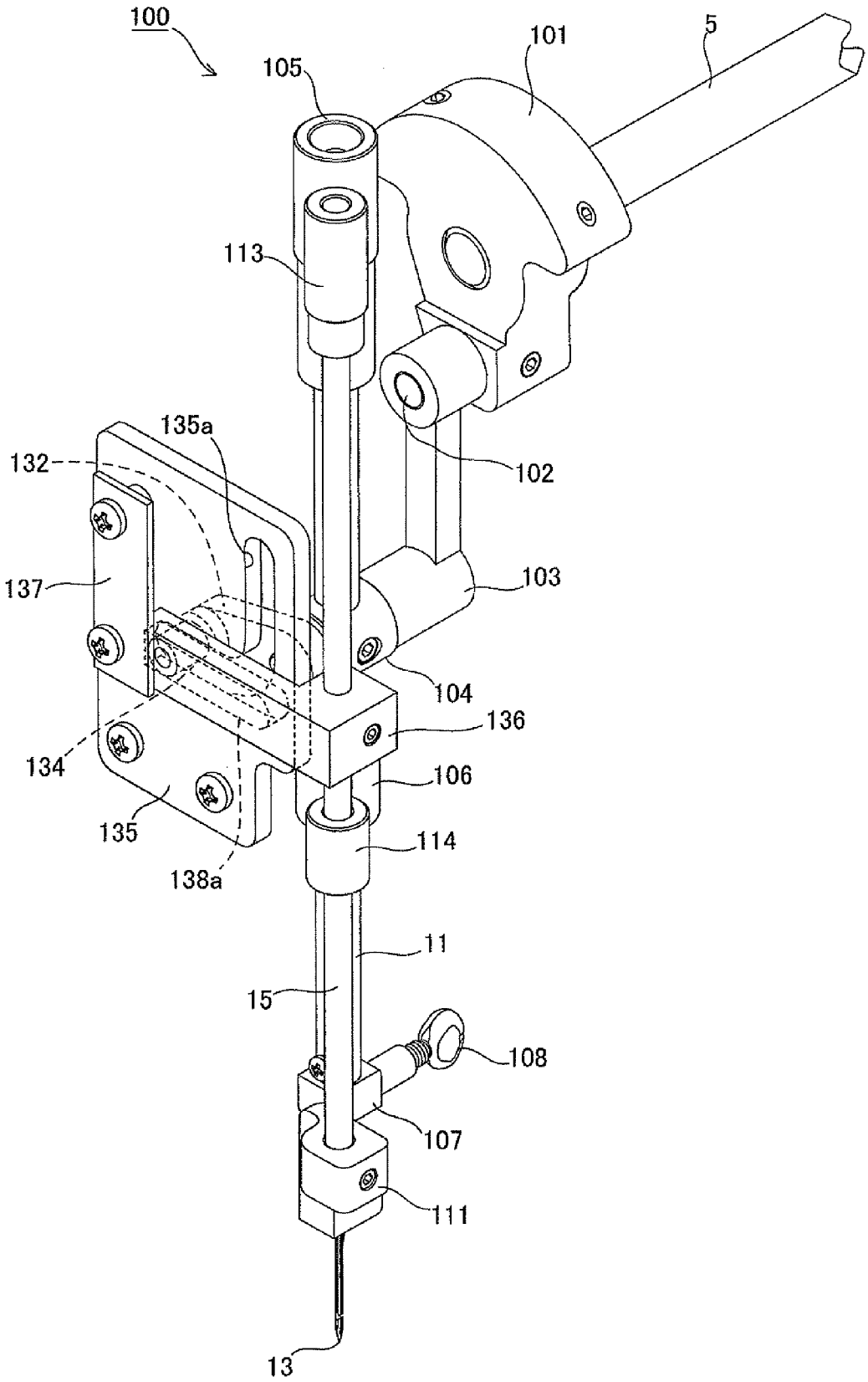

In the open eye needle-latch wire drive mechanism 100, the open eye needle 13 is fixed to a needle clamp 107, and the needle clamp 107 is fixed to the lower end portion of a needle bar 11 which is installed at the arm 1*b* by a needle clamp screw 108 in the state that the reciprocating motion can perform linearly and vertically by a needle bar upper bushing 105 and a needle bar lower bushing 106 (FIG. 3 (A)). And, a needle bar holder 104 is fixed to the needle bar 11 between the needle bar upper bushing 105 and the needle bar lower bushing 106. A crank rod pin 102 which is formed in this needle bar holder 104 is rotatably connected to one end of a needle bar crank rod 103, and another end of the needle bar crank rod 103 is rotatably connected to the needle bar crank 101 which is fastened to another end of the upper shaft 5 by the crank rod pin 102. Therefore, because the needle bar crank rod 103 cranks by the rotation of the upper shaft 5 through the needle bar crank 101, the needle bar 11 that the open eye needle 13 is fixed by the needle clamp 107 performs the linear reciprocating motion vertically by the needle bar holder 104.

Figure 4:
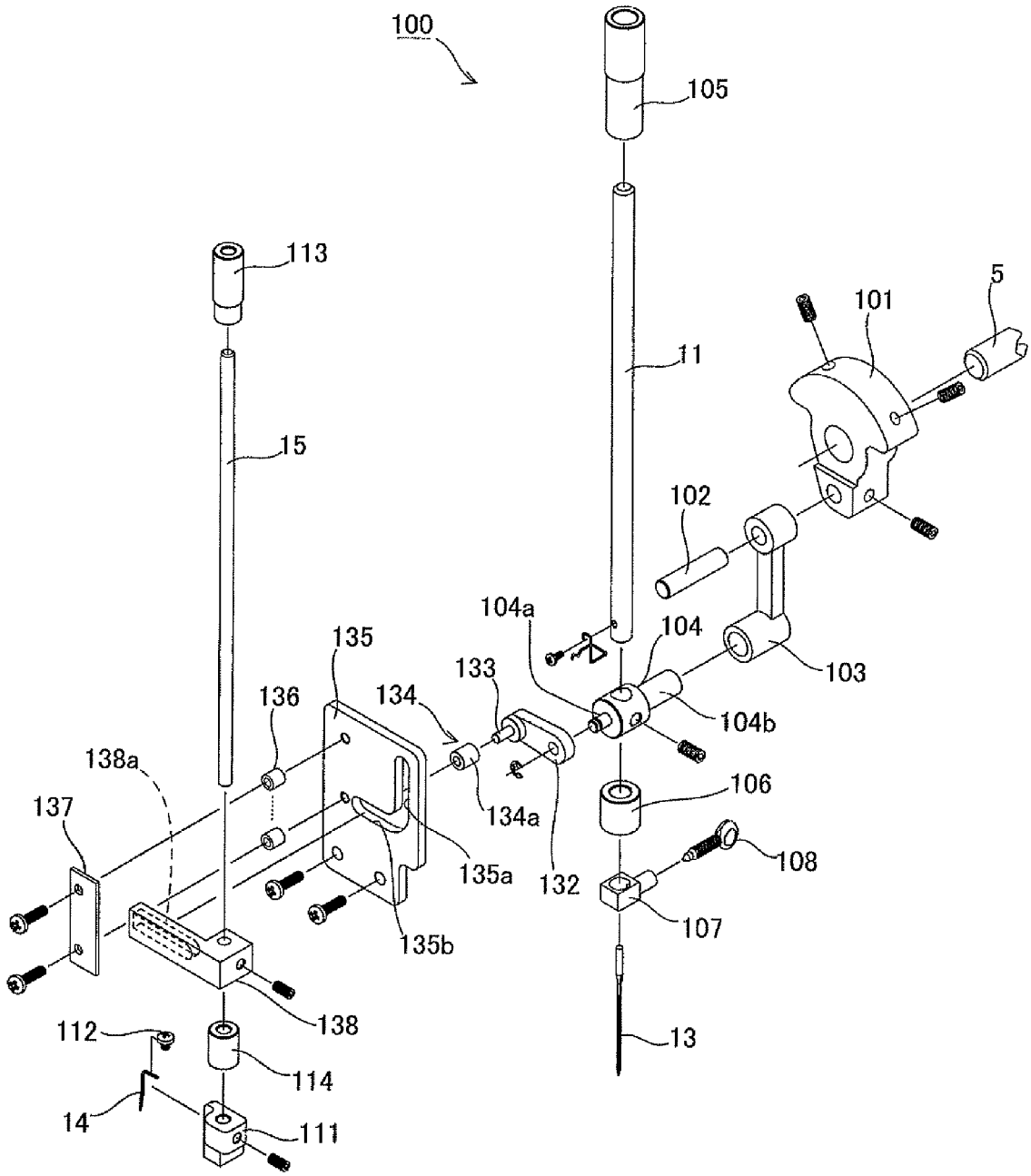
FIG. 4 An exploded perspective view showing the open eye needle-latch wire drive mechanism in the single-thread locked handstitch sewing machine of this invention.

As shown in FIGS. 3 (A), (B) and FIG. 4 the open eye needle-latch wire drive mechanism 100 is provided with a latch wire drive link 132, a latch wire bar drive arm 138 and a plate groove cam 135. One end of the latch wire drive link 132 is pivotally attached to the needle bar 11 and another end has a roller follower 134. The latch wire bar drive arm 138 has a groove 138*a* which is fixed to the latch wire bar 15 and fits in the roller follower 134 horizontally and movably. In the plate groove cam 135, a vertical groove 135*a* and a horizontal groove 135*b* are formed. And the roller follower 134 is fitted into the vertical groove 135*a* and the horizontal groove 135*b*. The vertical groove 135*a* lets the roller follower 134 move to the vertical direction toward the lower dead center from the upper dead center of the open eye needle 13. And, the horizontal groove 135*b* lets the roller follower 134 which moves toward the lower dead center move horizontally at the predetermined position. And, the plate groove cam 135 is fixed to the arm 1*b*.

One end of the latch wire drive link 132 is rotatably held by the pin 104*a* which is formed at one end of the needle bar holder 104. The crank rod pin 104*b* is formed at another end of the needle bar holder 104, and one end of the needle bar crank rod 103 is rotatably connected to the crank rod pin 104*b*. The needle bar holder 104 is fixed to the needle bar 11 between the needle bar upper bushing 105 and the needle bar lower bushing 106. And, a roller shaft 133 is formed at another end of the latch wire drive link 132, and the roller follower 134 is composed by holding a roller 134*a* rotatably.

The latch wire bar drive arm 138 is fixed to the latch wire bar 15 between the latch wire bar upper bushing 113 and the latch wire bar lower bushing 114. Besides, the thread capturing open eye 13*a* of the open eye needle 13 is opened and closed by the latch wire 14. This latch wire 14 is fixed to a latch wire clamp 111 by a latch wire clamp screw 112, and the latch wire clamp 111 is fixed to the lower end portion of a latch wire bar 15 which was installed in the arm 1*b* in the state that the linear reciprocating motion can perform vertically by a latch wire bar upper bushing 113 and a latch wire bar lower bushing 114. And, the vertical groove 135*a* and the horizontal groove 135*b* link by the curved groove, and thereby, the plate groove cam 135 is formed in the shape of L.

In the open eye needle-latch wire drive mechanism 100 constituted as described above, in the period that the thread capturing open eye 13*a* of the open eye needle 13 comes down from the upper dead center and pierces the fabric workpiece 21 and passes through the throat plate 12, and in the period that the thread capturing open eye 13*a* of the open eye needle 13 goes up from the lower dead center and passes through the throat plate 12 and slips out from the fabric workpiece 21 and reaches the upper dead center, the latch wire 14 which covers the thread capturing open eye 13*a* can be driven.

Figure 5:
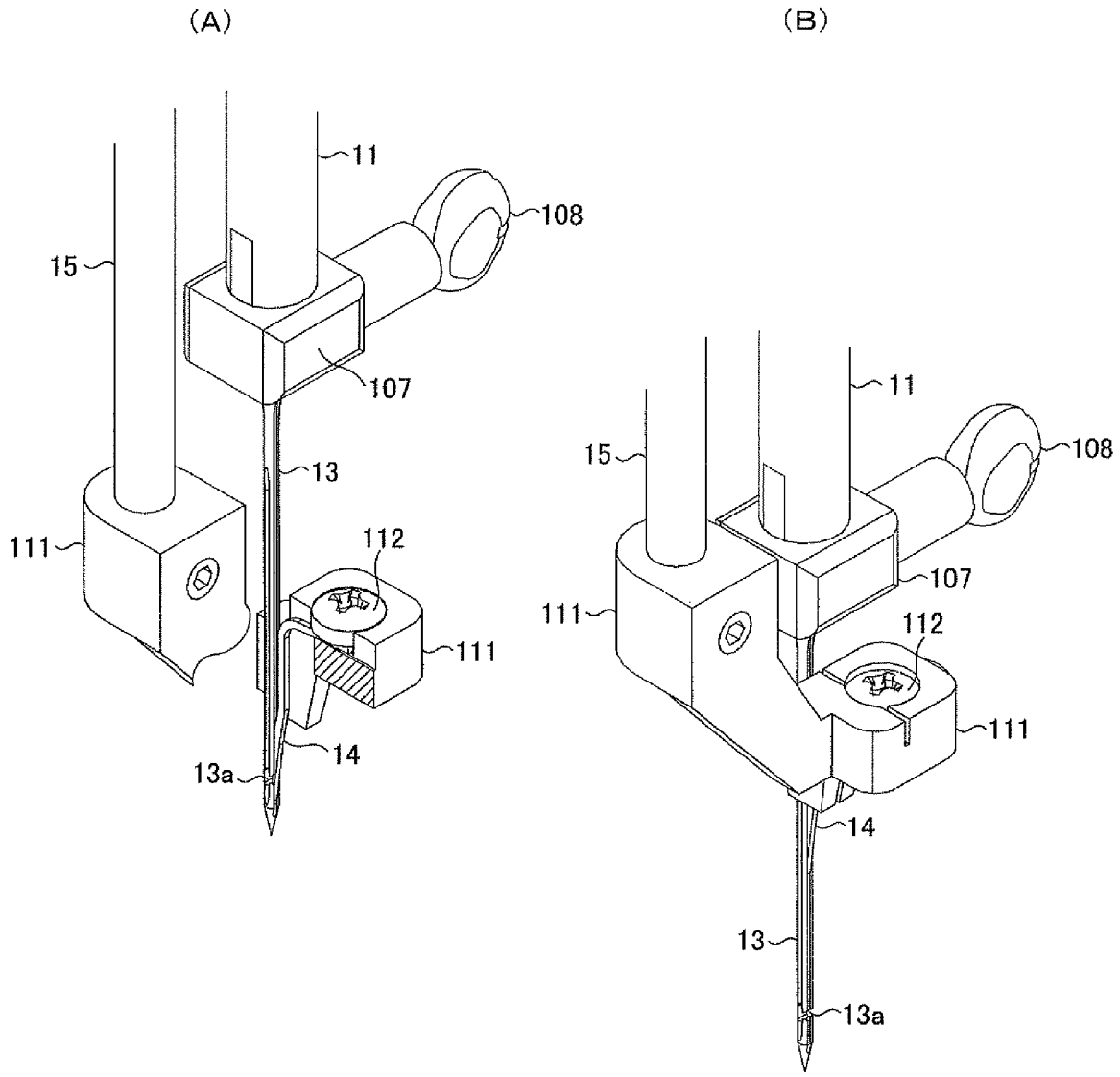
FIG. 5 A perspective view showing the relation between the open eye needle and the latch wire, wherein (A) is view that the thread capturing open eye of the open eye needle is closed state by the latch wire, (B) is a view that the thread capturing open eye of the open eye needle is open state.

Concretely, as shown in FIG. 3 (A), when the needle bar 11 goes up by the rotation of the upper shaft 5, the roller follower 134 of the latch wire drive link 132 goes up along the vertical groove 135*a* of the plate groove cam 135, and the latch wire bar drive arm 138 goes up. In this case, as shown in FIG. 5 (A) and FIG. 6 (A), because the latch wire 14 also goes up through the needle bar 15 that the latch wire bar drive arm 138 is fixed along with the rise of open eye needle 13, the thread capturing open eye 13*a* of the open eye needle 13 becomes closed state by the latch wire 14. That is, in the period that the thread capturing open eye 13*a* of the open eye needle 13 comes down from the upper dead center and pierces the fabric workpiece 21 and passes through the throat plate 12, and in the period that the thread capturing open eye 13*a* of the open eye needle 13 goes up from the lower dead center and passes through the throat plate 12 and slips out from the fabric workpiece 21 and reaches the upper dead center, the thread capturing open eye 13*a* is closed by the latch wire 14. Besides, as shown in FIG. 3 (B), when the needle bar 11 comes down by the rotation of the upper shaft 5, after the roller follower 134 of the latch wire drive link 132 comes down along the vertical groove 135*a* of the plate groove cam 135, it moves horizontally along the horizontal groove 135*b*. In this case, as shown in FIG. 5 (B) and FIG. 6 (B), although the open eye needle 13 comes down, the latch wire bar drive arm 138 stops. Thereby, the thread capturing open eye 13*a* of the open eye needle 13 becomes open state. That is, after the thread capturing open eye 13*a* of the open eye needle 13 comes down from the upper dead center, and pierces the fabric workpiece 21, and passes through the throat plate 12, because the latch wire 14 disengages from the thread capturing open eye 13*a*, the thread capturing open eye 13*a* is opened.

As described above, the reason to drive the latch wire 14 by the open eye needle-latch wire drive mechanism 100 is as follows. When the open eye needle 13 pierces the fabric workpiece 21, the occurrence of the thread breakage by hooking the thread of the fabric workpiece 21 by the thread capturing open eye 13*a* is prevented. And, it is prevented that the captured thread slips out from the thread capturing open eye 13*a*.

Figure 7:
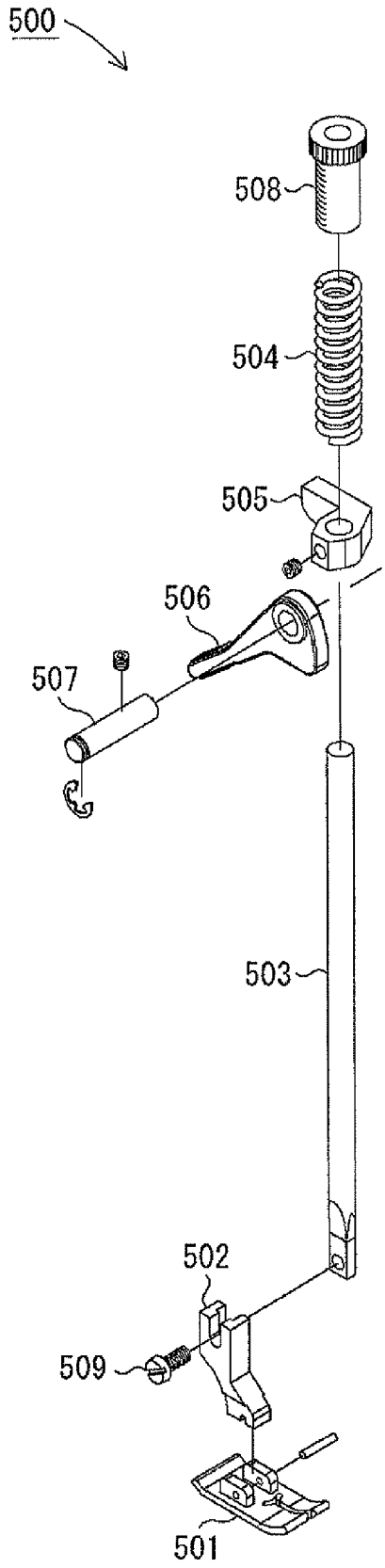
FIG. 7 An exploded perspective view showing the presser mechanism in the single-thread locked handstitch sewing machine of this invention.

In the neighborhood of the open eye needle-latch wire drive mechanism 100, as shown in FIG. 1 and FIG. 2, a presser mechanism 500 for operating the presser foot 501 to press the fabric workpiece 21 to the throat plate 12 is provided. As shown in FIG. 7, the presser mechanism 500 is installed to the arm 1*b* in the state that a presser bar 503 can perform the linear reciprocating motion vertically, and a presser foot leg 502 that the presser foot 501 was swingably assembled at the lower end portion of the presser bar 503 is fixed by a presser stopper screw 509. And, a presser bar pressure adjusting screw 508 is fixed at the upper portion of the presser bar 503, and the presser bar pressure adjusting screw 508 is screwed at the upper portion of the arm 1*b*. A presser bar holder 505 is fixed to the presser bar 503, and a presser foot pressure adjusting spring 504 is fitted into the presser bar 503 between the presser bar holder 505 and the lower surface of the arm 1*b*. The suppress strength to the fabric workpiece 21 of the presser foot 501 by the presser foot pressure adjusting spring 504 can be adjusted by turning the presser bar pressure adjusting screw 508. In addition, in order to let the presser foot 501 go up and down, a presser upholding lever 506 which engages to the presser bar holder 505 is rotatably provided to a presser upholding lever shaft 507 which is fixed to the arm 1*b*. The presser bar holder 505 goes up when the presser upholding lever 506 goes up, and the presser bar holder 505 comes down when the presser upholding lever 506 comes down. Therefore, the space between the presser foot 501 and the throat plate 12 is made when the presser upholding lever 506 goes up, and the fabric workpiece 21 is pressed to the throat plate 12 by the presser foot 501 when the presser upholding lever 506 comes down after placing the fabric workpiece 21 onto the throat plate 12, thereby, the fabric workpiece 21 can be set onto the throat plate 12.

Figure 8:
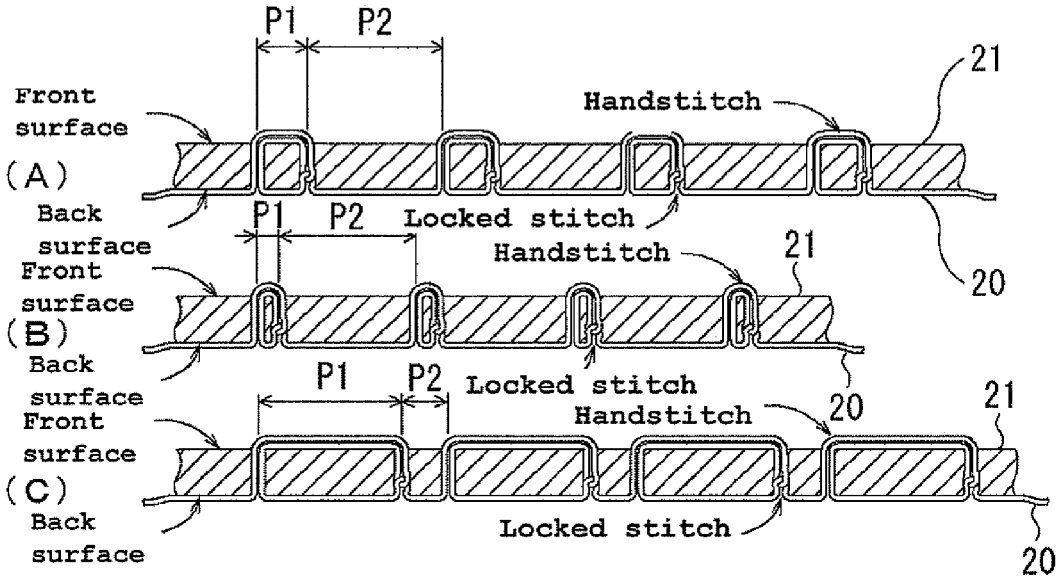
FIG. 8 An explanatory view showing the structure of the quasi-handstitch which is obtained by the method and sewing machine for forming single-thread locked handstitches of this invention.

As shown in FIG. 1 and FIG. 2, in order to feed the fabric workpiece 21 with one stitch length while the open eye needle 13 slips out from the fabric workpiece 21, goes up and passes through the upper dead center in the first stroke, and in order to feed the fabric workpiece 21 with one inter-stitch pitch while the open eye needle 13 slips out from the fabric workpiece 21, goes up and passes through the upper dead center in the second stroke, the cloth feed mechanism 600 is provided with the feed dog 601. Here, as shown in FIGS. 8 (A), (B) and (C), one stitch length P1 of the stitch feed is the stitch length of the handstitch which is formed on the front surface of the fabric workpiece 21, and one inter-stitch pitch P2 of the inter-stitch feed is the space length between the continuous two handstitches.

Figure 9:
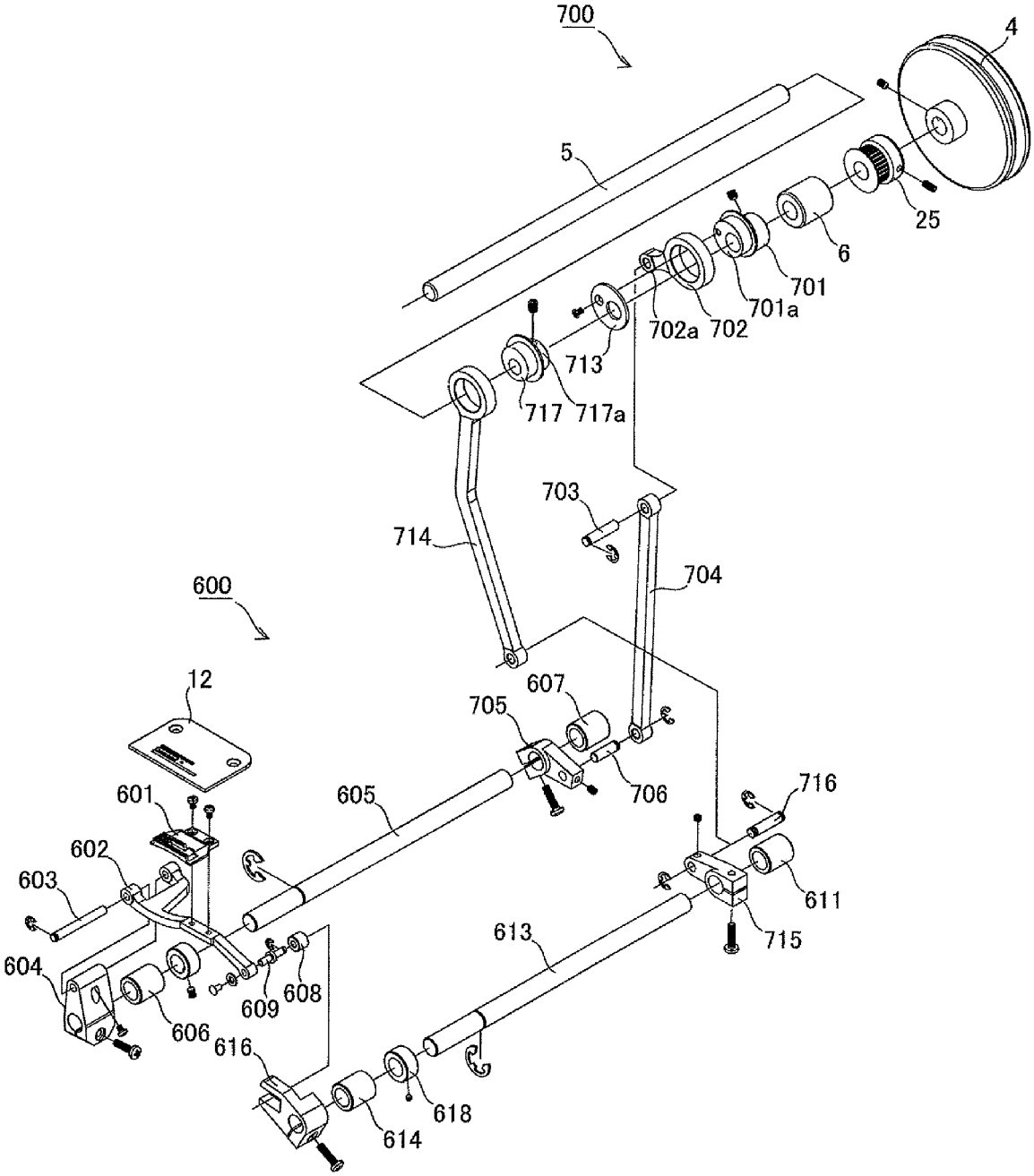
FIG. 9 An exploded perspective view showing the cloth feed mechanism and the cloth feed drive mechanism in the single-thread locked handstitch sewing machine of this invention.
Figure 10:
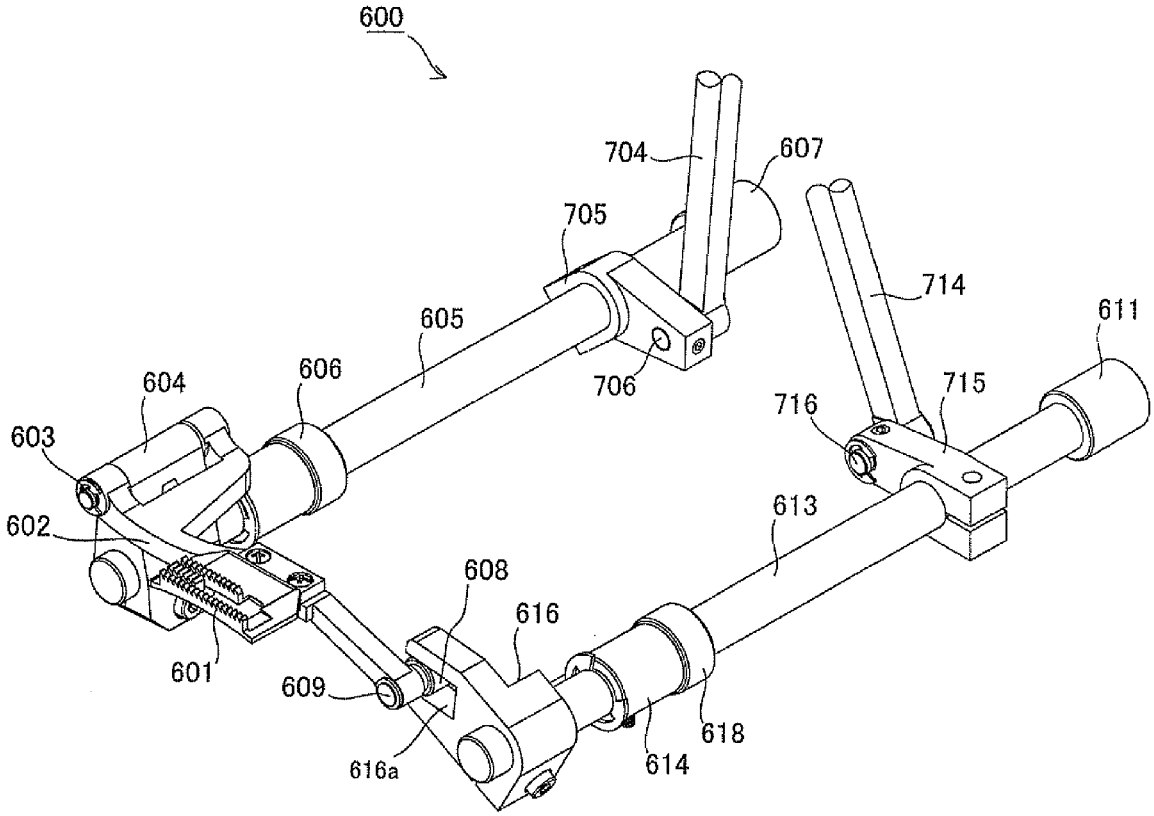
FIG. 10 A perspective view showing the cloth feed mechanism in the single-thread locked handstitch sewing machine of this invention.

As shown in FIG. 2, FIG. 9 and FIG. 10, the cloth feed mechanism 600 is provided at the lower side of the throat plate 12, and the feed dog 601 is fixed to the almost center portion of a feed base 602. The one end of the feed base 602 is rotatably connected by a horizontal feed arm shaft 603 to a horizontal feed arm 604 which is fixed to one side of the horizontal feed shaft 605. Therefore, because the horizontal feed arm 604 performs the reciprocating rocking by reciprocating and rotating the horizontal feed shaft 605, the feed dog 601 can perform the reciprocating motion horizontally.

And, a upper and lower feed roller shaft 609 is fixed to another end of the feed base 602, and a upper and lower feed roller 608 is rotatably provided to the upper and lower feed roller shaft 609. The upper and lower feed roller 608 is inserted slidably to a forked portion 616*a* of a feed dog up and down drive fork 616 which is fixed to one side of the upper and lower feed shaft 613. Therefore, because the feed dog up and down drive fork 616 performs the reciprocating rocking by reciprocating and rotating the upper and lower feed shaft 613, the upper and lower feed roller 608 which fits into the feed dog up and down drive fork 616 can let another end of the feed base 602 reciprocate up and down.

As shown in FIG. 9, the cloth feed drive mechanism 700 transmits a stitch length feed quantity and a inter-stitch pitch feed quantity which are setup in the after-mentioned feed quantity setting mechanism 300 in each fabric workpiece feed mode respectively, and it feeds the fabric workpiece 21 by the feed dog 601. And, in the cloth feed drive mechanism 700, a horizontal feed cam 701 which reciprocates and rotates the horizontal feed shaft 605 and an upper and lower feed cam 717 which is fixed to the upper shaft 5 and which reciprocates and rotates the upper and lower feed shaft 613 are fixed to the upper shaft 5. In this specification, "each fabric workpiece feed mode" means the stitch length feed and the inter-stitch pitch feed.

The horizontal feed cam 701 is an eccentric cam. A horizontal feed drive rod 702 is rotatably fitted into a cam portion 701*a*, and the one end of a horizontal feed vertical rod 704 is rotatably connected to an arm end 702*a* of the horizontal feed drive rod 702 by a linking pin 703. Another end of the horizontal feed vertical rod 704 is rotatably connected with a horizontal feed shaft drive arm 705 which is fixed to another side of the horizontal feed shaft 605 by a linking pin 706. Therefore, because the horizontal feed drive rod 702 performs the eccentric motion by the horizontal feed cam 701 when the upper shaft 5 rotates, the horizontal feed vertical rod 704 performs the up-and-down motion and the horizontal feed shaft 605 can perform the reciprocating rotation by the horizontal feed shaft drive arm 705.

The upper and lower feed cam 717 is the eccentric cam. The one end of a feed dog up and down drive vertical rod 714 is rotatably fitted into a cam portion 717*a*, and another end of the feed dog up and down drive vertical rod 714 is rotatably connected to a feed dog up and down shaft drive arm 715 which is fixed to another side of the upper and lower feed shaft 613 by a linking pin 716. Therefore, because the one end of the feed dog up and down drive vertical rod 714 performs the eccentric motion by the horizontal feed cam 701 when the upper shaft 5 rotates, the feed dog up and down drive vertical rod 714 itself performs the up-and-down motion and the upper and lower feed shaft 613 can perform the reciprocating rotation by the feed dog up and down shaft drive arm 715.

As just described, by reciprocating and rotating the horizontal feed shaft 605, the horizontal feed arm 604 performs the reciprocating rocking and it lets the feed base 602 reciprocate horizontally. And, by reciprocating and rotating the upper and lower feed shaft 613, the feed dog up and down drive fork 616 performs the reciprocating rocking and the upper and lower feed roller 608 which fits into the feed dog up and down drive fork 616 lets another end of the feed base 602 reciprocate in the upper and lower direction. Therefore, the feed dog 601 which is fixed to the feed base 602 can perform so-called four feed process elliptical movements which is rise→advance→descend→retreat.

Figure 11:
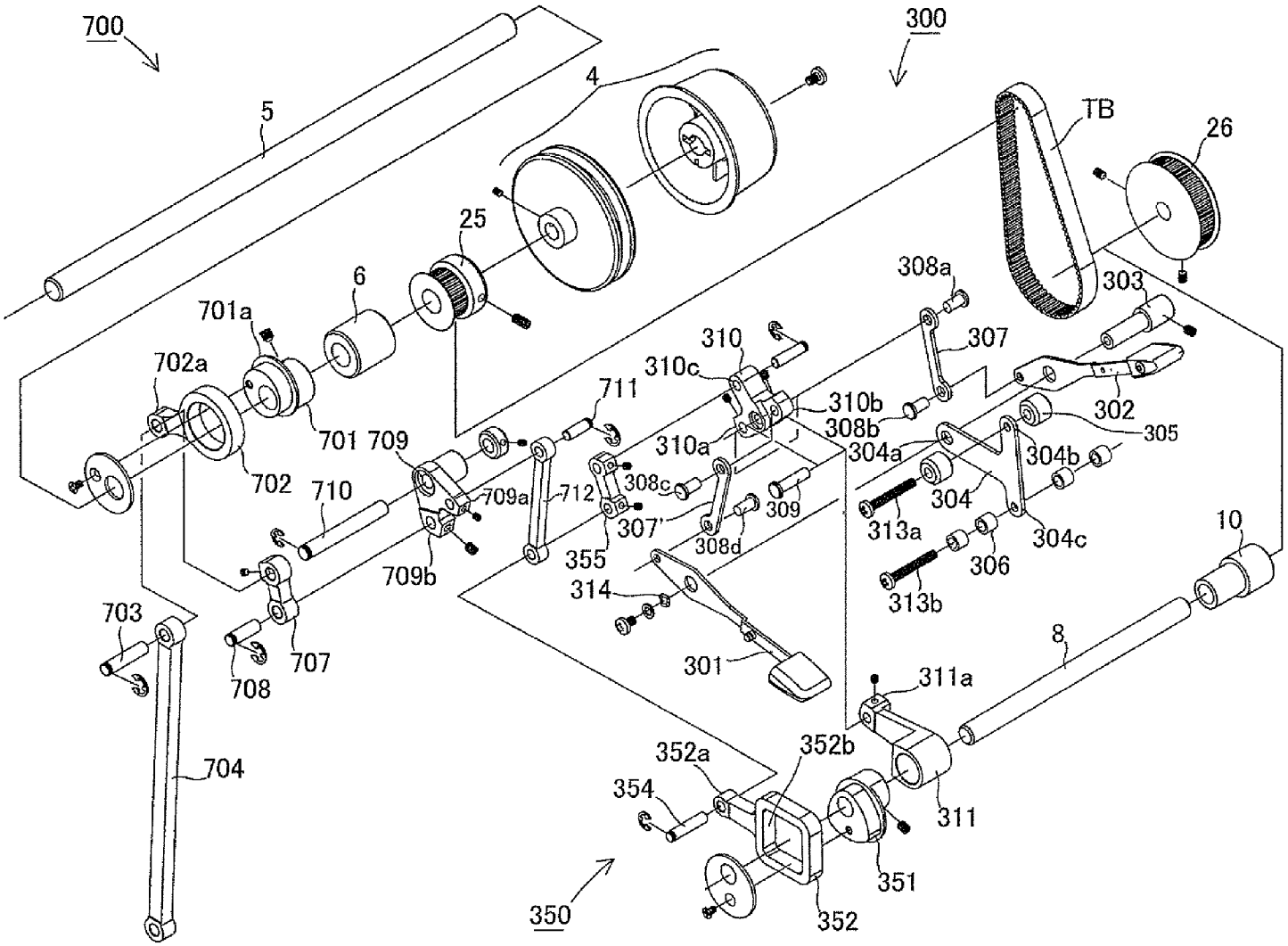
FIG. 11 An exploded perspective view showing the cloth feed drive mechanism, the feed quantity setting mechanism, and the mode changeover mechanism in the single-thread locked handstitch sewing machine of this invention.
Figure 12:
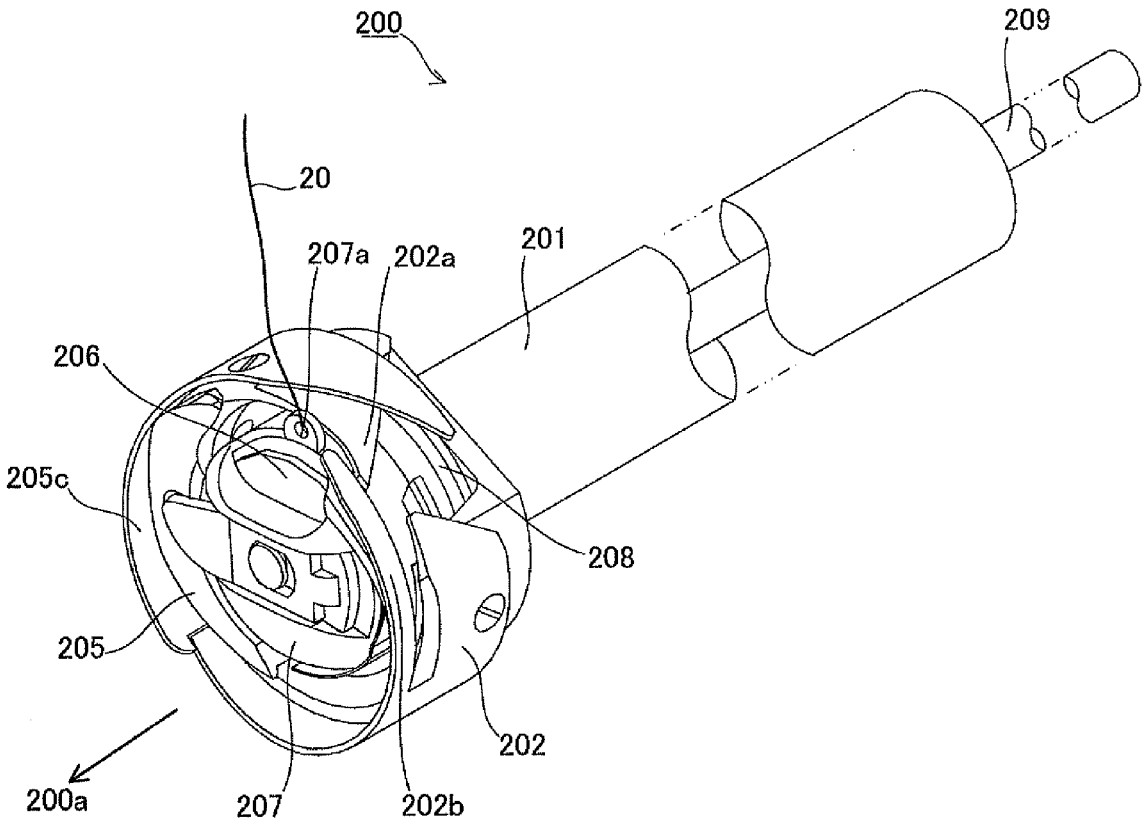
FIG. 12 A perspective view showing the rotary hook which is composed by the rocking bobbin casing which is loaded in the rotative outer rotary hook in the single-thread locked handstitch sewing machine of this invention.
Figure 13:
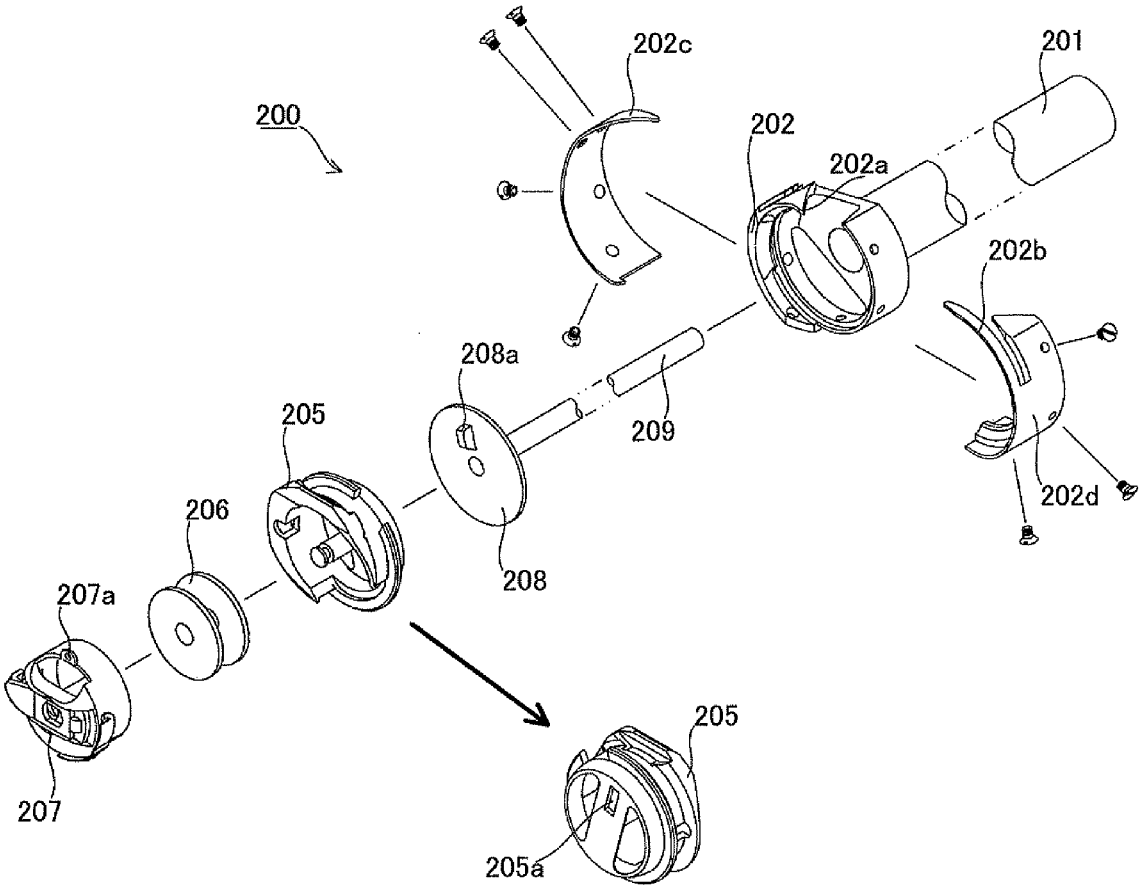
FIG. 13 An exploded perspective view showing the rotary hook which is composed by the rocking bobbin casing which is loaded in the rotative outer rotary hook in the single-thread locked handstitch sewing machine of this invention.

As shown in FIG. 11, the feed quantity setting mechanism 300 sets a stitch length feed quantity of a stitch length feed and an inter-stitch pitch feed quantity of an inter-stitch pitch feed respectively. And the feed quantity setting mechanism 300 comprises a reverse T-shaped feed adjuster 310 which is pivotally attached to a supporting arm 311 which is pivotally supported to the intermediate shaft 8 which is decelerated with one-half from the upper shaft 5 which drives the open eye needle 13. A stitch feed adjusting lever 301 which is a stitch length feed quantity operating member and a inter-stitch feed adjusting lever 302 which is an inter-stitch pitch feed quantity operating member are pivotally attached to both arms which become a horizontal arm of the reverse T-shaped feed adjuster 310.

Concretely, an arm end 311*a* of the supporting arm 311 connects with the portion which crosses the horizontal arm and the vertical arm of the reverse T-shaped feed adjuster 310 by a feed adjuster pin 309 rotatably, and it is rotatably fitted into the intermediate shaft 8. One end of a first adjusting lever link 307 is rotatably connected with one horizontal arm end 310*a* of the reverse T-shaped feed adjuster 310 by a linking pin 308*a*, and the portion which becomes the operating point of the inter-stitch feed adjusting lever 302 is rotatably connected with another end of the first adjusting lever link 307 by a linking pin 308*b*. One end of a second adjusting lever link 307' is rotatably connected with another horizontal arm end 310*b* of the reverse T-shaped feed adjuster 310 by a linking pin 308*c*, and the portion which becomes the operating point of the stitch feed adjusting lever 301 is rotatably connected with another end of the second adjusting lever link 307' by a linking pin 308*d*. In the stitch feed adjusting lever 301 and the inter-stitch feed adjusting lever 302, the portions which become the fulcrums respectively are rotatably provided at an adjusting lever shaft 303 which is fixed to the support pedestal portion 1*c*. Besides, between the inter-stitch feed adjusting lever 302 and the stitch feed adjusting lever 301 which are rotatably provided at a adjusting lever shaft 303, a vertical arm end 304*a* of a T-shaped adjusting lever partition plate 304 is provided at the adjusting lever shaft 303, and it is fixed to the support pedestal portion 1*c* by a setscrew 313*a* and 313*b* so that one horizontal arm end 304*b* which becomes the horizontal arm is positioned upward and another end of the horizontal arm 304*c* is positioned downward. Further, a partition plate upper spacer 305 is fixed to one horizontal arm end 304*b* by the setscrew 313*a*, and a partition plate lower spacer 306 is fixed to another horizontal arm end 304*c* by the setscrew 313*b*. The partition plate upper spacer 305 is the stopper of the upward position of the portion which becomes the point of force of the inter-stitch feed adjusting lever 302 and the stitch feed adjusting lever 301, and the partition plate lower spacer 306 is the stopper of the downward position of the portion which becomes the point of force of the inter-stitch feed adjusting lever 302 and the stitch feed adjusting lever 301. In addition, the inter-stitch feed adjusting lever 302 and the stitch feed adjusting lever 301 are pivotally supported to the adjusting lever shaft 303 that the portion which becomes the fulcrum is firmly fixed to the support pedestal portion 1*c*, and it stops at the position which is set by the operation of the portion of the point of force which becomes the operating finger grip in the state pressed by the elastic member 314 such as the wavelike washer. Hereinafter, this stopped state is called semi-fixing.

Besides, as shown in FIG. 1 and FIG. 2, a feed mode changeover mechanism 350 which changes over every one skip stitch set in sequence to each fabric workpiece feed mode corresponding to the stitch length feed and the inter-stitch pitch feed respectively is provided. In this specification, "skip stitch set" means a set of the handstitch and the locked stitch.

As shown in FIG. 11, the feed mode changeover mechanism 350 is provided with a feed changeover triangular cam 351 which is firmly fixed to the intermediate shaft 8 and has two deviating points and a feed changeover rod 352 which contacts to the outside of the feed changeover triangular cam 351. A connecting end 352*a* of the feed changeover rod 352 is pivotally attached to one end of a stitch length changeover link 355, and another end of the stitch length changeover link 355 is pivotally attached to a vertical arm end 310*c* of the reverse T-shaped feed adjuster 310. Concretely, the feed changeover triangular cam 351 contacts to the outside of an almost quadrangular cam hole 352*b* which is formed in the feed changeover rod 352, and the connecting end 352*a* of the feed changeover rod 352 is rotatably connected to one end of the stitch length changeover link 355 by a linking pin 354, and another end of the stitch length changeover link 355 is rotatably connected to the vertical arm end 310*c* of the reverse T-shaped feed adjuster 310 by a linking pin 312.

In addition, in the feed changeover triangular cam 351, although one skip stitch set having two even-numbered deviating points is formed, not only this, as a feed changeover cam having four or more even-numbered deviating points, the forming of the multiple skip stitch sets is also possible.

Besides, as shown in FIG. 11, the cloth feed drive mechanism 700 is provided with a horizontal feed connection link 712 whose one end is pivotally attached to the connecting end 352*a* of the feed changeover rod 352, a horizontal feed connection crank 709 whose first arm 709*a* is pivotally attached to another end of the horizontal feed connection link 712, and a horizontal feed rod link 707 whose one end is pivotally attached to a second arm 709*b* of the horizontal feed connection crank 709 and whose another end is pivotally attached to the horizontal feed vertical rod 704.

Concretely, one end of the horizontal feed connection link 712 is rotatably connected to the connecting end 352*a* of the feed changeover rod 352 by the linking pin 354, and another end of the horizontal feed connection link 712 is rotatably connected to the first arm 709*a* of the horizontal feed connection crank 709 by a linking pin 711, and the second arm 709*b* of the horizontal feed connection crank 709 rotatably is connected to one end of the horizontal feed rod link 707 by a linking pin 708. Another end of the horizontal feed rod link 707 rotatably is connected to the horizontal feed vertical rod 704 and an arm end 702*a* of the horizontal feed drive rod 702 by the linking pin 703.

Further, an intermediate shaft driven pulley 26 is fixed to one end of the intermediate shaft 8, and a timing belt TB which is the endless belt is wound to this intermediate shaft driven pulley 26 and the upper shaft drive pulley 25 which is fixed to the upper shaft 5. In the intermediate shaft driven pulley 26 and the upper shaft drive pulley 25, a rotational motion is transmitted to the intermediate shaft 8 by decelerating one-half from the upper shaft 5.

In addition, the operations of the feed quantity setting mechanism 300 and the feed mode changeover mechanism 350 are explained in detail in the after-mentioned explanation of operation.

As shown in FIG. 1 and FIG. 2, the rotary hook 200 is composed in the following mechanism. By going up from the brink that the open eye needle 13 reaches the lower dead center, the thread exit 207*a* of the bobbin case 207 which houses the bobbin 206 that the thread 20 which is incorporated in the bobbin casing 205 is wound is swung by swinging the bobbin casing 205 which is loaded in the outer rotary hook 202 of the rotary hook 200 which rotates at the lower direction of the throat plate 12. Thereby, the thread 20 which is drawn out from the thread exit 207*a* is contacted circumferentially on the open eye needle 13 and is tensed. While the open eye needle 13 slips out from the fabric workpiece 21, goes up, and passes through the upper dead center in the first stroke, the fabric workpiece 21 is fed with one stitch length. And, when the open eye needle 13 comes down from the upper dead center, pierces to the fabric workpiece 21, and goes up from the lower dead center, by having a loop-taker point 202*a* of the outer rotary hook 202 of the rotary hook 200 which rotates which scoops the captured thread 20 by the thread capturing open eye 13*a*, and by releasing the captured thread 20 from the thread capturing open eye 13*a* by the rotation of the outer rotary hook 202, and by rotating the captured thread 20 which is scooped and released by the rotation of the loop-taker point 202*a* of the outer rotary hook 202 by the further rotation of the outer rotary hook 202, the thread 20 is guided in the rotary hook 200, and crosses the thread 20 which is wound in the bobbin case 207.

As shown in FIG. 12, FIG. 13, FIG. 14 and FIG. 15, such the rotary hook 200 incorporates removably the bobbin case 207 which houses the bobbin 206 that the thread 20 is wound into the bobbin casing 205, and the bobbin case 207 is swingably loaded together with the bobbin casing 205 in the outer rotary hook 202. The outer rotary hook 202 has the loop-taker point 202*a*.

Besides, the outer rotary hook 202 has the pipy rotary hook shaft 201 which is composed with the outer rotary hook 202 integrally. And the rotary hook shaft 201 is driven by the timing belt 231 which is tightened between the rotary hook drive pulley 230 which is provided at the above-mentioned upper shaft 5 and a rotary hook shaft pulley 232 which is provided at the rotary hook shaft 201. Thereby, the outer rotary hook 202 of the rotary hook 200 is rotated and driven by the rotation number ratio of 1:1 with the upper shaft 5. In addition, the outer rotary hook 202 of the rotary hook 200 may be rotated and driven by the rotation number ratio of 1:2 with the upper shaft 5.

In this single-thread locked handstitch sewing machine, the outer rotary hook 202 is provided with a outer rotary hook deviator 202*b* which deviates the thread 20 of the brink of guiding out from the rotary hook 200 to the direction of letting go from the plane of rotation of the loop-taker point 202*a* (that is, a rotary hook opening part direction 200*a*), and avoids that the loop-taker point 202*a* hooks the thread 20 which guides out from the rotary hook 200. The outer rotary hook deviator 202*b* is provided at a part of a bobbin casing holder 202*d* which holds the bobbin casing 205, and guides the thread 20 which guides in to the rotary hook 200 together with a thread guide spring 202*c* and guides out.

Figure 14:
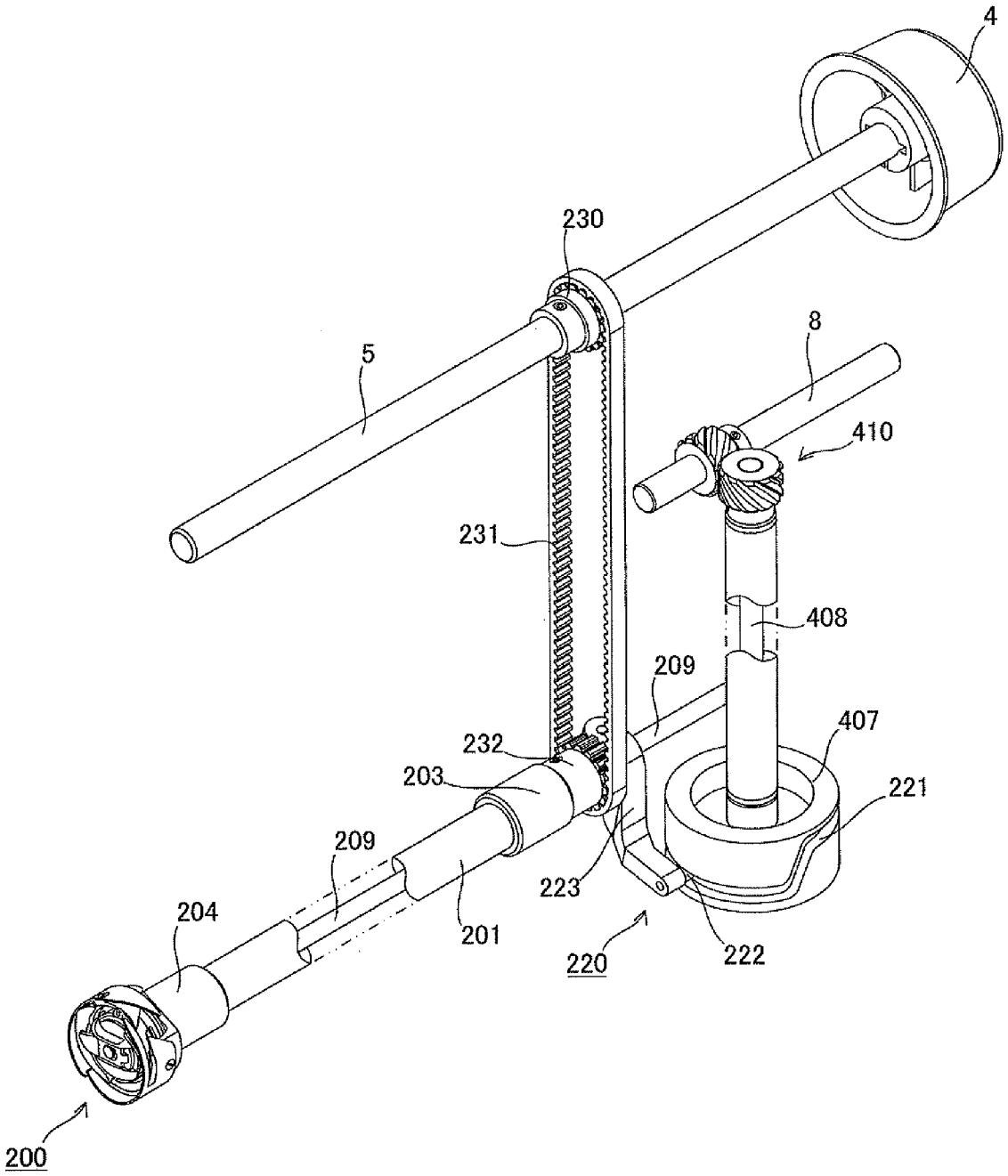
FIG. 14 A perspective view showing the outer rotary hook drive portion and the bobbin casing rocking mechanism in the single-thread locked handstitch sewing machine of this invention.
Figure 15:
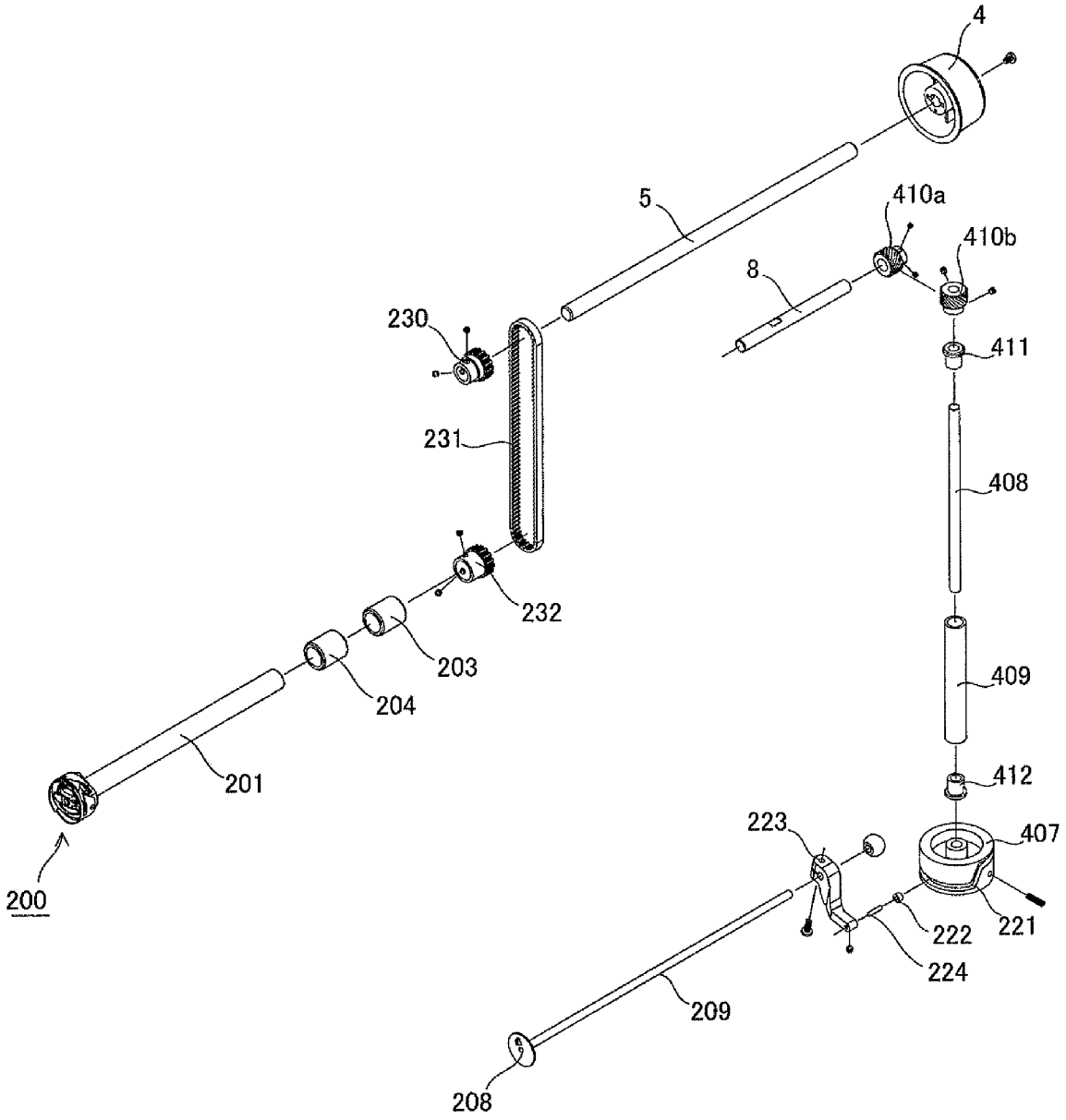
FIG. 15 An exploded perspective view showing the outer rotary hook drive portion and the bobbin casing rocking mechanism in the single-thread locked handstitch sewing machine of this invention.

Besides, as shown in FIG. 1, FIG. 14 and FIG. 15, the bobbin casing 205 of the rotary hook 200 is driven swingably by a rocking actuator 208 from the bobbin casing rocking mechanism 220. That is, the bobbin casing rocking mechanism 220 is composed by a spiral gear 410 which is provided at the intermediate shaft 8 and converts the rotational motion in the horizontal direction into the rotational motion in the vertical direction, a thread draw out actuator drive cam shaft 408 which transmits the rotational motion which is converted into the vertical direction from the horizontal direction by the spiral gear 410, and a thread draw out actuator drive cam 407 which is fixed to the thread draw out actuator drive cam shaft 408. A cam follower 222 which is pivotally supported at a pin 224 which is fixed to one end of a bobbin casing rocking arm 223 is driven along a bobbin casing rocking groove 221 which is provided laterally at a circumference of the thread draw out actuator drive cam 407, and a rocking actuator shaft 209, therefore, the bobbin casing 205 is rocked by the bobbin casing rocking arm 223.

In the intermediate shaft driven pulley 26 and the upper shaft drive pulley 25, a rotational motion is transmitted to the intermediate shaft 8 by decelerating one-half from the upper shaft 5. The bobbin casing rocking groove 221 has one wave which changes up and down every one revolution. In this way, the bobbin casing 205 rocks with the rotation of the upper shaft 5, therefore, with the up-and-down motion of the open eye needle 13 with 2:1.

Besides, in bobbin casing 205, a concave portion 205*a* which is provided at the bobbin casing 205 and a convex portion 208*a* which is provided at the rocking actuator 208 engage by having a gap that the thread 20 which is scooped by the loop-taker point 202*a* and guided in to the rotary hook 200 can pass through without friction, and the bobbin casing 205 is driven by the rocking actuator 208. The rocking actuator 208 has the rocking actuator shaft 209 which is composed with the rocking actuator 208 integrally, and the rocking actuator shaft 209 is arranged at the pipy rotary hook shaft 201 concentrically. The rocking actuator shaft 209 is rocked and driven by the above-described bobbin casing rocking mechanism 220.

The thread exit 207*a* is provided at the bobbin case 207 so that it rocks to the direction in parallel with the opening part direction of the thread capturing open eye 13*a* astride the needle dropping position of the open eye needle 13.

A thread draw out actuator drive mechanism 400 which drives the thread draw out actuator 401 is connected to the intermediate shaft 8.

As shown in FIG. 1 and FIG. 2, the thread draw out actuator drive mechanism 400 has following function. In thread draw out actuator 401, after the thread 20 which is captured by the thread capturing open eye 13*a* is scooped by the loop-taker point 205*a* of the outer rotary hook 202, the thread 20 which is scooped by the loop-taker point 202*a* is guided in to the rotary hook 200, and the thread 20 which is drawn out from the thread exit 207*a* of the bobbin case 207 is hooked just before guiding out from the rotary hook 200, and the thread which guides out from the rotary hook 200 is tightened, after that, the thread 20 is captured by the thread capturing open eye 13*a*, since then, the hooked thread 20 is released.

Figure 17:
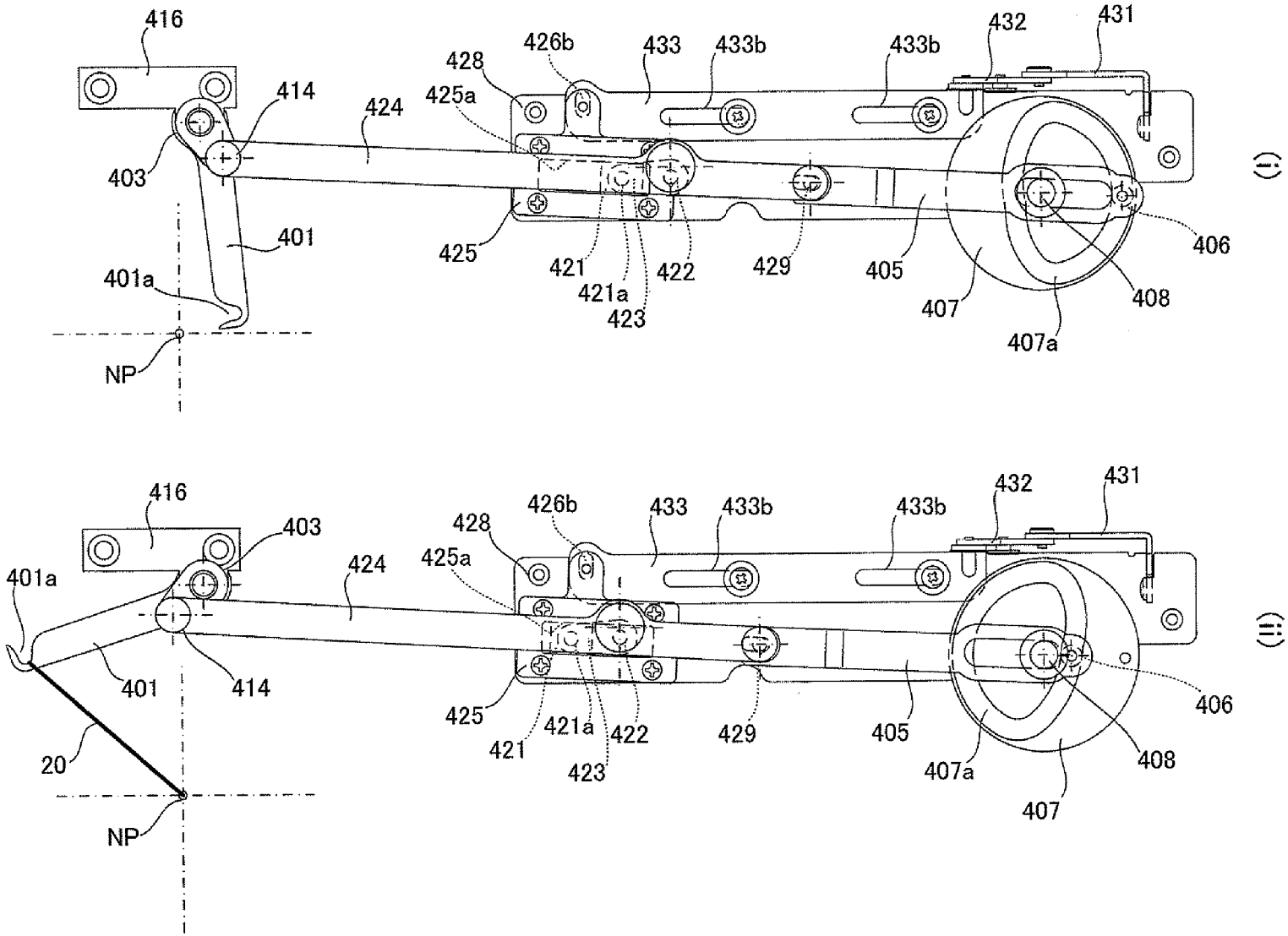
FIG. 17 (A) A plan view showing the movement state when viewing the thread tightness adjusting mechanism of FIG. 16 (A) and FIG. 16 (B) from the lower side of the sewing machine.
Figure 17:
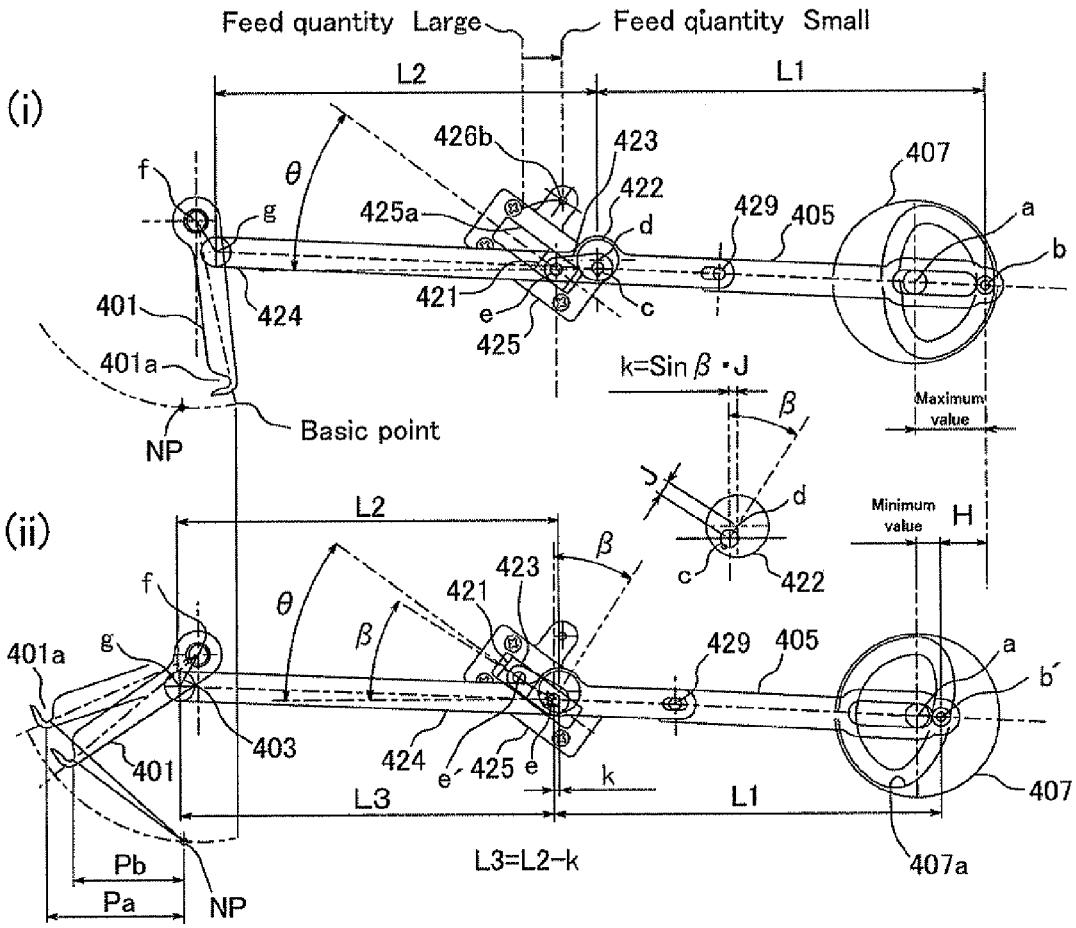

As shown in FIG. 15 and FIG. 17, such the thread draw out actuator drive mechanism 400 is provided with the spiral gear 410 which converts the rotational motion in the horizontal direction of the intermediate shaft 8 into the rotational motion in the vertical direction, the thread draw out actuator drive cam shaft 408 which transmits the rotational motion which is converted from the horizontal direction into the vertical direction by the spiral gear 410, and the thread draw out actuator drive cam 407 which gives the rotational motion of the thread draw out actuator drive cam shaft 408 to the above-mentioned function of the thread draw out actuator 401.

Concretely, a first gear 410*a* of the spiral gear 410 is fixed to the intermediate shaft 8, and a second gear 410*b* is fixed to one end (upper end) of the thread draw out actuator drive cam shaft 408. The thread draw out actuator drive cam 407 that a cam groove 407*a* is formed and is a face cam is fixed to another end (lower end) of the thread draw out actuator drive cam shaft 408. The thread draw out actuator drive cam shaft 408 is rotatably installed by a thread draw out actuator drive cam shaft upper bushing 411 and a thread draw out actuator drive cam shaft lower bushing 412 which are provided to a thread draw out actuator drive cam shaft tube 409 which is fixed to a bed portion 1*a*. Besides, the thread draw out actuator drive mechanism 400 has a thread draw out actuator drive rod base 405 that it is arranged horizontally and a cam follower 406 which engages to the cam groove 407*a* of the thread draw out actuator drive cam 407 is rotatably provided by a cam follower pin 413. In the thread draw out actuator drive rod base 405, a hollow elongate hole 405*a* is formed and the thread draw out actuator drive cam shaft 408 is inserted into this elongate hole 405*a*. And the thread draw out actuator drive rod base 405 is movably provided to the thread draw out actuator drive cam shaft 408 at the lower direction of the thread draw out actuator drive cam 407 horizontally by a thrust collar 415. A hole 405*d* which fastens a guide pin 429 is provided at the intermediate portion of the thread draw out actuator drive rod base 405, and a hole 405*c* which pivotally supports a thread draw out actuator eccentric shaft 422 of an after-mentioned thread tightness adjusting mechanism 420 is provided at the another end.

A thread draw out actuator adjusting rod 424 is guided by the guide pin 429 and connected through the thread draw out actuator eccentric shaft 422 at the thread draw out actuator drive rod base 405. The thread draw out actuator adjusting rod 424 is connected to an arm end 403*a* of a thread draw out actuator drive arm 403. The another end of the thread draw out actuator adjusting rod 424 and the arm end 403*a* of the thread draw out actuator drive arm 403 are rotatably connected by a linking pin 414. The thread draw out actuator drive arm 403 is attached to a mounting base 416 in the lower end of a thread draw out actuator rocking shaft 402 and a boss 401*b* of the thread draw out actuator 401 is attached to the mounting base 416 in the upper end of the thread draw out actuator rocking shaft 402 respectively, and they are fixed to the thread draw out actuator rocking shaft 402 respectively. The thread draw out actuator drive arm 403 and the thread draw out actuator 401 are rotatably attached on the mounting base 416 together with the thread draw out actuator rocking shaft 402.

In the thread draw out actuator drive mechanism 400 which is composed like this, when the intermediate shaft 8 rotates, the thread draw out actuator drive cam shaft 408 rotates by the spiral gear 410, and the cam follower 406 is driven corresponding to the shape of the cam groove 407*a* of the thread draw out actuator drive cam 407. And, the reciprocating motion of the thread draw out actuator drive rod base 405 is performed, and the arm end 403*a* of the thread draw out actuator drive arm 403 is rocked through the thread draw out actuator eccentric shaft 422 by the thread draw out actuator adjusting rod 424, therefore the thread draw out actuator 401 is rocked.

The thread draw out actuator drive mechanism 400 has following function. By the rocking motion of thread draw out actuator 401, the thread 20 which is captured by the thread capturing open eye 13*a* is scooped by the loop-taker point 205*a* of the outer rotary hook 202 and secedes from the thread capturing open eye 13*a*, since then, the thread 20 which is scooped by the loop-taker point 202*a* is guided in to the rotary hook 200, and the thread 20 which is drawn out from the thread exit 207*a* of the bobbin case 207 is hooked by a thread grapple portion 401*a* just before guiding out from the rotary hook 200, and the thread which guides out from the rotary hook 200 is tightened. The handstitch which is sewed by the rocking motion of the thread draw out actuator 401 is completed with the beautiful stitch.

Figure 16:
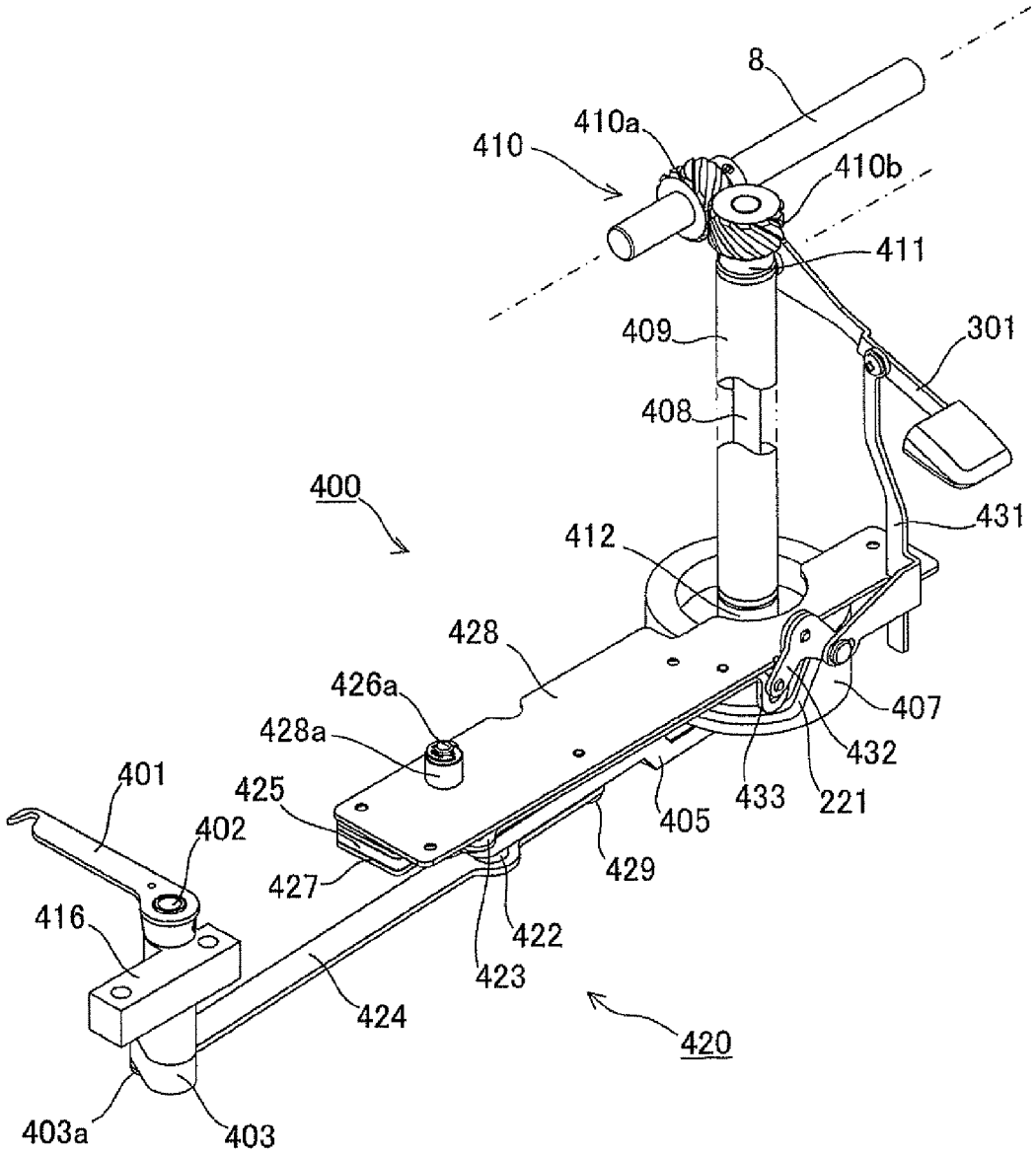
FIG. 16 (A) A perspective view showing the thread draw out actuator drive mechanism and the thread tightness adjusting mechanism in the single-thread locked handstitch sewing machine of this invention.
Figure 16:
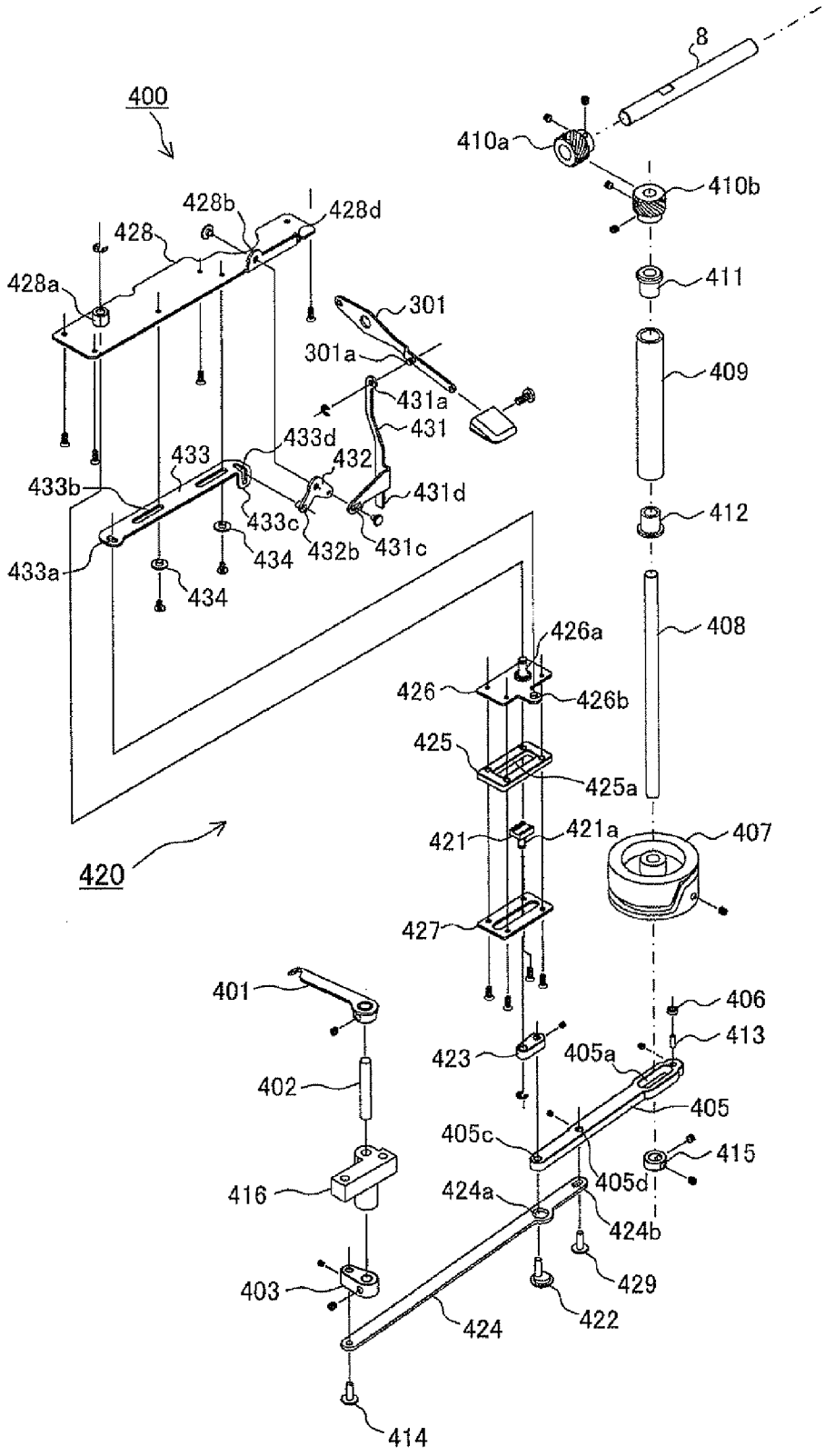

In the above-mentioned single-thread locked handstitch sewing machine, the thread draw out actuator 401 performs the reciprocating motion, and gives the looseness to the thread 20 and tightens the stitches. And even if the stitch length is changed by the feed quantity setting mechanism 300, a thread tightness quantity by the thread draw out actuator 401 becomes always constant. Then, as shown in FIG. 16 (A), FIG. 16 (B), FIG. 17 (A) and FIG. 17 (B), the thread tightness adjusting mechanism 420 which adjusts the thread tightness quantity of the thread draw out actuator 401 corresponding to the feed quantity which is set by the feed quantity setting mechanism 300, that is, corresponding to the stitch length and the inter-stitch pitch, is provided.

The structure of the thread tightness adjusting mechanism 420 is explained. The above-described thread draw out actuator eccentric shaft 422 is fixed to an eccentric adjusting arm 423 through a hole 424*a* which is provided at the intermediate portion of the thread draw out actuator adjusting rod 424 and the hole 405*c* of the thread draw out actuator drive rod base 405.

The guide pin 429 is fixed to the hole 405*d* of the thread draw out actuator drive rod base 405 through a elongate hole 424*b* which is provided at the another end of the thread draw out actuator adjusting rod 424, and guides slidably the thread draw out actuator adjusting rod 424 along the elongate hole 424*b*.

A central shaft 421*a* of a square piece 421 is pivotally supported at a hole 423*b* which is provided at one end of the eccentric adjusting arm 423. The square piece 421 is slidably inserted to a guide groove 425*a* of a thread draw out actuator adjusting grooved block 425, and the thread draw out actuator adjusting grooved block 425 is fixed to an adjusting grooved block swivel base 426 together with a square grooved block lid 427.

The adjusting grooved block swivel base 426 has a swivel shaft 426*a*, and is pivotally attached for a mounting boss 428*a* of a thread draw out actuator adjusting board plate 428 which is provided in the inside of the bed 1*a* so that it can swivel.

The adjusting grooved block swivel base 426 has a pin 426*b* at a protruded end, and is connected to an elongate hole 433*a* of one end of a slide link 433. The slide link 433 is slidably attached to the thread draw out actuator adjusting board plate 428 by a pair of elongate holes 433*b*, 433*b* and a pair of slide pieces 434.

A joining arm 433*c* which is provided at another end of the slide link 433 and folded at a right angle to the lower direction has an elongate hole 433*d*. A pin 432*b* which is implanted at one arm 432*a* of a thread draw out actuator adjusting bell crank 432 which is pivotally attached to an attachment arm 428*b* which is provided at another end of the thread draw out actuator adjusting board plate 428 and folded at a right angle to the upper direction is slidably fitted to the elongate hole 433*d*.

In another arm 432*c* of the thread draw out actuator adjusting bell crank 432, a elongate hole 431*c* which is provided at a thread draw out actuator adjusting vertical rod 431 is slidably fixed by a stepped pin 432*d*. A portion which provides the elongate hole 431*c* of the thread draw out actuator adjusting vertical rod 431 is folded at a right angle to the left direction in the intermediate portion of the thread draw out actuator adjusting vertical rod 431, and the upper end is rotatably attached to a pin 301*a* which is implanted at the above-described stitch feed adjusting lever 301 by an attachment hole 431*a*. A lower end portion 431*d* of the thread draw out actuator adjusting vertical rod 431 is slidably and loosely fitted to a guide groove 428*d* which is provided at the thread draw out actuator adjusting board plate 428.

In this way, the thread draw out actuator drive rod base 405 and the thread draw out actuator adjusting grooved block 425 are connected by the thread draw out actuator eccentric shaft 422 on the reference line that the thread draw out actuator drive cam shaft 408 and the thread draw out actuator drive arm 403 are connected, and are fixed to the eccentric adjusting arm 423 so that the eccentric direction of the thread draw out actuator eccentric shaft 422 becomes the right angle for the reference line, and are composed by the position that the respective shaft centers of the rotatory swivel shaft 426*a* of the thread draw out actuator adjusting grooved block 425 that the square piece shaft 421*a* which is fitted into one end of the eccentric adjusting arm 423 and the square piece 421 slide correspond to the reference line.

In addition, in the above-described embodiment, as for the thread tightness adjusting mechanism 420, although the feed quantity which is set by the feed quantity setting mechanism 300, that is, the mode which adjusts the thread tightness quantity of the thread draw out actuator 401 corresponding to the stitch length is explained, the feed quantity which is set by the feed quantity setting mechanism 300, that is, the thread tightness quantity of the thread draw out actuator 401 may be adjusted corresponding to the stitch length and/or the inter-stitch pitch.

Figure 18:
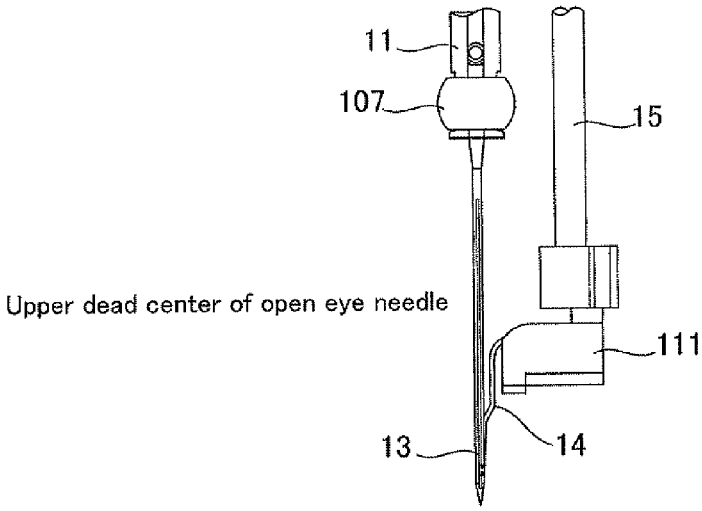
FIG. 18 (A) A movement explanatory view showing the method for forming single-thread locked handstitches about the movement of the single-thread locked handstitch sewing machine by this invention.
Figure 18:
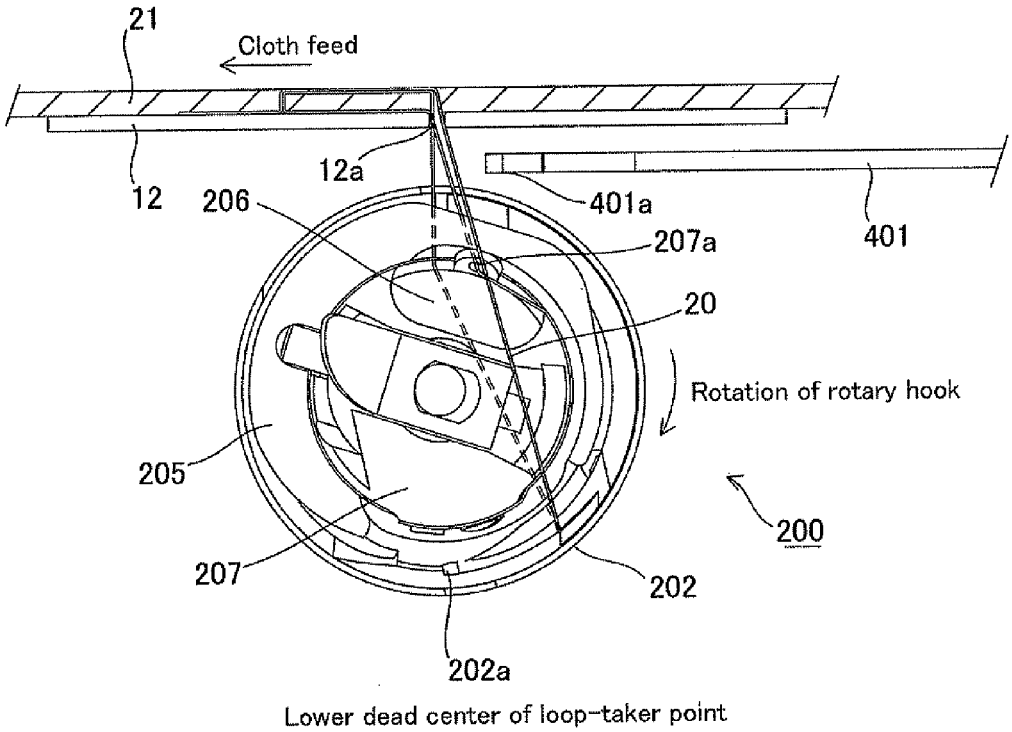
Figure 18:
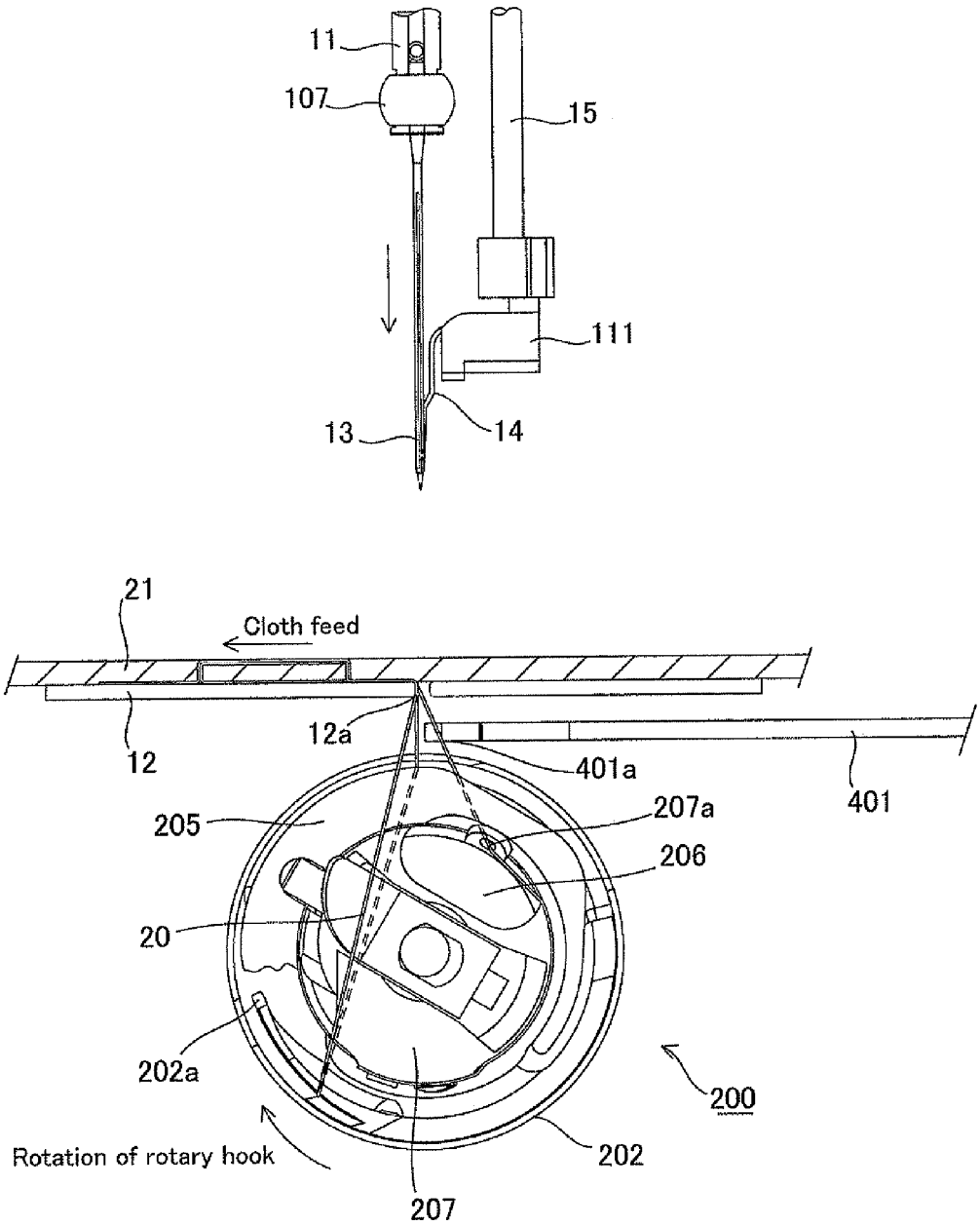
Figure 18:
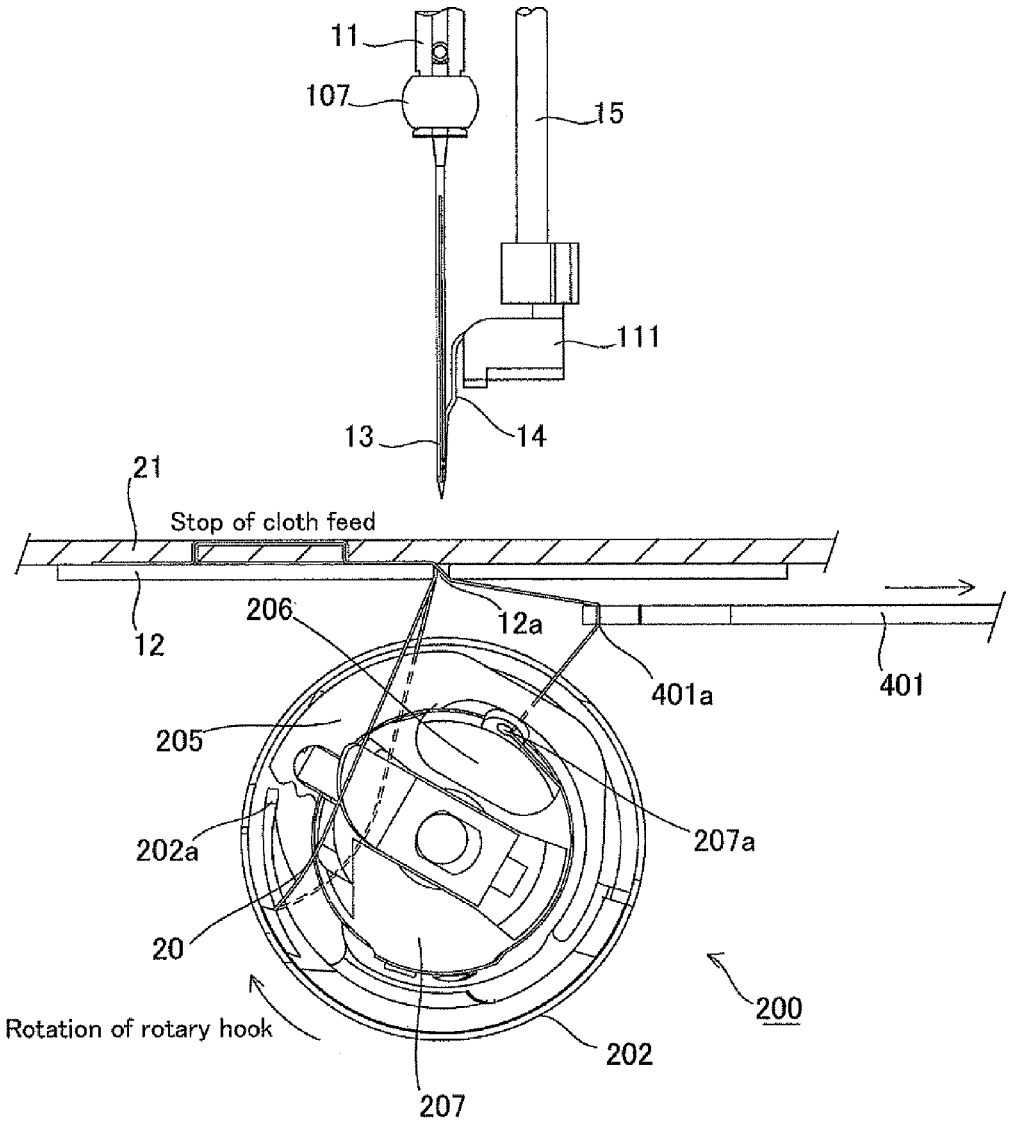
Figure 18:
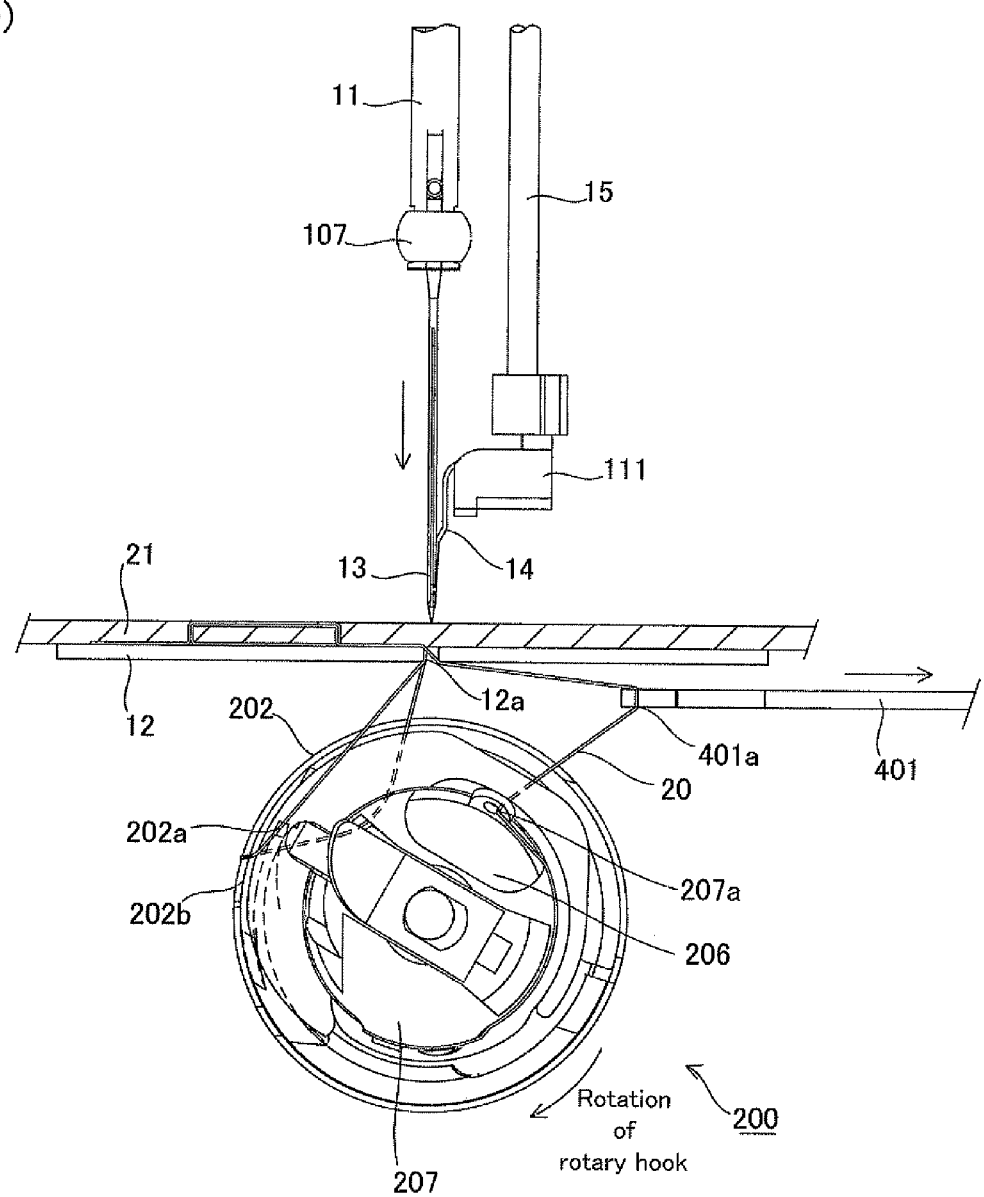
Figure 18:
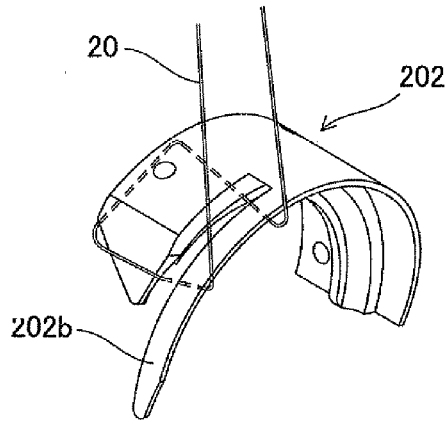
Figure 18:
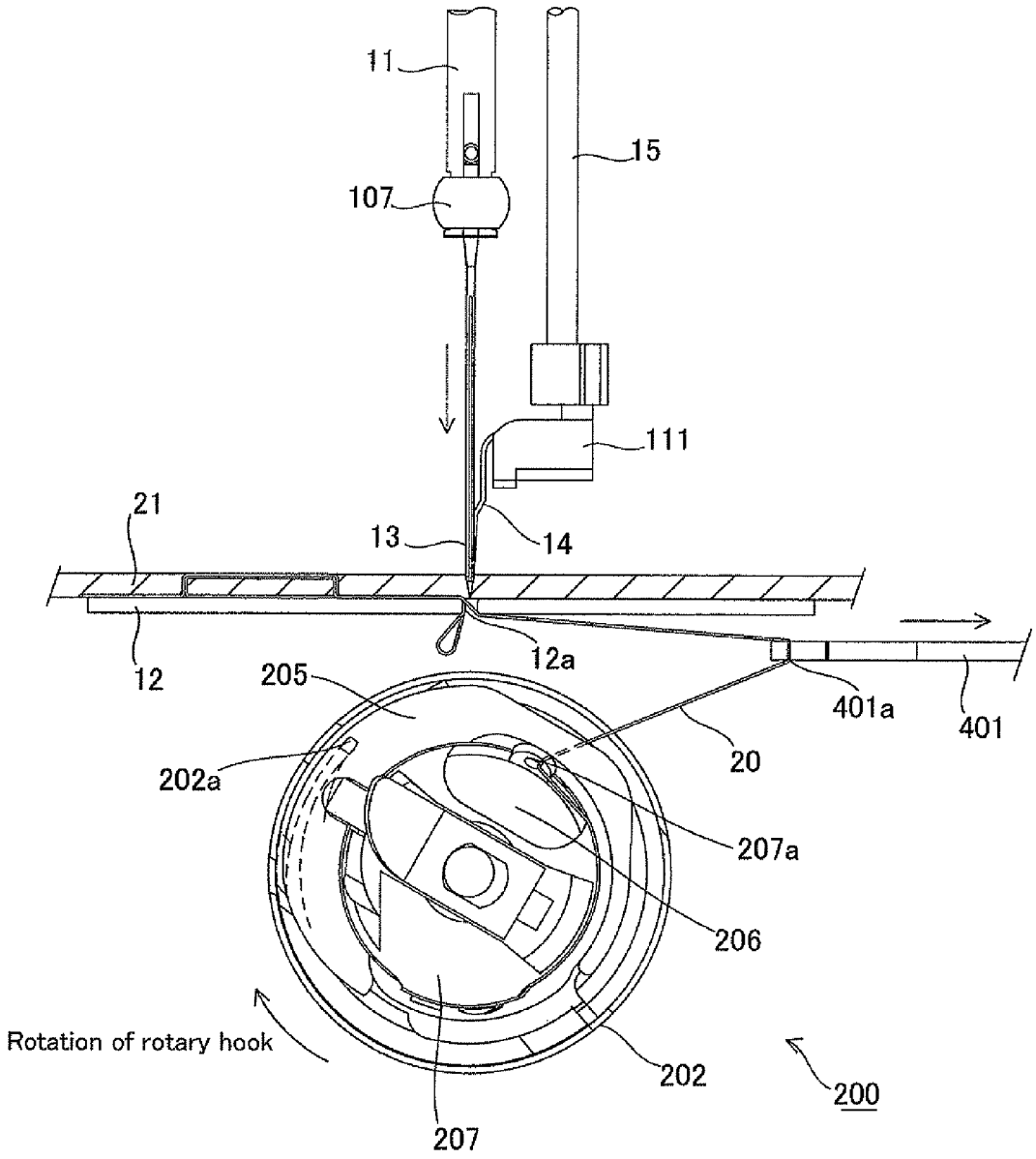
Figure 18:
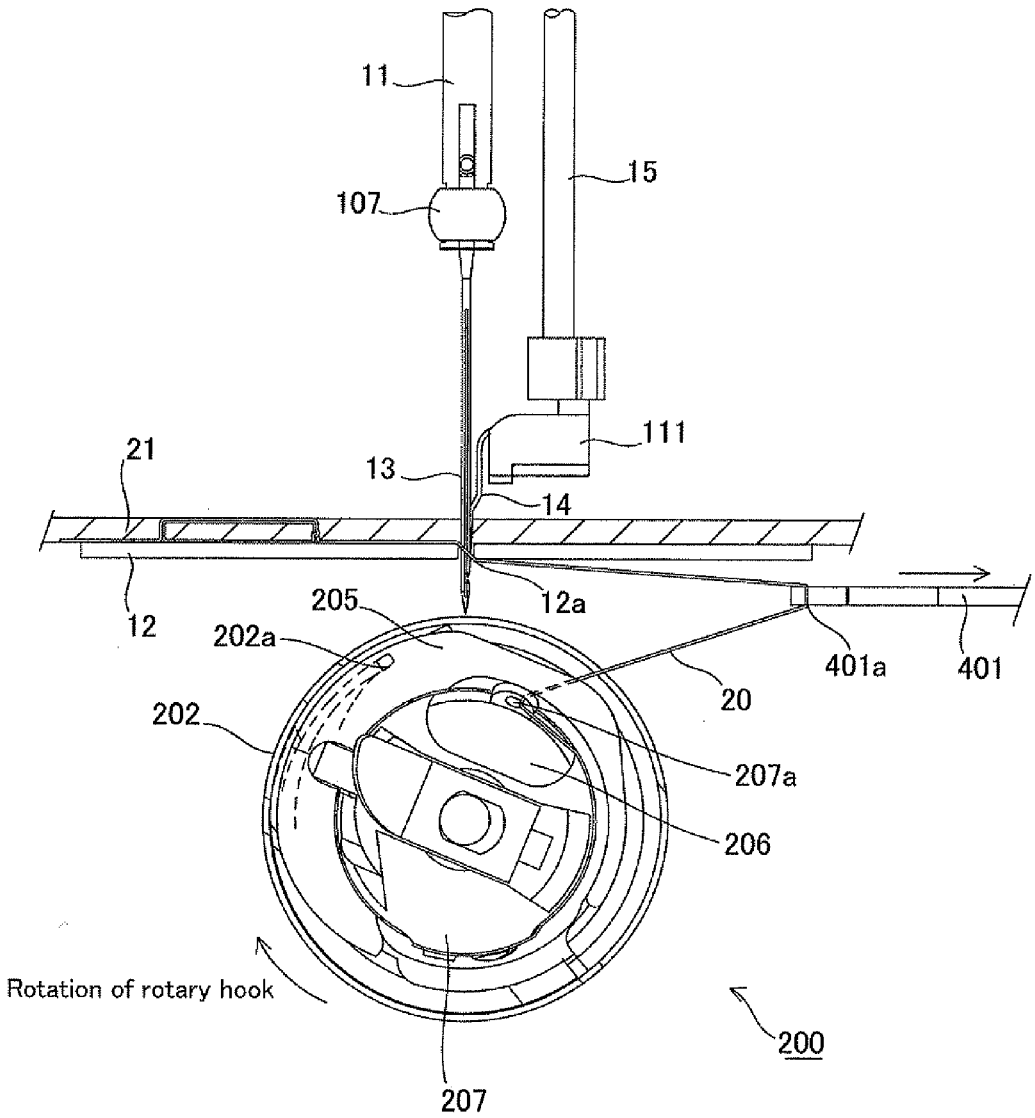
Figure 18:
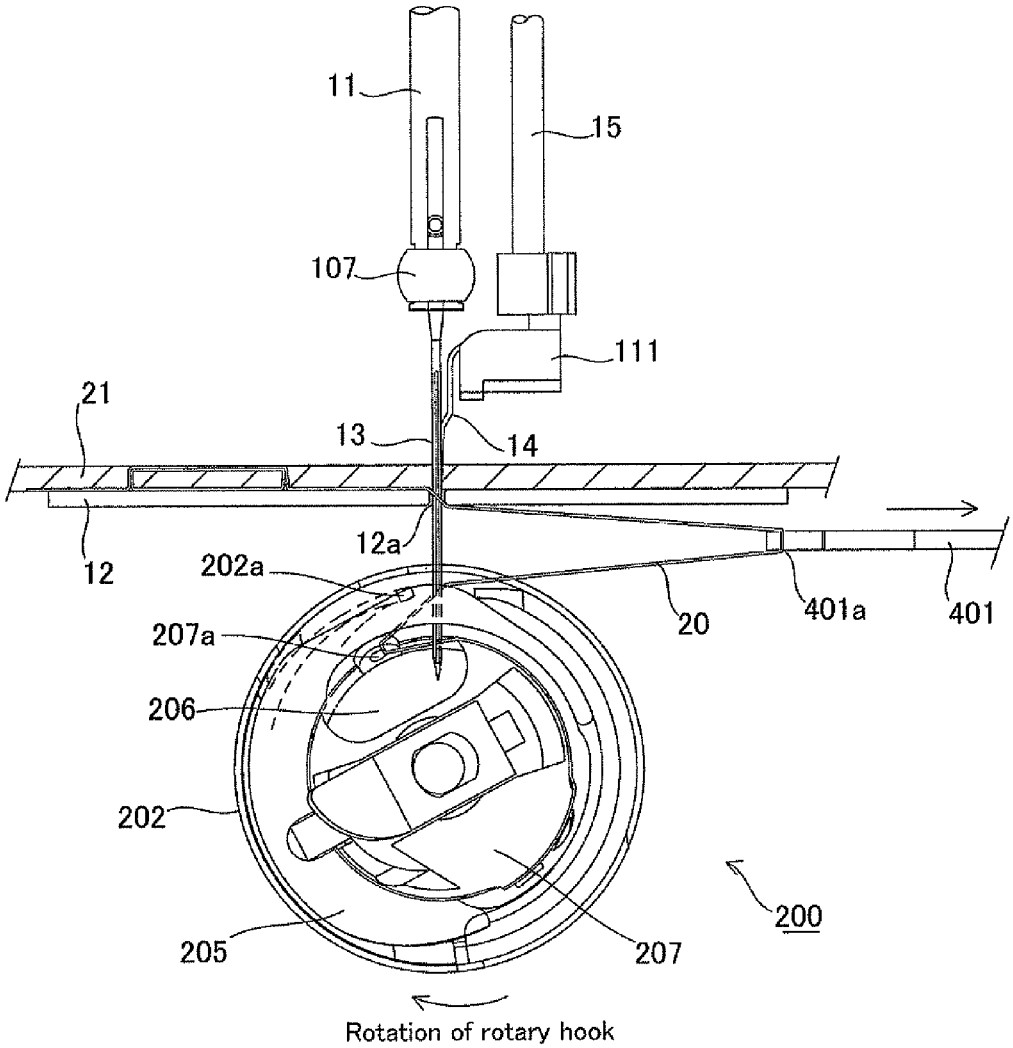
Figure 18:
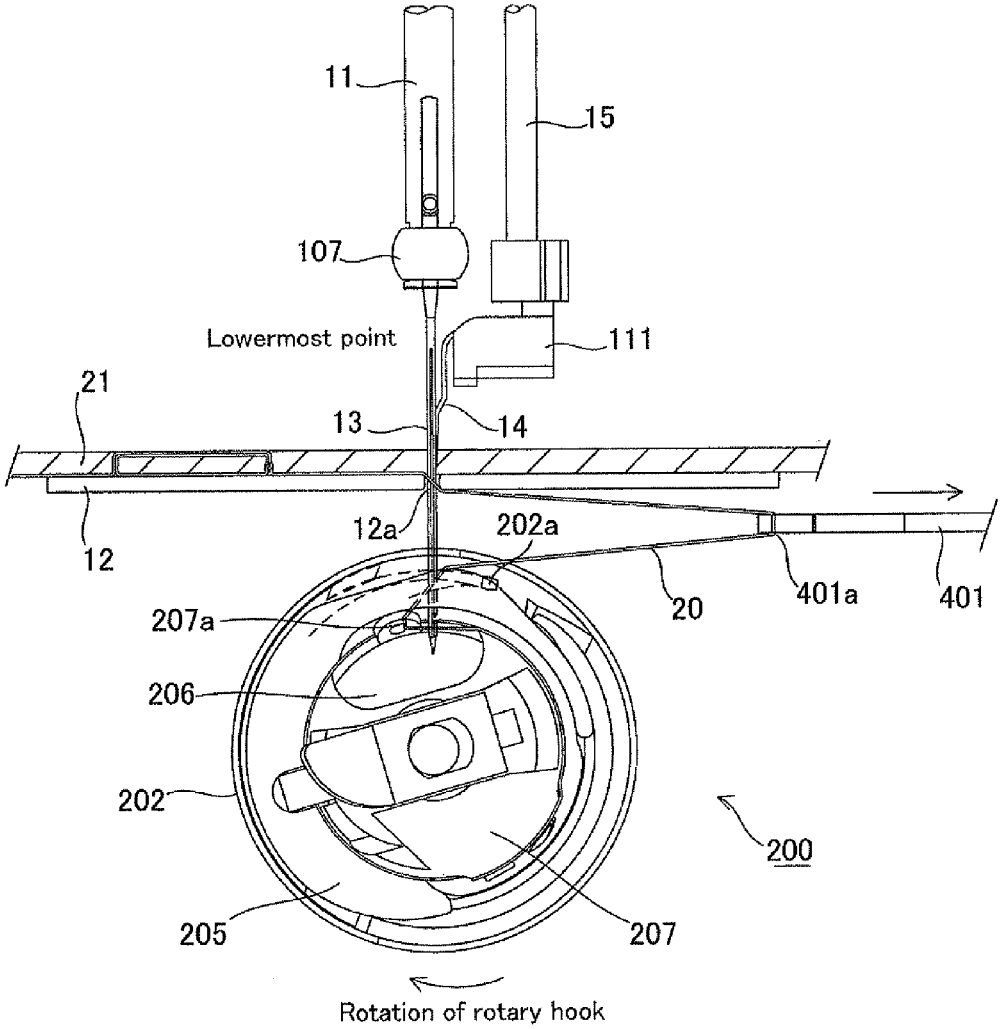
Figure 18:
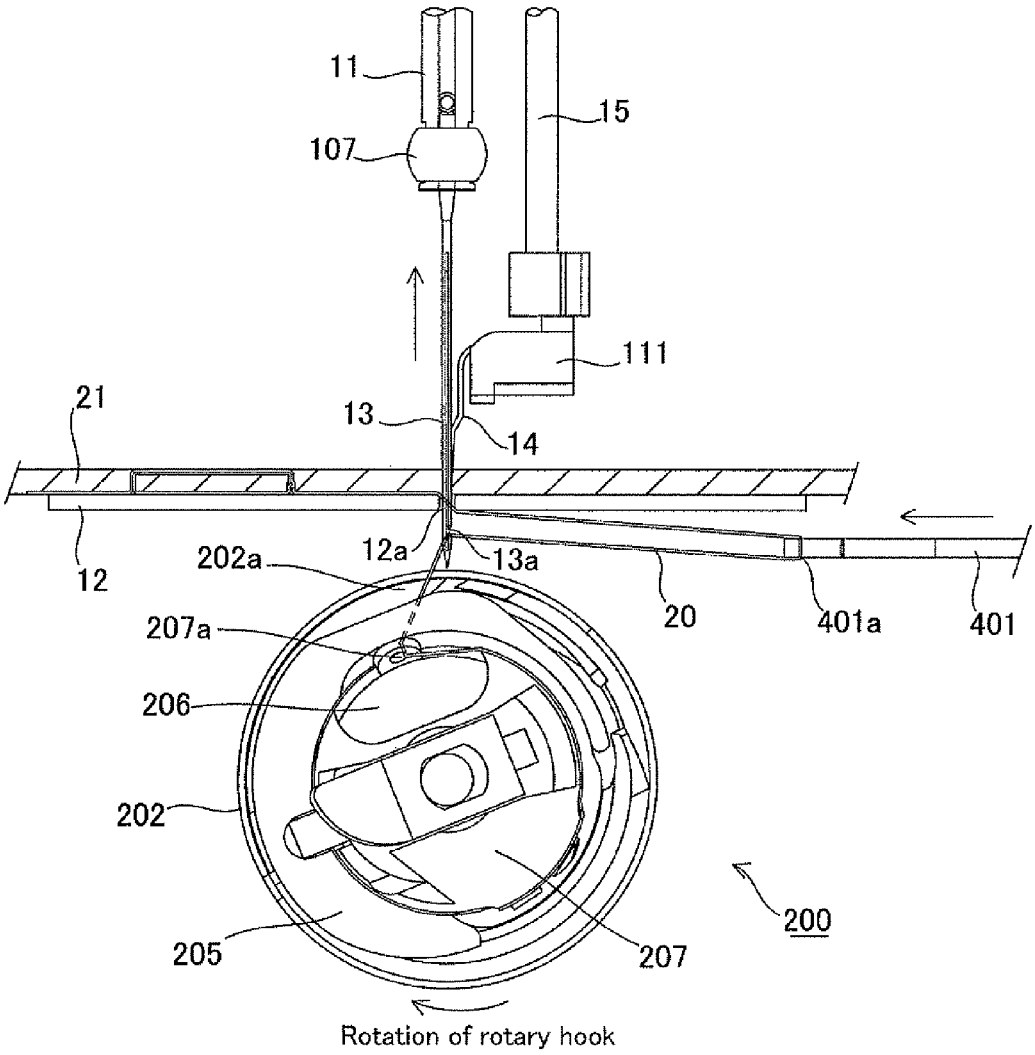
Figure 18:
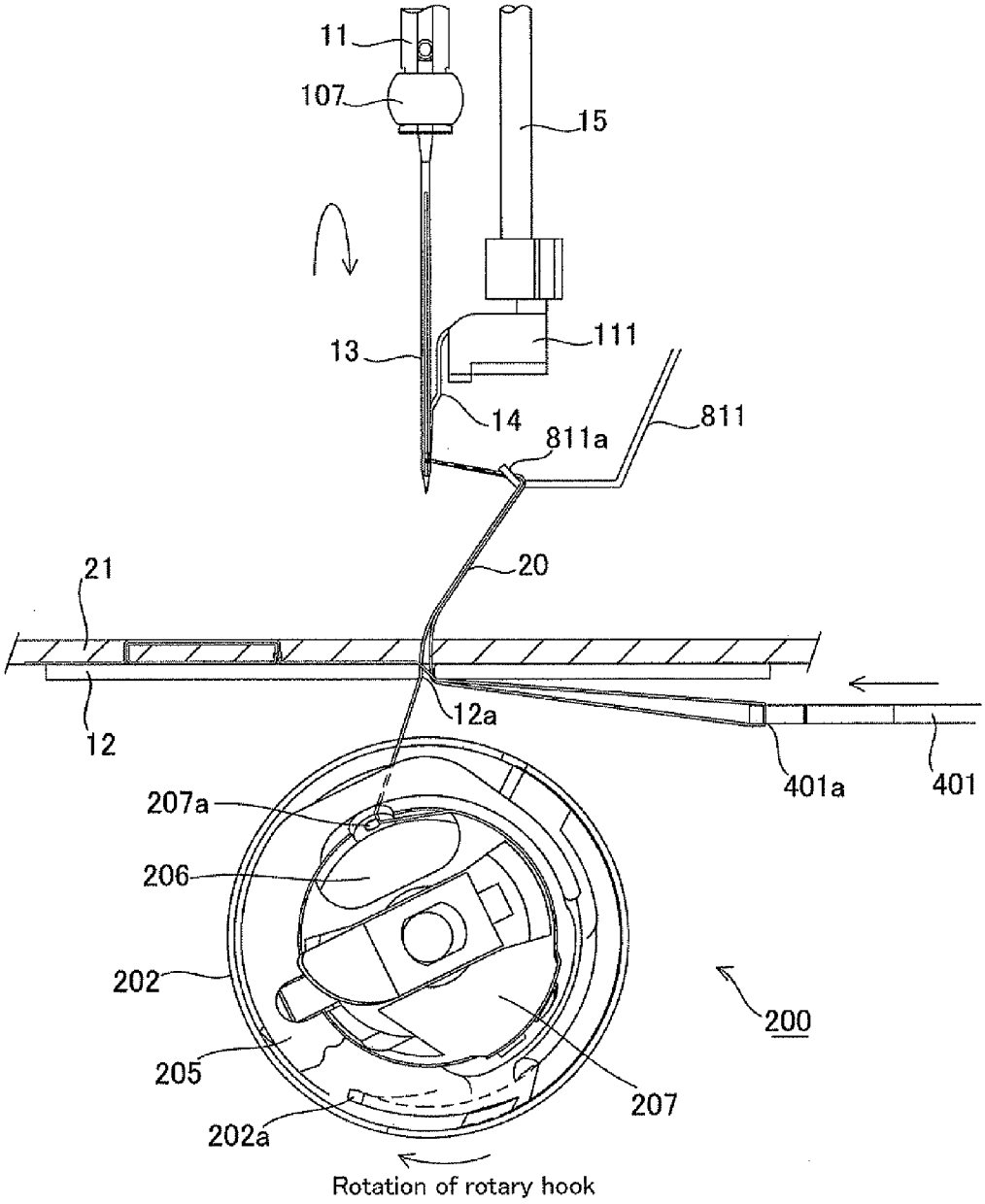
Figure 18:
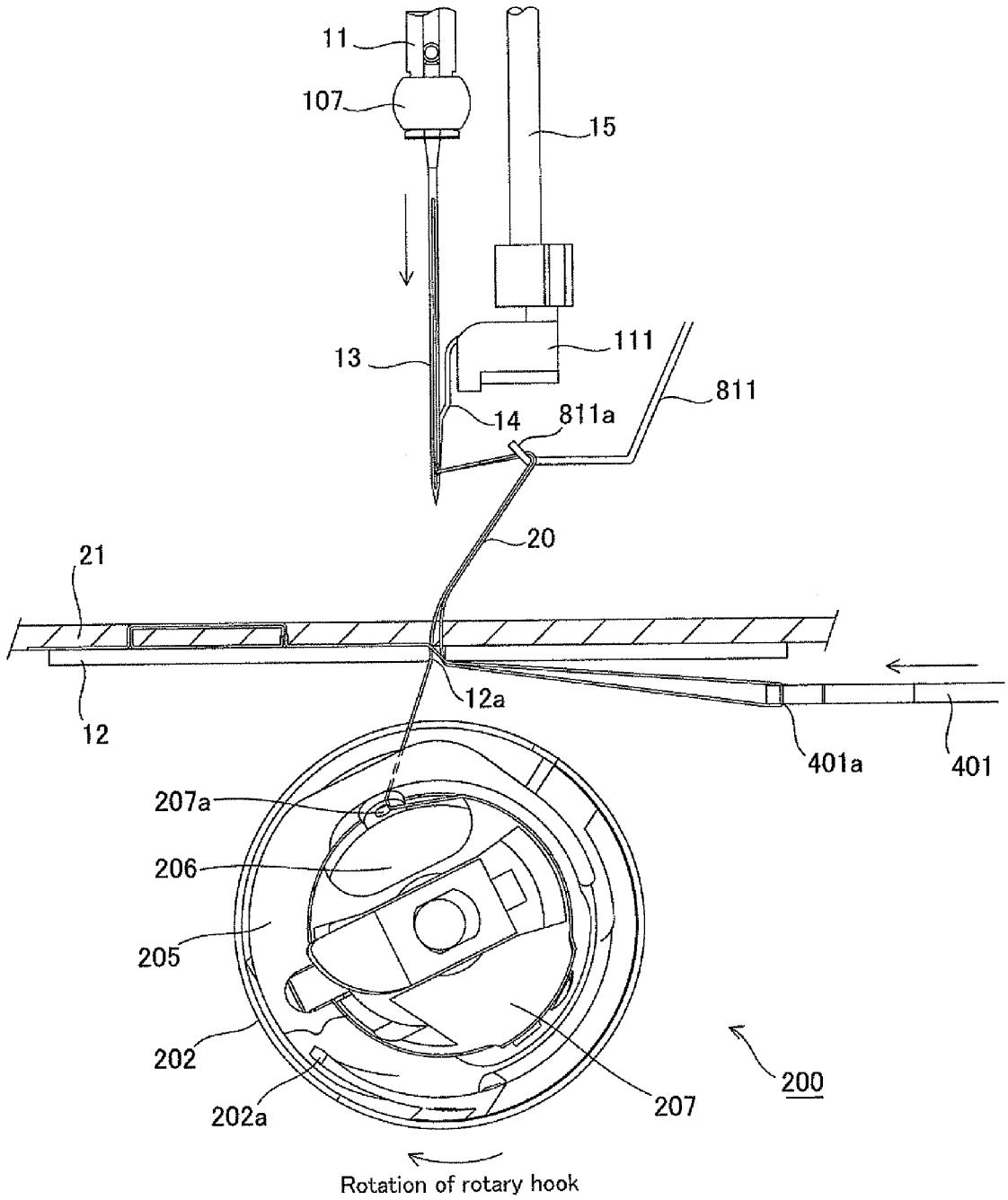
Figure 18:
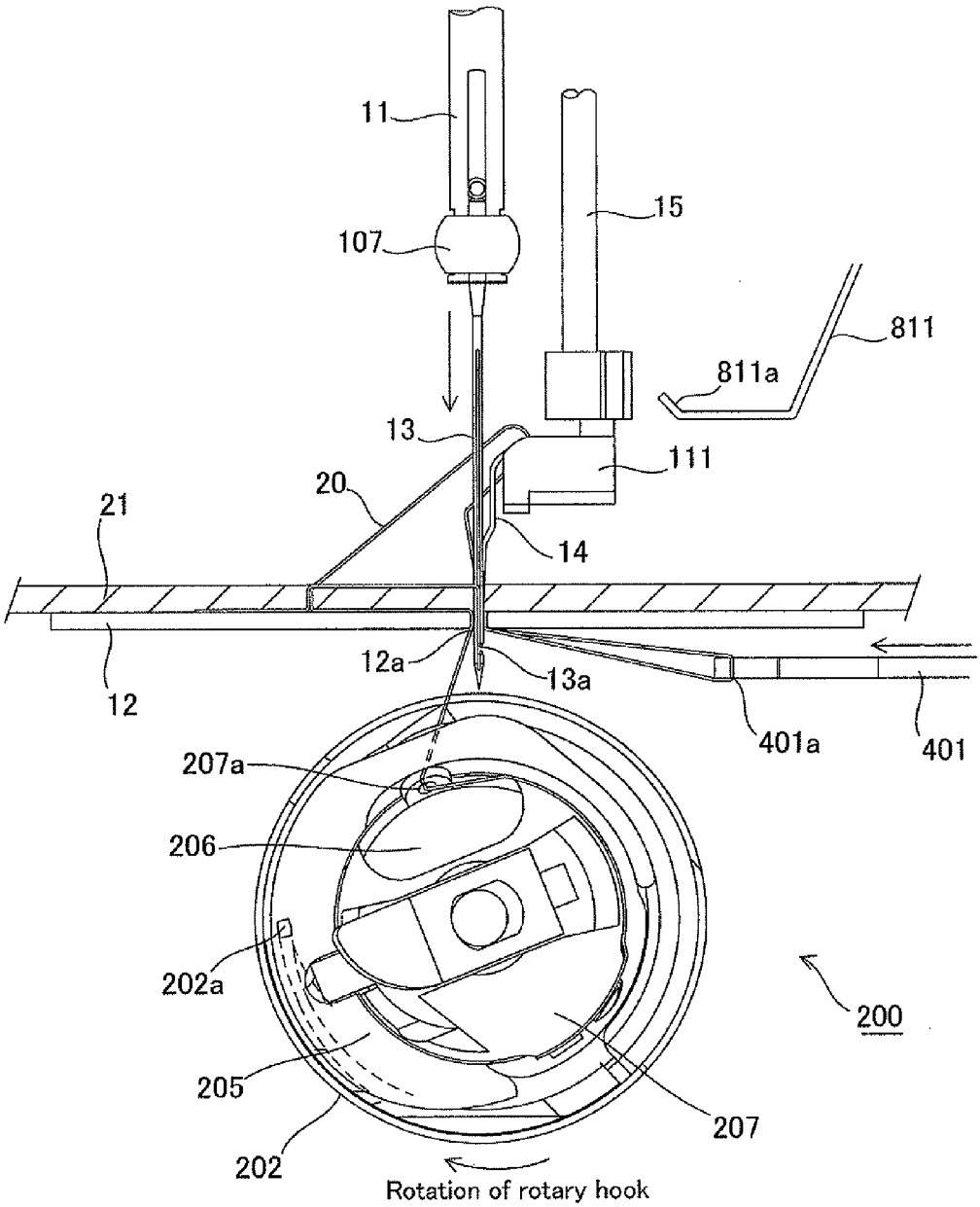
Figure 18:
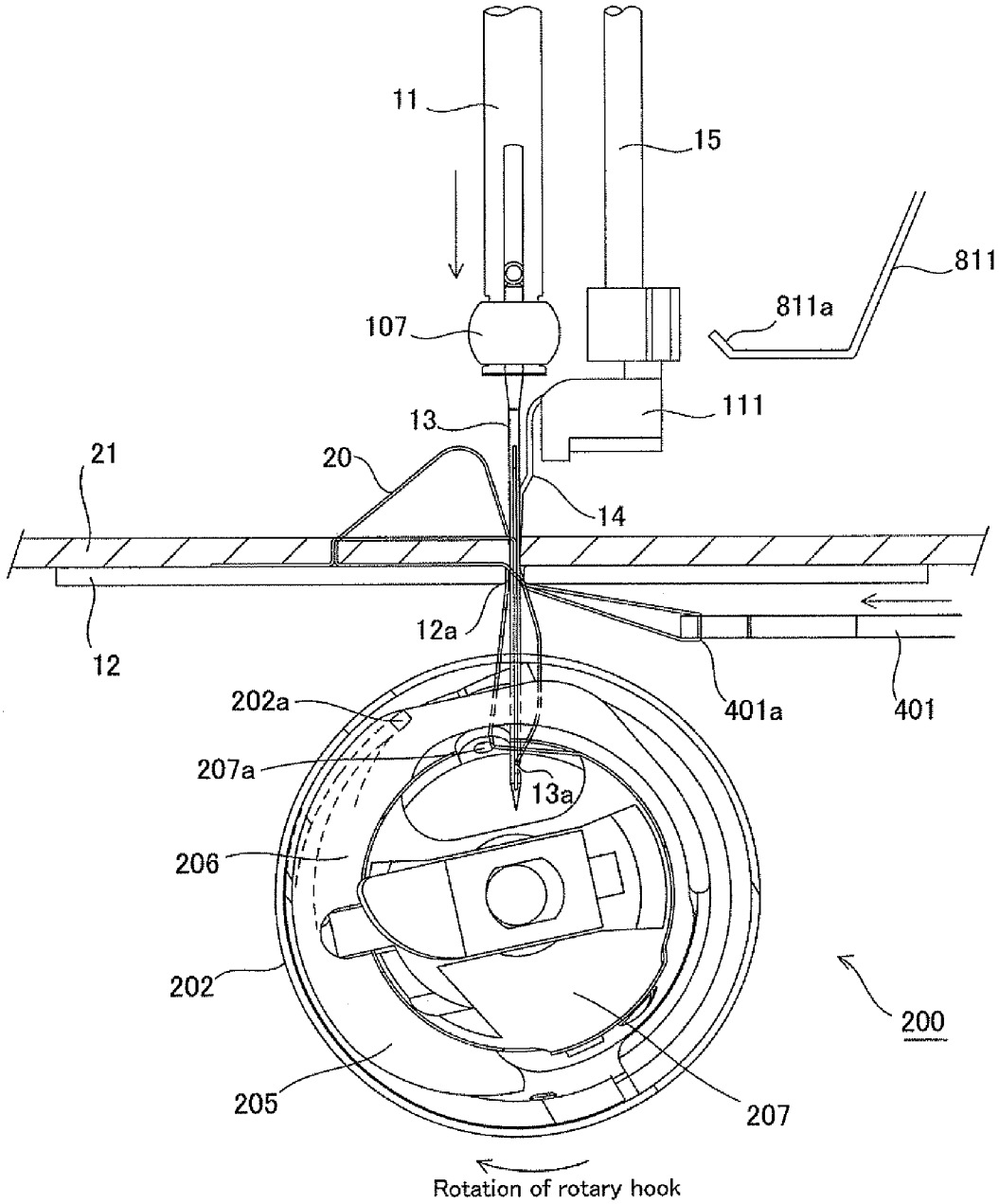
Figure 18:
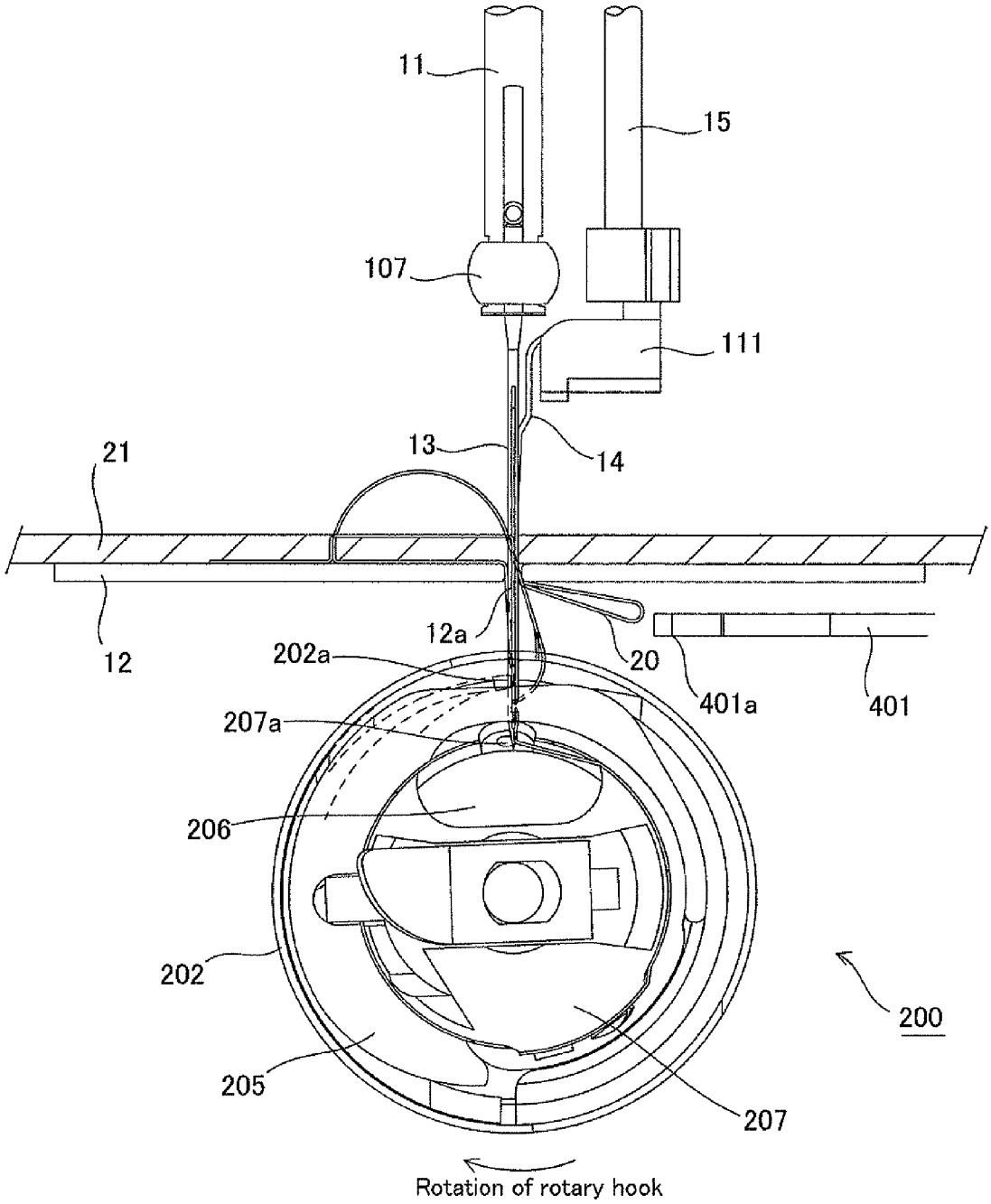
Figure 18:
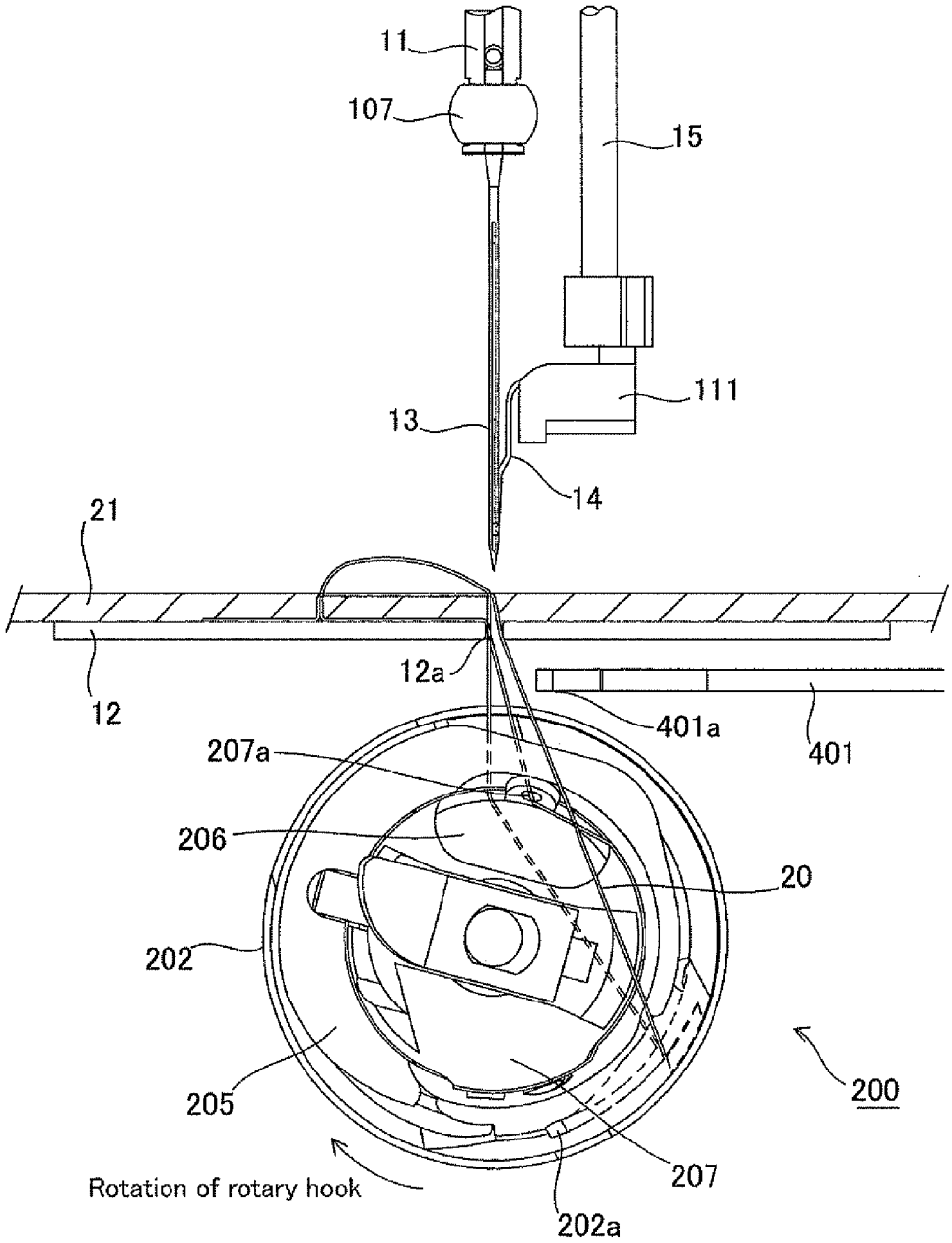

Besides, in the above-mentioned single-thread locked handstitch sewing machine, as shown in FIG. 18 (J)-(L), when the open eye needle 13 comes down in the second stroke, the thread 20 which is captured by the thread capturing open eye 13*a* of the open eye needle 13 between the needle-point of the open eye needle 13 and the fabric workpiece 21 becomes the slack state from the tight state, and the thread slack occurs. Thereby, there is a possibility that the thread 20 of the slack state might be pierced by the needlepoint of the open eye needle 13 which descends. Therefore, as shown in FIG. 25 (A), (B), when the open eye needle 13 comes down from the upper dead center in the second stroke, a thread shifting mechanism 800 which shift the thread captured by the thread capturing open eye 13*a* between the needlepoint of the open eye needle 13 and the fabric workpiece is provided.

Figure 25:
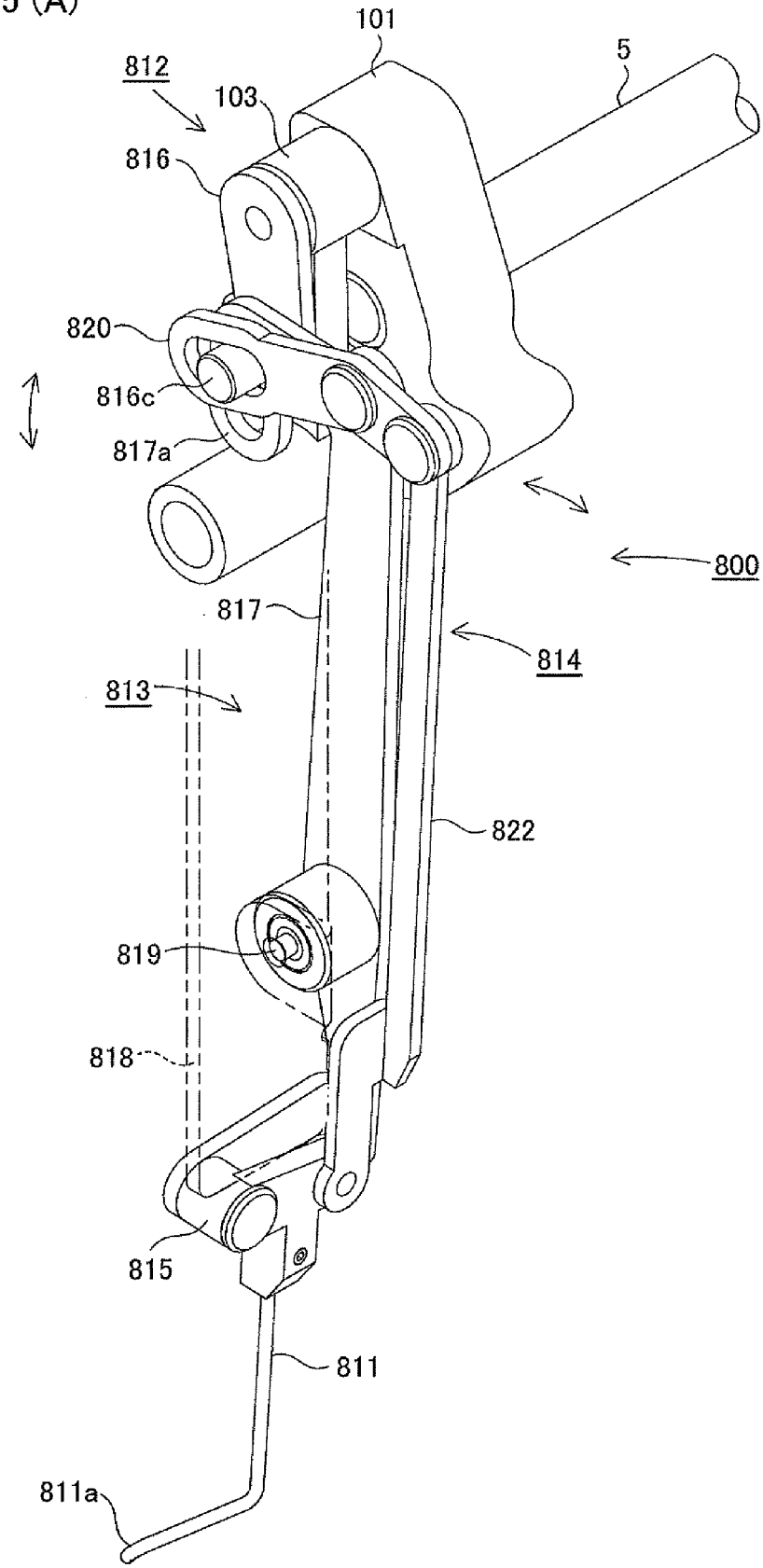
FIG. 25 (A) A perspective view showing the thread shifting mechanism in the single-thread locked handstitch sewing machine of this invention.
Figure 25:
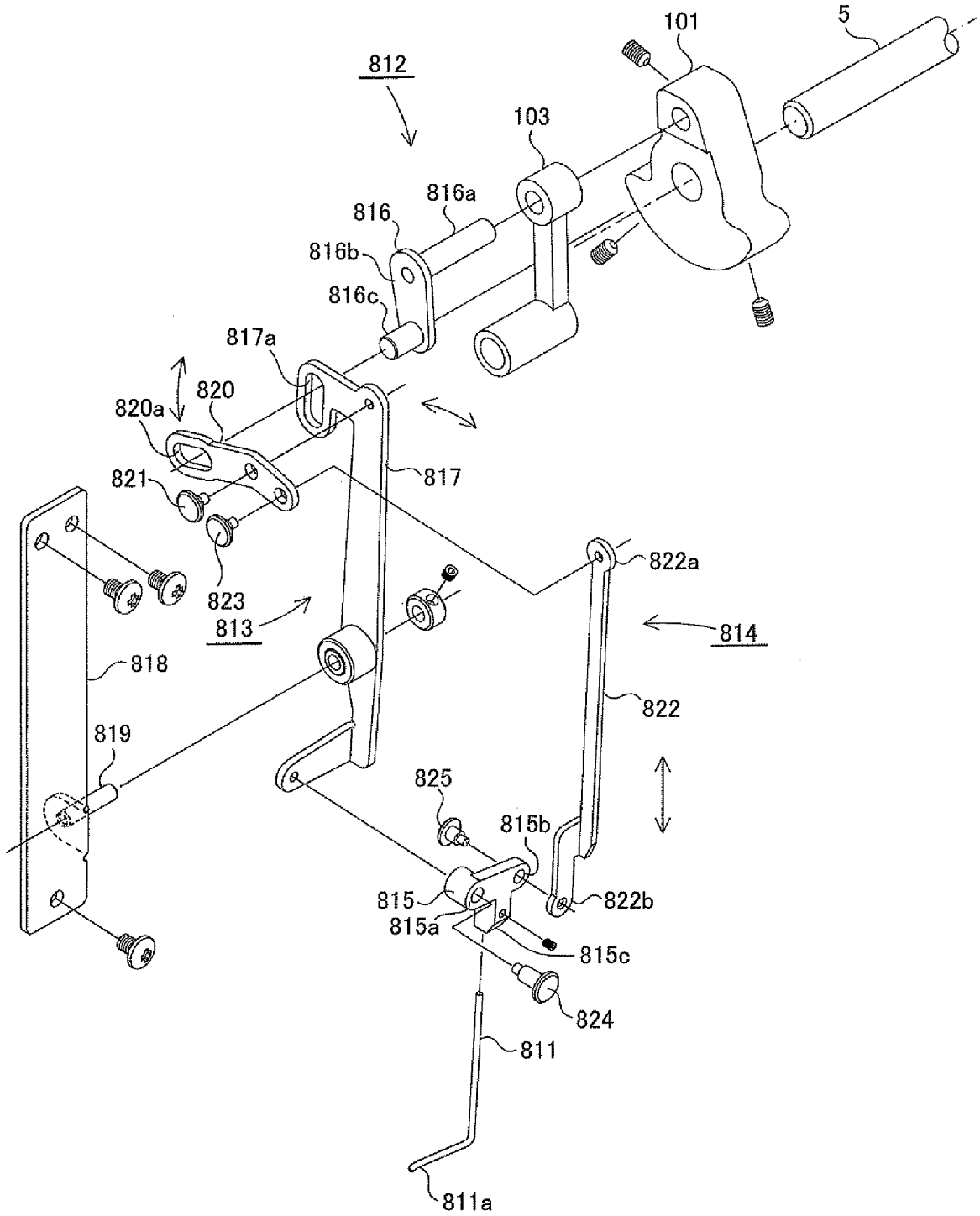

As shown in FIG. 25 (A) and (B), the thread shifting mechanism 800 is provided with a thread shifter 811 which is formed in the L-shape to hook the thread slack which occurs between the needlepoint of the open eye needle 13 and the fabric workpiece 21, an eccentric mechanism 812 which converts the rotational motion of the upper shaft 5 to the eccentric motion, a first link mechanism 813 which is connected to the eccentric mechanism 812 and converts the eccentric motion of the aforementioned eccentric mechanism to the horizontal motion, a second link mechanism 814 which is connected to the eccentric mechanism 812 and converts the eccentric motion of the aforementioned eccentric mechanism to the up-and-down motion and a thread shifting attachment arm 815 which is connected to the first link mechanism 813 and the second link mechanism 814 and converts the motion trace to the elliptical motion in the horizontal direction by combining the horizontal motion of the first link mechanism 813 and the up-and-down motion of the second link mechanism 814 and transmits the elliptical motion to the thread shifter 811.

The eccentric mechanism 812 utilizes a thread shifting drive eccentric shaft 816 instead of a crank rod pin 102 which connects the needle bar crank rod 103 of the open eye needle-latch wire drive mechanism 100 which is shown in above-mentioned FIG. 3 (A), (B) and FIG. 4 to the needle bar crank 101. The thread shifting drive eccentric shaft 816 is composed by a crank rod pin 816*a* which connects the needle bar crank rod 103 to the needle bar crank 101 and an arm portion 816*b* that the crank rod pin 816*a* is fixed to one end and an eccentric shaft 816*c* is fixed to another end.

The first link mechanism 813 is provided with a thread shifting horizontal rocking arm 817 that an elongate hole 817*a* which engages to the eccentric shaft 816*c* of the thread shifting drive eccentric shaft 816 is formed in one end. The elongate hole 817*a* is formed in the thread shifting horizontal rocking arm 817 so that the longer direction becomes up-and-down direction. The thread shifting horizontal rocking arm 817 is composed so that the elongate hole 817*a* which is one end becomes the point of force, and so that another end becomes the operating point, and so that the portion between one end and another end becomes the fulcrum. A thread shifting mechanism attachment board 818 which supports the fulcrum of the thread shifting horizontal rocking arm 817 is fixed to the arm 1*b*. The portion which becomes the fulcrum of the thread shifting horizontal rocking arm 817 is rotatably supported to a thread shifting spindle 819 which is provided to the predefined position of the thread shifting mechanism attachment board 818. Therefore, by making the thread shifting spindle 819 the fulcrum, another end of the thread shifting horizontal rocking arm 817 can perform the reciprocating rocking in the horizontal direction whose direction is same as the motion direction of the feed of the feed dog 601.

The second link mechanism 814 is provided with a thread shifting up-and-down drive arm 820 that an elongate hole 820*a* which engages to the eccentric shaft 816*c* of the thread shifting drive eccentric shaft 816 is formed in one end. The elongate hole 820*a* is formed in the thread shifting up-and-down drive arm 820 so that the longer direction becomes almost horizontal direction. The thread shifting up-and-down drive arm 820 is composed so that the elongate hole 820*a* which is one end becomes the point of force, and so that another end becomes the operating point, and so that the portion between one end and another end becomes the fulcrum. The fulcrum of the thread shifting up-and-down drive arm 820 is rotatably connected to one end of the thread shifting horizontal rocking arm 817 by a connecting member 821 such as the linking pin. And, an upper end 822*a* of a thread shifting up-and-down rocking arm 822 which is arranged in the up-and-down direction is rotatably connected to the operating point of the thread shifting up-and-down drive arm 820 by a connecting member 823 such as the linking pin. Therefore, because another end of the thread shifting up-and-down drive arm 820 can perform the reciprocating rocking in the up-and-down direction by making the connecting member 821 the fulcrum, the thread shifting up-and-down rocking arm 822 which is connected to another end of the thread shifting up-and-down drive arm 820 can perform the reciprocating motion in the up-and-down direction.

In the thread shifting attachment arm 815, the arrangement direction of the T-shaped horizontal arm is perpendicular to the motion direction of the feed of the feed dog 601 (FIG. 1). And, one horizontal arm end 815*a* is rotatably connected to another end of the thread shifting horizontal rocking arm 817 by a connecting member 824 such as the linking pin, and a lower end 822*b* of the thread shifting up-and-down rocking arm 822 is rotatably connected to another horizontal arm end 815*b* by a connecting member 825 such as the linking pin. And, the arrangement direction of the vertical arm of the thread shifting attachment arm 815 is the vertical direction, and the thread shifter 811 is fixed to a tip 815*c*.

Figure 26:
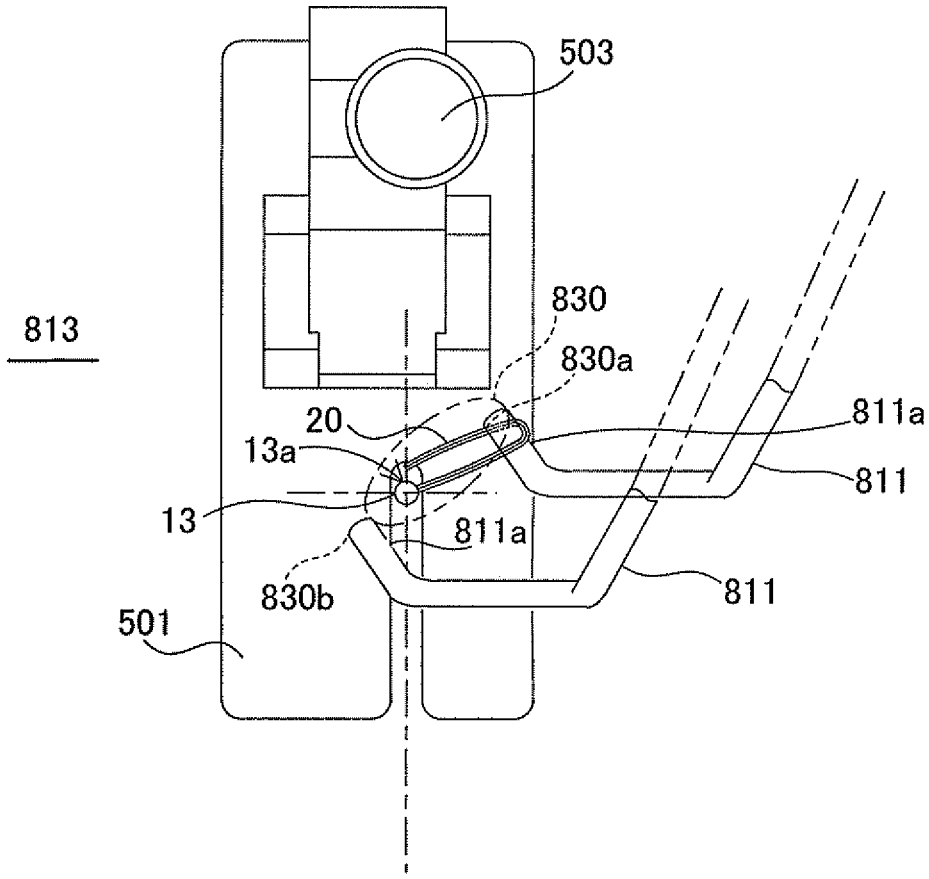
FIG. 26 An explanatory view showing the motion trace of the thread shifter of the thread shifting mechanism of FIG. 25 (A) and FIG. 25 (B).

In the thread shifting mechanism 800 composed in this way, as shown in FIG. 26, while the upper shaft 5 turns around once, a tip portion 811*a* of the thread shifter 811 turns around once at the upper direction of the presser foot 501 by the elliptical motion of the motion trace 830. Therefore, the tip portion 811*a* of the thread shifter 811 can perform the elliptical motion without interference to the open eye needle 13 which performs the linear motion in the up-and-down direction.

Concretely, when the needle bar crank 101 rotates by the upper shaft 5, compared with the distance between the rotation center by the upper shaft 5 of the needle bar crank 101 and the shaft center of the crank rod pin 816*a*, because the distance between the shaft center of a crank rod pin 816*a* of the thread shifting drive eccentric shaft 816 and the shaft center of the eccentric shaft 816*c* is slightly short by only preliminarily designed size, the eccentric shaft 816*c* of the thread shifting drive eccentric shaft 816 performs the small circular motion.

When the eccentric shaft 816*c* of the thread shifting drive eccentric shaft 816 performs the small circular motion, because another end of the thread shifting horizontal rocking arm 817 can perform the reciprocating rocking by the elongate hole 817*a* in the horizontal direction whose direction is same as the motion direction of the feed of the feed dog 601 by making the thread shifting spindle 819 the fulcrum, also a vertical arm end 815*c* of the thread shifting attachment arm 815 which is connected to another end of the aforementioned thread shifting horizontal rocking arm 817 performs the reciprocating rocking in the horizontal direction whose direction is same as the motion direction of the feed of the feed dog 601. And, when the eccentric shaft 816*c* of the thread shifting drive eccentric shaft 816 performs the small circular motion, because another end of the thread shifting up-and-down drive arm 820 performs the reciprocating rocking by the elongate hole 820*a* in the up-and-down direction by making the linking pin 821 the fulcrum, the thread shifting up-and-down rocking arm 822 which is connected to another end of the thread shifting up-and-down drive arm 820 performs the reciprocating motion in the up-and-down direction. When the thread shifting up-and-down rocking arm 822 performs the reciprocating motion in the up-and-down direction, because another end 815*b* of the thread shifting attachment arm 815 which is connected to the lower end 822*b* of the aforementioned thread shifting up-and-down rocking arm 822 performs the reciprocating rocking in the up-and-down direction, the vertical arm end 815*c* of the aforementioned thread shifting attachment arm 815 performs the reciprocating rocking in the horizontal direction whose direction is perpendicular to the motion direction of the feed of the feed dog 601.

Therefore, when two reciprocating rocking motions by the first link mechanism 813 and the second link mechanism 814 are combined, the tip portion 811*a* of the thread shifter 811 can perform the elliptical motion of the motion trace 830 as shown in FIG. 26 in the horizontal direction. Thereby, when the open eye needle 13 comes down from the upper dead center in the second stroke, it is possible to shift the thread by scooping the thread which is captured by the thread capturing open eye 13*a* by the tip portion 811*a* of the thread shifter 811 between the needle point of the open eye needle 13 and the fabric workpiece.

In the single-thread locked handstitch sewing machine composed in this way, the handstitch on the front surface and the locked stitch on the back surface of the fabric workpiece 21 are formed as the skip stitch set by cooperation of the open eye needle 13, the rotary hook 200 which is composed by the rocking bobbin casing 205 which is loaded at the rotating outer rotary hook 202 and the thread drawing out actuator 401. And, the stitch length feed of the fabric workpiece 21 for the handstitch is performed by the cloth feed mechanism 600 in the first stroke of the open eye needle 13, and the inter-stitch pitch feed of the fabric workpiece 21 for the inter-handstitch is performed by the cloth feed mechanism 600 in the second stroke of the open eye needle 13.

Besides, in the single-thread locked handstitch sewing machine, the stitch length feed quantity of the stitch length feed and the inter-stitch pitch feed quantity of the inter-stitch pitch feed are set by the feed quantity setting mechanism 300, and each fabric workpiece feed mode corresponding to the stitch length feed and the inter-stitch pitch feed respectively every one skip stitch set is changed over in sequence, and the set stitch length feed quantity and inter-stitch pitch feed quantity are transmitted to the feed drive mechanism 700 in each fabric workpiece feed mode respectively, and thereby, the fabric workpiece 21 is fed by the cloth feed mechanism 600. Meanwhile, in this specification, "cooperation" means working in cooperation with other portions.

Figure 19:
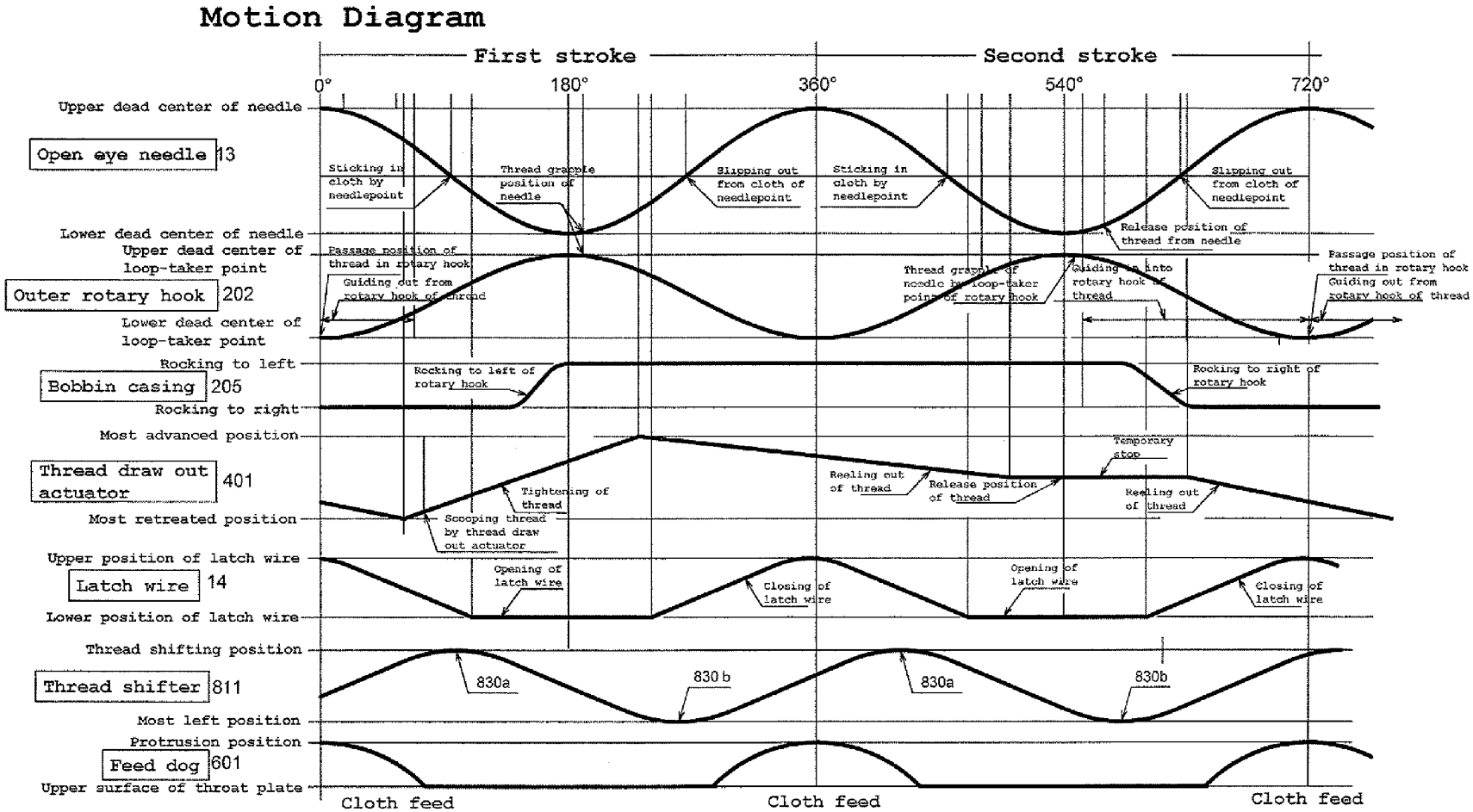
FIG. 19 A movement explanatory view showing the movement state of the open eye needle, the bobbin casing, the outer rotary hook, the thread draw out actuator, the latch wire and the feed dog of the single-thread locked handstitch sewing machine by this invention.
Figure 20:
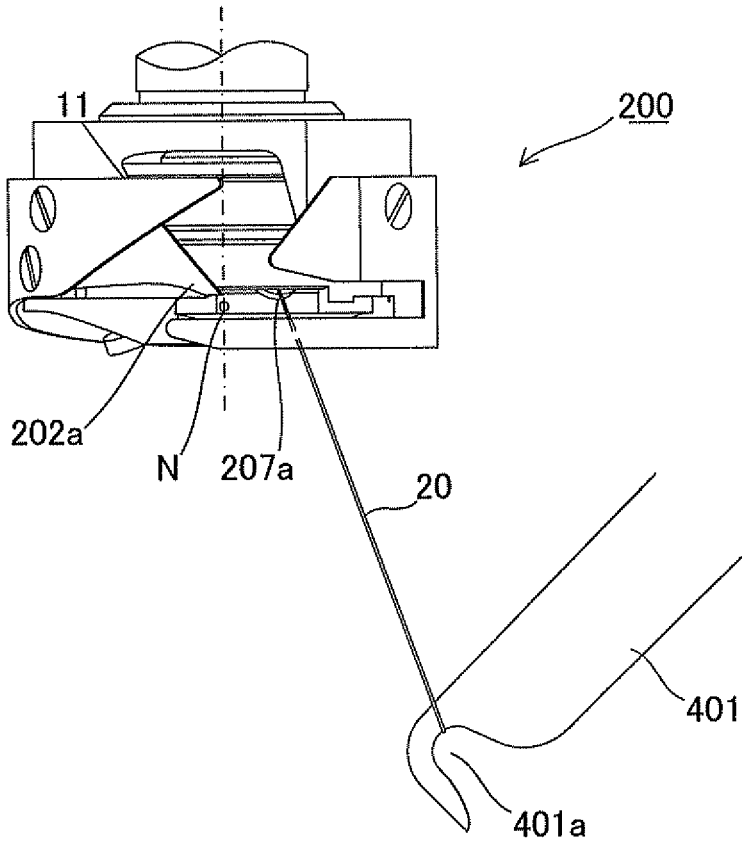
FIG. 20 (A) An explanatory view showing the preparatory state of the open eye needle which captures the thread when viewing the rotary hook which is described in FIG. 18 (G) from the upper side.
Figure 20:
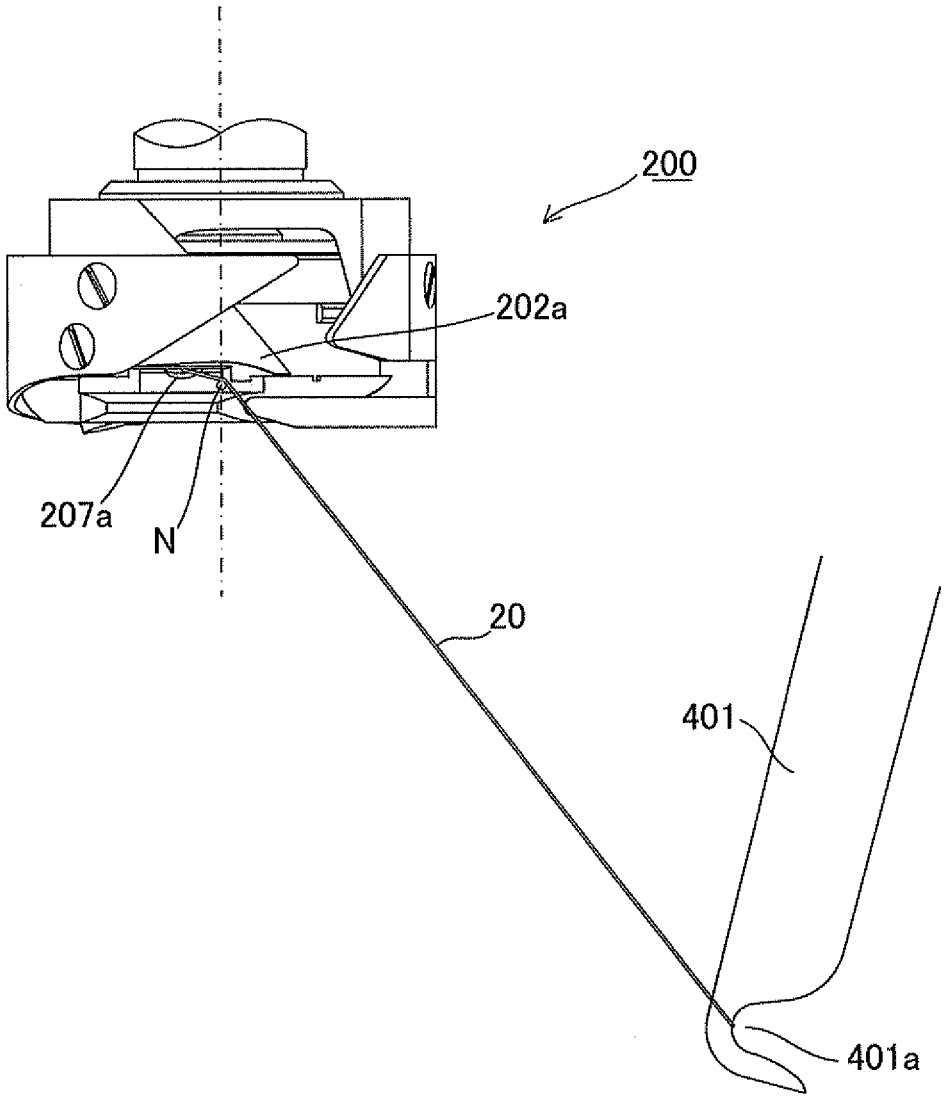

The movement of such the single-thread locked handstitch sewing machine is explained based on FIGS. 18 (A)-(O), FIG. 19 and FIG. 20 (A), (B) with a focus on the method for forming single-thread locked handstitches. FIG. 18 (A)-(O) are the movement explanatory view of the open eye needle 13, the rotary hook 200 which is composed by the rocking bobbin casing 205 which is loaded at the rotating outer rotary hook 202 and the thread draw out actuator 401, and FIG. 19 is the motion diagram of the open eye needle 13, the rotary hook 200, the thread draw out actuator 401, the latch wire 14 and the feed dog 601. In this movement explanation, when the direction is indicated, the state that FIGS. 18 (A)-(O) are seen from the front is explained. Besides, in FIG. 18 (A)-(O), the drawing of the feed dog 601 is omitted.

For the sake of convenience of the explanation, the movement explanation is performed from the state that the open eye needle 13 which does not capture the thread 20 by the thread capturing open eye 13*a* is positioned at the upper dead center and the state that the loop-taker point 202*a* of the outer rotary hook 202 is positioned at the lower direction of the vertical direction (FIG. 18 (A)).

In the state of FIG. 18 (A), the thread exit 207*a* of the bobbin case 207 which is incorporated in the bobbin casing 205 rocks to the right direction by the rocking actuator 208 which is driven by the bobbin casing rocking mechanism 220. The thread 20 which is drawn out from the thread exit 207*a* of the bobbin case 207 connects to the stitch which passes a needle throat 12*a* of the throat plate 12, and which passes through from the back surface of the fabric workpiece 21 to the front surface, and which folds back from the front surface to the back surface. And the thread 20 is the state of being guided in to the rotary hook 200 by the loop-taker point 202*a* of the outer rotary hook 202, the latch wire 14 is the closed state, and the feed dog 601 is the state of the inter-stitch feed. The feed direction of the fabric workpiece 21 is the left. In addition, in FIG. 19, because the skip stitch set is formed by two rotations of the pulley 4, one cycle of the sewing is shown with 720 degrees in the upper shaft 5, and FIG. 18 (A) is the state that the upper shaft 5 is 0 degree (720 degrees). The open eye needle 13 becomes the upper dead center when the upper shaft 5 is 0 degree; the open eye needle 13 becomes the lower dead center with 180 degrees; the open eye needle 13 becomes the upper dead center with 360 degrees; and the open eye needle 13 becomes the lower dead center with 540 degrees.

In FIG. 1, when the driven pulley 4 which is driven by the motor M through the drive belt MB rotates clockwise by looking from the side of the open eye needle 13, the open eye needle-latch wire drive mechanism 100, the cloth feed drive mechanism 700, a rotary hook drive portion 231-232, the bobbin casing rocking mechanism 220 and the thread draw out actuator drive mechanism 400 drive by the rotation of the upper shaft 5.

When the open eye needle-latch wire drive mechanism 100 drives, the open eye needle 13 performs the linear reciprocating motion vertically. When the cloth feed drive mechanism 700 drives, the feed dog 601 performs the four processes elliptical motions of the feed by the cloth feed mechanism 600. When the rotary hook drive portion 231-232 and the bobbin casing rocking mechanism 220 drive, the outer rotary hook 202 of the rotary hook 200 rotates and rocks. When the thread draw out actuator drive mechanism 400 drives, the thread draw out actuator 401 rocks. The movement explanation of each mechanism is omitted because the above-mentioned composition explanation was explained in detail.

(a) In the state that the thread 20 is not captured by the thread open eye 13*a* and in the first stroke, the open eye needle 13 which performs the linear reciprocating motion vertically comes down from the upper dead center (upper shaft 5: 0 degree), and pierces the fabric workpiece 21 which is placed on the throat plate 12 (FIG. 18 (A)-FIG. 18 (G), FIG. 19), and the bobbin casing 205 rocks just before the open eye needle 13 reaches the lower dead center, and the thread 20 which is drawn out from the thread exit 207*a* of the bobbin case 207 from the bobbin 206 which is incorporated in the bobbin casing 205 is contacted circumferentially on the open eye needle 13 and tightened. In addition, when the open eye needle 13 comes down from the upper dead center and passes through the fabric workpiece 21, the thread capturing open eye 13*a* of the open eye needle 13 becomes the open state by the latch-wire 14 (FIG. 18 (G), FIG. 19).

(b) when the open eye needle 13 goes up from the lower dead center (upper shaft: 180 degrees), the thread 20 which is wound on the bobbin 206 which is housed in the bobbin case 207 which is incorporated in the bobbin casing 205 at the lower direction of the throat plate 12, passes the thread exit 207*a* of the bobbin case 207, is drawn out by the thread draw out actuator 401, and is contacted circumferentially on the open eye needle 13 and tightened is captured by the thread capturing open eye 13*a* (FIG. 18 (H)-FIG. 18 (I), FIG. 19).

(c) In the state that the thread 20 is captured by the thread capturing open eye 13*a* and in the first stroke, while the open eye needle 13 slips out from the fabric workpiece 21, goes up, and passes through the upper dead center, the fabric workpiece 21 is fed with one stitch length by the cloth feed mechanism 600 (FIG. 19). The feed dog 601 stops the cloth feed of the fabric workpiece 21 before the open eye needle 13 sticks into the fabric workpiece 21 (FIG. 19). In addition, when the open eye needle 13 goes up from the lower dead center and passes the fabric workpiece 21, the thread capturing open eye 13*a* of the open eye needle 13 becomes the closed state by the latch-wire 14 (FIG. 18 (J)-FIG. 18 (K), FIG. 19).

(d) When the open eye needle 13 comes down from the upper dead center, passes through the above-described fabric workpiece, and goes up from the lower dead center in the second stroke, the thread 20 which is captured by the thread capturing open eye 13*a* is scooped by the loop-taker point 202*a* of the rotative outer rotary hook 202, and the captured thread 20 is released from the thread capturing open eye 13*a* by the rotation of the loop-taker point 202*a* of the outer rotary hook 202 (FIG. 18 (I)-FIG. 18 (M), FIG. 19).

In addition, in the second stroke, when the open eye needle 13 comes down from the upper dead center, the thread shifting of the thread 20 which is captured by the thread capturing open eye 13*a* is performed by being scooped by the tip portion 811*a* of the thread shifter 811 between the needlepoint of open eye needle 13 and the fabric workpiece in the thread shifting mechanism 800 (FIG. 18 (J)-FIG. 18 (L), FIG. 19). Therefore, when the open eye needle 13 comes down in the second stroke, there is no possibility that the thread 20 which is captured by the thread capturing open eye 13*a* of the open eye needle 13 between the needlepoint of open eye needle 13 and the fabric workpiece 21 becomes the slack state from the tight state, and the thread slack occurs, and the thread 20 of the slack state might be pierced by the needlepoint of the open eye needle 13 which descends.

(e) The thread 20 which is scooped by the loop-taker point 202*a* of the outer rotary hook 202 and is released is guided in to the rotary hook 200. The thread 20 which is draw out from the thread exit 207*a* of the bobbin case 207 is hooked just before guiding out from the rotary hook 200 by the thread draw out actuator 401 which is driven by the thread draw out actuator drive mechanism 400. The thread 20 which is guided in to the rotary hook 200 is interlaced to the thread 20 which is wound on the bobbin case 207, and the thread 20 which is guided out from the rotary hook 200 is tightened by the thread draw out actuator 401 by the thread draw out actuator drive mechanism 400 (FIG. 18 (B)-FIG. 18 (G), FIG. 19). In addition, after the open eye needle 13 passes through to the fabric workpiece 21, the thread draw out actuator 401 hooks the thread 20 which is drawn out from the thread exit 207*a* of the bobbin case 207, and begins the backward movement so as to release the thread 20 which is drawn out to tighten the thread at the same time as the descent of the open eye needle (FIG. 18 (I)-FIG. 18 (N), FIG. 19). Besides, when the thread 20 is guided in to the rotary hook 200 and guided out from the rotary hook 200, the outer rotary hook deviator 202*b* of the outer rotary hook 202 deviates the thread 20 just before guiding out from the rotary hook 200 to the direction of letting the thread 20 go from the rotatory plane of the loop-taker point 202*a*, and avoids hooking the thread 20 which is guided out from the rotary hook 200 by the loop-taker point 202*a* (FIG. 18 (C), FIG. 18 (D)).

(f) In the state that the thread 20 is not captured by the thread capturing open eye 13*a* and in the second stroke, while the open eye needle 13 slips out from the fabric workpiece 21, goes up, and passes through the upper dead center, the fabric workpiece 21 is fed with one inter-stitch pitch by the cloth feed mechanism 600. The feed dog 601 stops the one inter-stitch pitch feed before the open eye needle 13 sticks into the fabric workpiece 21 (FIG. 18 (N), (O), (A), FIG. 19).

(g) The handstitch on the front surface and the locked stitch on the back surface of the fabric workpiece 21 are formed respectively by repeating the steps from (a) to (f).

Therefore, the thread 20 is certainly captured to the thread capturing open eye 13*a* of the open eye needle 13, and the formation of single-thread locked stitch is performed in the inner space of the sewing machine bed, and the sewing which is suitable to the quasi-handstitch which is called pinpoint/saddle stitch is possible. Besides, because the handstitch on the front surface and the locked stitch on the back surface of the fabric workpiece 21 are formed respectively and the sewing-work is performed in the state that the handstitch can be seen on the surface for the worker, it is possible to confirm the position of the handstitch, thereby, the accurate sewing can be performed. In addition, because thread 20 which forms single-thread locked stitch does not come loose easily by performing the locked stitch sewing, the firm sewing can be obtained.

In such the single-thread locked handstitch sewing machine, the stitch length and the inter-stitch pitch can be adjusted by the feed quantity setting mechanism 300 and the feed mode changeover mechanism 350. The movements of the feed quantity setting mechanism 300 and the feed mode changeover mechanism 350 are explained based on FIG. 21-FIG. 24. FIG. 21-FIG. 24 are the drawings showing the feed quantity setting mechanism 300, the mode changeover mechanism 350, the cloth feed mechanism 600 and the cloth feed drive mechanism 700 schematically. Besides, in FIG. 21-FIG. 24, the stitch feed adjusting lever 301 and the inter-stitch feed adjusting lever 302 rocks upward and downward respectively. And these are composed so as to become the minimum feed pitch at the upper end point a's of the stitch feed adjusting lever 301 and the upper end point as of the inter-stitch feed adjusting lever 302, and these are composed so as to become the maximum feed pitch at the lower end point a'd of the stitch feed adjusting lever 301 and the lower end point ad of the inter-stitch feed adjusting lever 302. In this movement explanation, when the direction is indicated, FIG. 21-FIG. 24 are explained in the state seen toward the right direction from the direction of the feed dog 601.

<Setting Example that the Stitch Feed Pitch and the Inter-Stitch Feed Pitch are the Minimum Feed>

Figure 21:
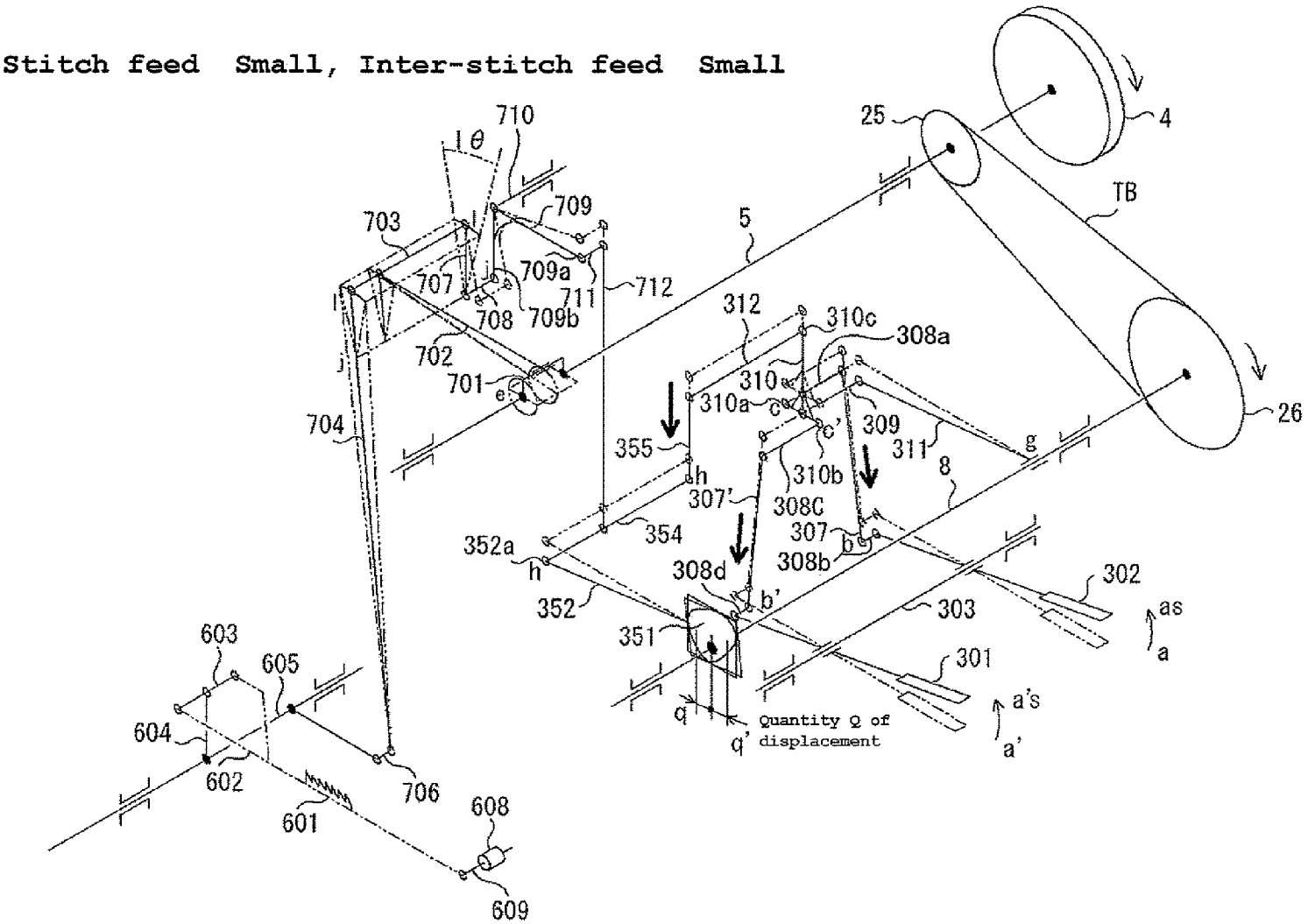
FIG. 21 A view showing the feed quantity setting mechanism, the mode changeover mechanism, the cloth feed mechanism and the cloth feed drive mechanism schematically in the single-thread locked handstitch sewing machine of this invention.

Firstly, the case that one stitch length P1 of the stitch feed and one inter-stitch pitch P2 of the inter-stitch feed are the minimum feed is explained based on FIG. 21, FIG. 8 (B), (C).

By operating the stitch feed adjusting lever 301 and the inter-stitch feed adjusting lever 302, when both are set at the upper end point a's, as of the minimum feed pitch, because the portions b', b which become each operating points of the stitch feed adjusting lever 301 and the inter-stitch feed adjusting lever 302 are respectively positioned at the lowermost point, the connecting adjusting lever link 307' and 307 move respectively the reverse T-shaped feed adjuster 310 which is supported by the supporting arm 311 to the lower direction in the vertical state. This moved position becomes the lowermost position of the feed adjuster 310.

When the reverse T-shaped feed adjuster 310 is positioned at the lowermost position in the vertical state, the connecting end 352*a* of the feed changeover rod 352 and the horizontal feed connection link 712 are respectively downed to the lower direction through the stitch length changeover link 355 which is pivotally attached to the vertical arm end of the reverse T-shaped feed adjuster 310.

This moved position becomes the lowermost position of the connecting end 352*a* of the feed changeover rod 352 and the horizontal feed connection link 712. In this state, when the intermediate shaft 8 rotates clockwise, because the feed changeover triangular cam 351 performs the eccentric motion, the feed changeover rod 352 performs the reciprocating rocking intermittently between the right-and-left two positions q and q' of the almost horizontal direction with the quantity Q of displacement. The shape of the feed changeover triangular cam 351 is formed so that the feed changeover rod 352 can stop intermittently in the moved position q and q'. The time which stops intermittently in the moved position q and q' is decided by the feed changeover triangular cam 351. And, because the intermediate shaft 8 rotates one time while the upper shaft 5 rotates two times, the feed changeover rod 352 moves to the moved position of q direction by the one rotation of the upper shaft, and moves to the moved position of q' direction by the further one rotation of the upper shaft.

When the feed changeover rod 352 stops intermittently by moving to the position q' of the right direction, the point h which is one end of the stitch length changeover link 355 corresponds to the point c' which is another horizontal arm end 310*b* of the reverse T-shaped feed adjuster 310 which moved to the lowermost position. And, when the feed changeover rod 352 stops intermittently by moving to the position q of the left direction, the point h which is one end of the stitch length changeover link 355 corresponds to the point c which is one horizontal arm end 310*a* of the reverse T-shaped feed adjuster 310 which moved to the lowermost position. Therefore, because the position of the point h which is one end of the horizontal feed connection link 712 can be decided to the point c which is one horizontal arm end 310*a* and the point c' which is another horizontal arm end 310*b* of the feed adjuster 310 which are respectively set by the stitch feed adjusting lever 301 and the inter-stitch feed adjusting lever 302, the setup of each fabric workpiece feed mode can be changed over in sequence. This setup of each fabric workpiece feed mode is performed by the feed changeover rod 352. And the cloth feed is performed every this fabric workpiece feed mode.

As described above, when the stitch feed adjusting lever 301 and the inter-stitch feed adjusting lever 302 are respectively set in the minimum feed pitch, the first arm 709*a* of the horizontal feed connection crank 709 is downed to the horizontal feed connection link 712 and rotates clockwise. Therefore, the point j which is the lower end of the second arm 709*b* of the horizontal feed connection crank 709 rocks to the left direction and is stopping. In this state, when the upper shaft 5 rotates clockwise, because the horizontal feed drive rod 702 performs the reciprocating motion by the quantity e of eccentricity of the horizontal feed eccentric cam 701 in the almost horizontal direction, the point j which is one end of the horizontal feed rod link 707 which is connected to the second arm 709*b* of the horizontal feed crank 709 becomes the rocking center, and the horizontal feed vertical rod 704 which is connected to another end 1 of the horizontal feed rod link 707 rocks to the right-and-left direction. In addition, the position that the second arm 709*b* of the horizontal feed crank 709 rocks to the left direction and stops is set so that the point j which is one end of the horizontal feed rod link 707 corresponds to the rocking center of the horizontal feed vertical rod 704. And because the rocking center of the horizontal feed rod link 707 and the rocking center of the horizontal feed vertical rod 704 overlap, even if the quantity e of eccentricity of the horizontal feed eccentric cam 701 is transmitted, the up-and-down motion which is transmitted to the horizontal feed vertical rod 704 becomes extremely few. Therefore, in each fabric workpiece feed mode, the horizontal feed quantity of the feed dog 601 becomes minimum, and the fabric workpiece 21 becomes minimum feed.

<Setting Example that the Stitch Feed Pitch and the Inter-Stitch Feed Pitch are the Maximum Feed>

Figure 22:
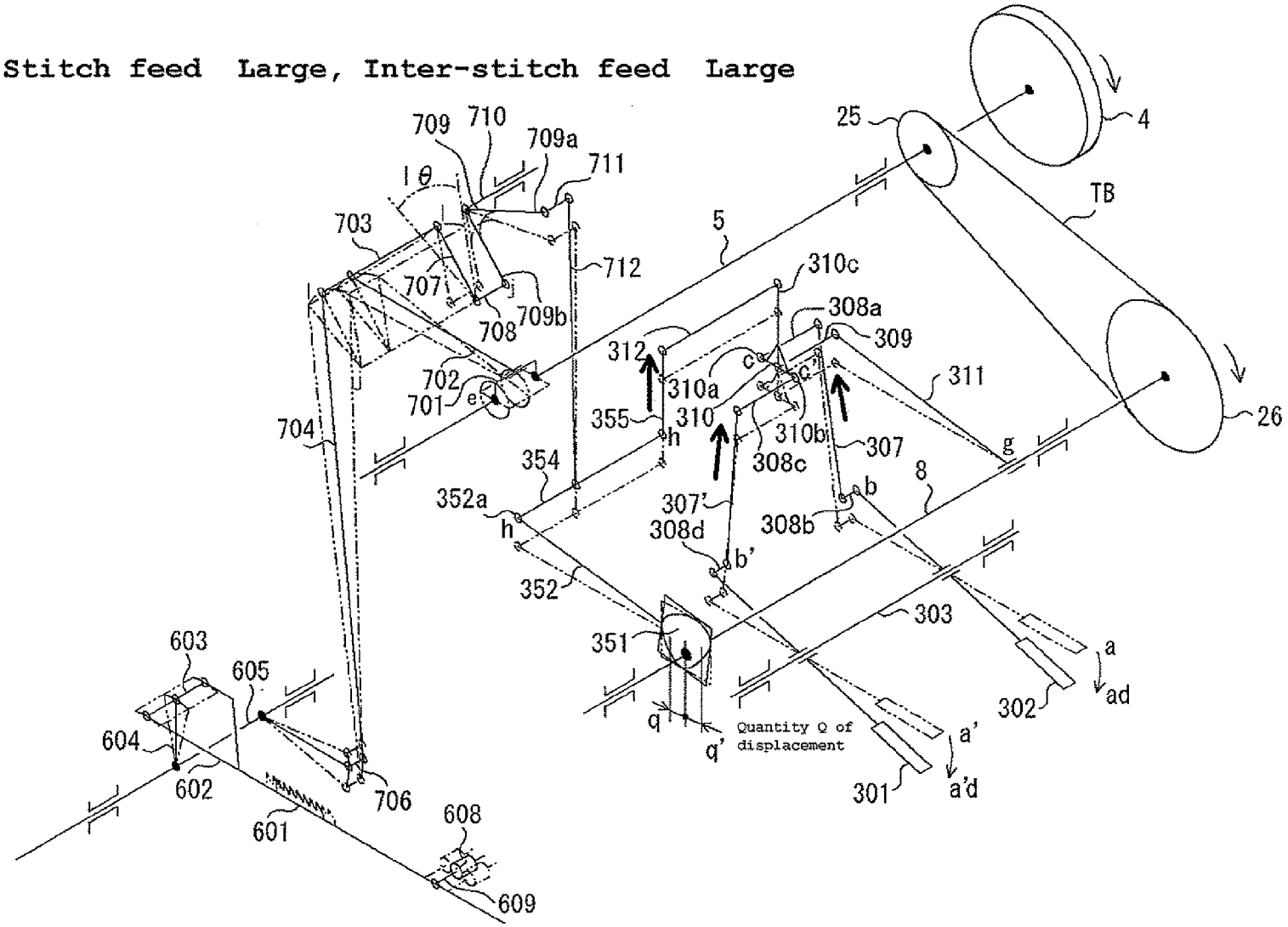
FIG. 22 A view showing the feed quantity setting mechanism, the mode changeover mechanism, the cloth feed mechanism and the cloth feed drive mechanism schematically in the single-thread locked handstitch sewing machine of this invention.

Next, the case that one stitch length P1 of the stitch feed and one inter-stitch pitch F2 of the inter-stitch feed are the maximum feed is explained based on FIG. 22, FIG. 8 (B), (C).

When both of the stitch feed adjusting lever 301 and the inter-stitch feed adjusting lever 302 are set at the lower end-points a'd, ad of the maximum feed pitch by operating the stitch feed adjusting lever 301 and the inter-stitch feed adjusting lever 302, because the portions b', b which become each operating point of the stitch feed adjusting lever 301 and the inter-stitch feed adjusting lever 302 respectively are positioned at the uppermost positions, the connecting adjusting lever link 307', 307 respectively move upward the reverse T-shaped feed adjuster 310 which is supported by the supporting arm 311 in the vertical state. This moved position becomes the uppermost position of the feed adjuster 310.

When the reverse T-shaped feed adjuster 310 is positioned at the uppermost position in the vertical state, the connecting end 352*a* of the feed changeover rod 352 and the horizontal feed connection link 712 are respectively pushed up to the upper direction through the stitch length changeover link 355 which is pivotally attached to the vertical arm end 3100 of the reverse T-shaped feed adjuster 310. This moved position becomes the uppermost position of the connecting end 352*a* of the feed changeover rod 352 and the horizontal feed connection link 712. In this state, when the intermediate shaft 8 rotates clockwise, as well as the above-mentioned setting example of the minimum feed, because the feed changeover triangular cam 351 performs the eccentric motion, the feed changeover rod 352 performs the reciprocating rocking intermittently between the right-and-left two positions q and q' of the almost horizontal direction in the quantity Q of displacement. In addition, the shape of the feed changeover triangular cam 351 is formed so that the feed changeover rod 352 can stop intermittently in the moved position q and q'. The time which stops intermittently in the moved position q and q' is decided by the feed changeover triangular cam 351. And, because the intermediate shaft 8 rotates one time while the upper shaft 5 rotates two times, the feed changeover rod 352 moves to q direction of the moved position by the one rotation of the upper shaft, and moves to q' direction of the moved position by the further one rotation of the upper shaft.

When the feed changeover rod 352 stops intermittently by moving to the position q' of the right direction, the point h which is one end of the stitch length changeover link 355 corresponds to the point c' which is another horizontal arm end 310*b* of the reverse T-shaped feed adjuster 310 which moved to the uppermost position. And, when the feed changeover rod 352 stops intermittently by moving to the position q of the left direction, the point h which is one end of the stitch length changeover link 355 corresponds to the point c which is one horizontal arm end 310*a* of the reverse T-shaped feed adjuster 310 which moved to the uppermost position. Therefore, because the position of the point h which is one end of the horizontal feed connection link 712 can be decided to the point c which is one horizontal arm end 310*a* and the point a' which is another horizontal arm end 310*b* of the feed adjuster 310 which are respectively set by the stitch feed adjusting lever 301 and the inter-stitch feed adjusting lever 302, the setup of each fabric workpiece feed mode can be changed over in sequence. This setup of each fabric workpiece feed mode is performed by the feed changeover rod 352. And the cloth feed is performed every this fabric workpiece feed mode.

As described above, when the stitch feed adjusting lever 301 and the inter-stitch feed adjusting lever 302 are respectively set in the maximum feed pitch, the first arm 709*a* of the horizontal feed connection crank 709 is pushed up to the horizontal feed connection link 712 and rotates counterclockwise. Therefore, the point j which is the lower end of the second arm 709*b* of the horizontal feed connection crank 709 rocks to the right direction and is stopping. In this state, when the upper shaft 5 rotates clockwise, the horizontal feed drive rod 702 performs the reciprocating motion by the quantity e of eccentricity of the horizontal feed eccentric cam 701 in the almost horizontal direction. Thereby, when the horizontal feed eccentric cam 701 is eccentric and rotates and moves to the left direction, by the horizontal feed drive rod 702, another end 1 of the horizontal feed rod link 707 rocks to the lower left direction. And when the horizontal feed eccentric cam 701 is eccentric, rotates and moves to the right direction, by the horizontal feed drive rod 702, another end 1 of the horizontal feed rod link 707 rocks to the upper right direction. Consequently, the reciprocating rocking motion by the horizontal feed drive rod 702 is transmitted to the horizontal feed vertical rod 704 by being transferred to the maximum up-and-down reciprocating motion. Therefore, in each fabric workpiece feed mode, the horizontal feed quantity of the feed dog 601 becomes maximum pitch, and the cloth feed of the fabric workpiece 21 is performed with maximum pitch.

<Setting Example that the Stitch Feed Pitch is Minimum and the Inter-Stitch Feed Pitch is Maximum>

Figure 23:
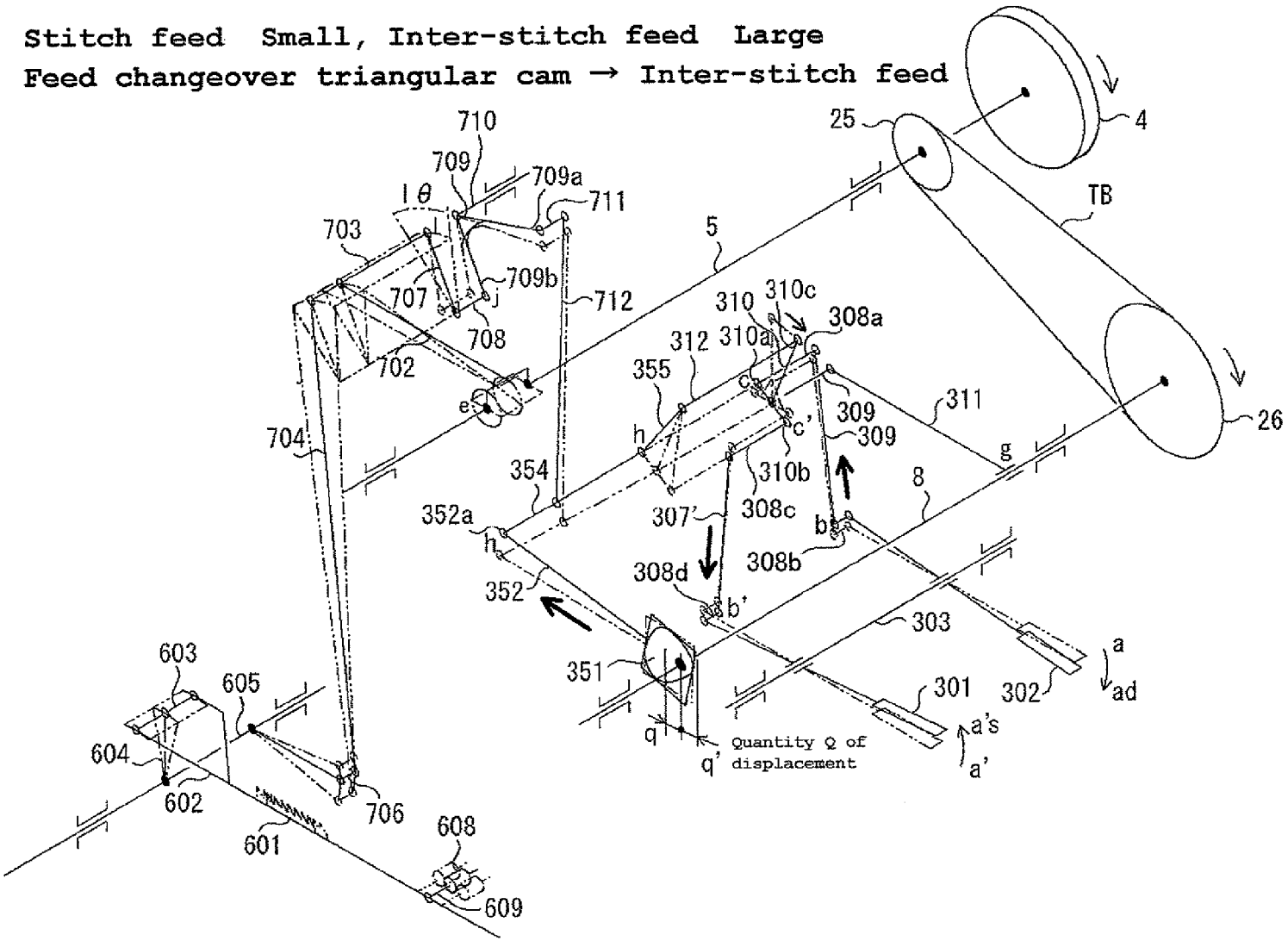
FIG. 23 (A) A view showing the feed quantity setting mechanism, the mode changeover mechanism, the cloth feed mechanism and the cloth feed drive mechanism schematically in the single-thread locked handstitch sewing machine of this invention.
Figure 23:
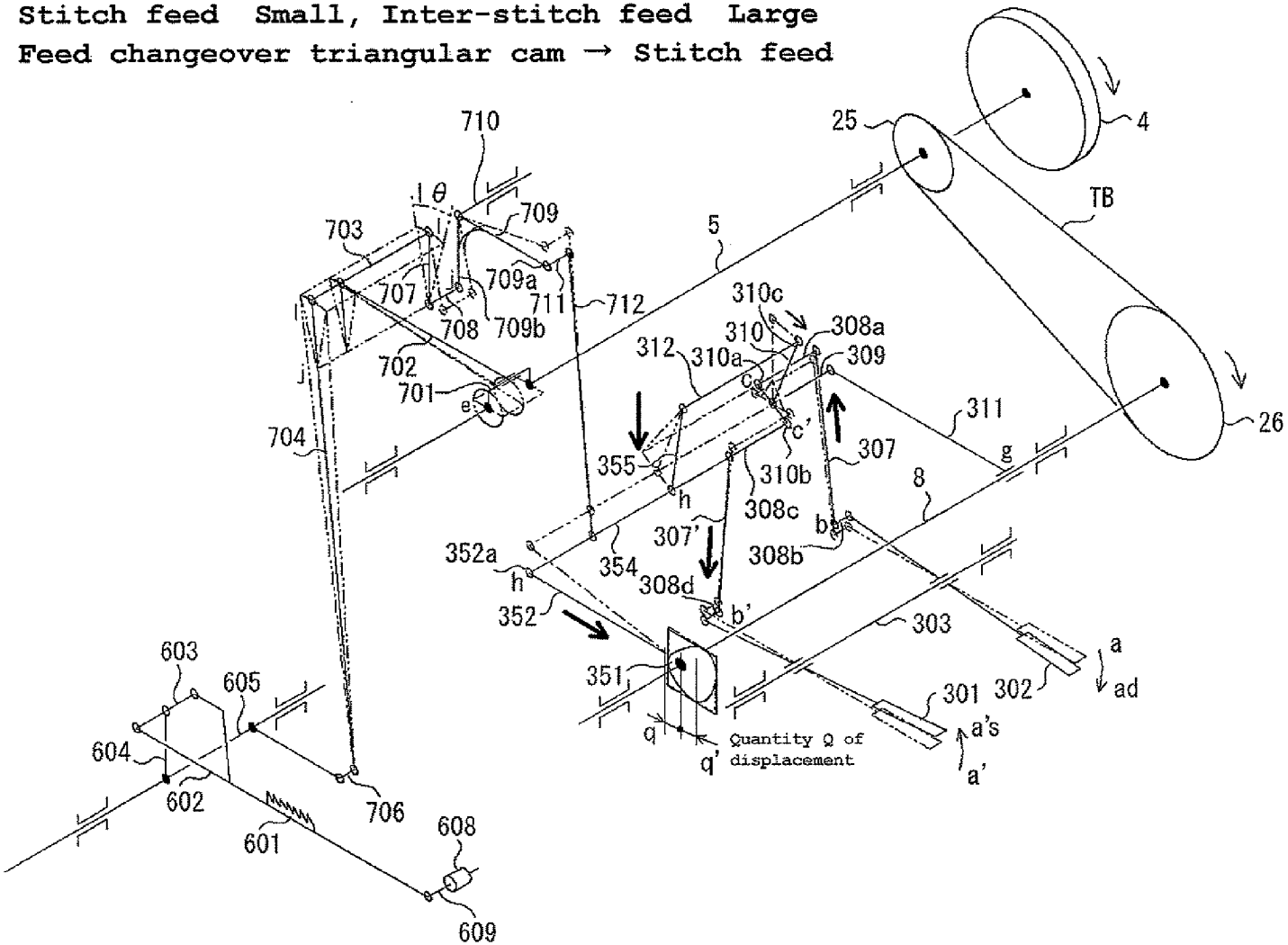

Next, as shown in FIG. 8 (B), the case that one stitch length P1 of the stitch feed is the minimum feed and one inter-stitch pitch P2 of the inter-stitch feed is the maximum feed is explained based on FIGS. 23 (A) and (B).

As shown in FIG. 23 (A), when setting the stitch feed adjusting lever 301 at the uppermost position a's of the minimum feed pitch and when setting the inter-stitch feed adjusting lever 302 at the lowermost position ad of the maximum feed pitch by operating respectively, the portion b' which becomes the operating point of the stitch feed adjusting lever 301 is positioned at the lowermost position and the portion b which becomes the operating point of the inter-stitch feed adjusting lever 302 is positioned at the uppermost position. The adjusting lever link 307' which is connected to the stitch feed adjusting lever 301 pulls down another horizontal arm end 310*b* of the reverse T-shaped feed adjuster 310, and the adjusting lever link 307 which is connected to the inter-stitch feed adjusting lever 302 pushes up one horizontal arm end 310*a* of the reverse T-shaped feed adjuster 310. Consequently, the reverse T-shaped feed adjuster 310 rotates clockwise around a pivotally supporting point d which is pivotally supported by the supporting arm 311.

In such state, in the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q of the left direction and stops intermittently, the point h which is one end of the stitch length changeover link 355 corresponds to the point c which is one horizontal arm end 310*a* of the clockwise rotated reverse T-shaped feed adjuster 310. That is, the point h which is one end of the stitch length changeover link 355 moves to the upper left direction by rotating clockwise on the linking pin 312. Therefore, the horizontal feed connection link 712 which is connected to another end of the stitch length changeover link 355 is pushed up to the upper direction, and the first arm 709*a* of the horizontal feed connection crank 709 which is connected to the horizontal feed connection link 712 is pushed up and rotates counterclockwise. Therefore, the point j which is the lower end of the second arm 709*b* of the horizontal feed connection crank 709 rocks to the right direction and is stopping. In this state, when the upper shaft 5 rotates clockwise, the horizontal feed drive rod 702 performs the reciprocating motion by the quantity e of eccentricity of the horizontal feed eccentric cam 701 in the almost horizontal direction. Thereby, when the horizontal feed eccentric cam 701 is eccentric and rotates and moves to the left direction, by the horizontal feed drive rod 702, another end 1 of the horizontal feed rod link 707 rocks to the lower left direction. And when the horizontal feed eccentric cam 701 is eccentric and rotates and moves to the right direction, by the horizontal feed drive rod 702, another end 1 of the horizontal feed rod link 707 rocks to the upper right direction and is stopping. Consequently, the reciprocating rocking motion by the horizontal feed drive rod 702 is transmitted to the horizontal feed vertical rod 704 by being transferred to the maximum up-and-down reciprocating motion. Therefore, the inter-stitch feed which is set by the inter-stitch feed adjusting lever 302 becomes the feed quantity of the maximum feed pitch.

On the other hand, as shown in FIG. 23 (B), the vertical arm end 310*c* of the reverse T-shaped feed adjuster 310 inclines to the right direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q' of the right direction and stops intermittently, the point h which is one end of the stitch length changeover link 355 corresponds to the point c' which is another horizontal arm end 310*b* of the clockwise rotated reverse T-shaped feed adjuster 310.

That is, the point h which is one end of the stitch length changeover link 355 moves to the lower right direction by rotating counterclockwise around the linking pin 312. Therefore, the horizontal feed connection link 712 which is connected to another end of the stitch length changeover link 355 is pulled down to the lower direction, and the first arm 709*a* of the horizontal feed connection crank 709 which is connected to the horizontal feed connection link 712 is pulled down and rotates clockwise. Therefore, the point j which is the lower end of the second arm 709*b* of the horizontal feed connection crank 709 rocks to the left direction and is stopping. In this state, when the upper shaft 5 rotates clockwise, the horizontal feed drive rod 702 performs the reciprocating motion by the quantity e of eccentricity of the horizontal feed eccentric cam 701 in the almost horizontal direction. Thereby, the point j which is one end of the horizontal feed rod link 707 which is connected to the second arm 709*b* of the horizontal feed crank 709 becomes the rocking center, and the horizontal feed vertical rod 704 which is connected to another end 1 of the horizontal feed rod link 707 rocks to the right-and-left direction. In addition, the position that the second arm 709*b* of the horizontal feed crank 709 rocks to the left direction and stops is set so that the point j which is one end of the horizontal feed rod link 707 corresponds to the rocking center of the horizontal feed vertical rod 704. And because the rocking center of the horizontal feed rod link 707 and the rocking center of the horizontal feed vertical rod 704 overlap, even if the quantity e of eccentricity of the horizontal feed eccentric cam 701 is transmitted, the up-and-down motion which is transmitted to the horizontal feed vertical rod 704 becomes extremely few. Therefore, because the horizontal feed quantity of the feed dog 601 also becomes extremely few, the cloth feed of the fabric workpiece 21 is few. That is, it becomes the feed quantity of the minimum feed pitch which is set by the stitch feed adjusting lever 301.

As described above, each setup of each fabric workpiece feed mode can be changed over in sequence.

<Setting Example that the Stitch Feed Pitch is Maximum and the Inter-Stitch Feed Pitch is Minimum>

Figure 24:
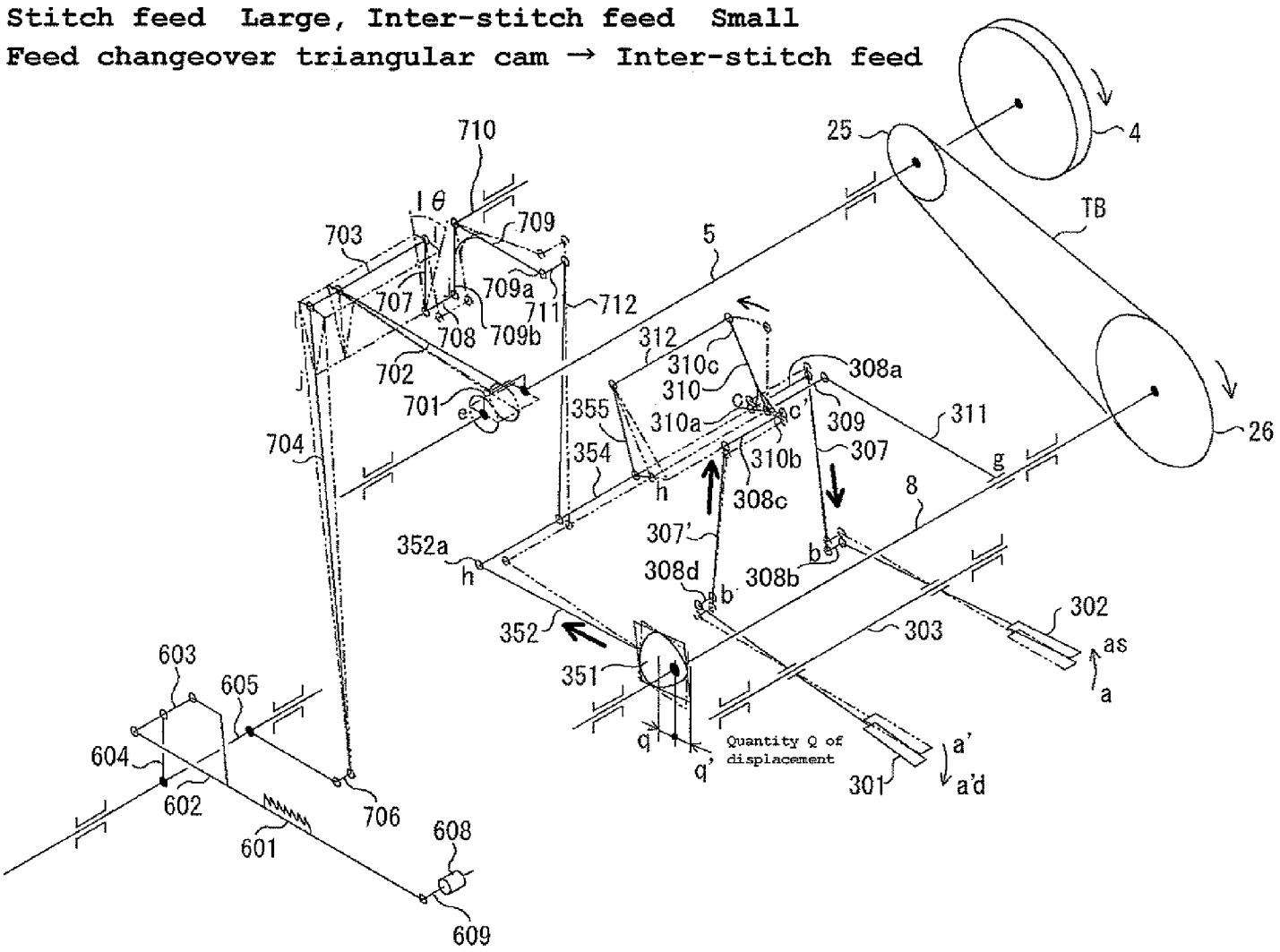
FIG. 24 (B) A view showing the feed quantity setting mechanism, the mode changeover mechanism, the cloth feed mechanism and the cloth feed drive mechanism schematically in the single-thread locked handstitch sewing machine of this invention.
Figure 24:
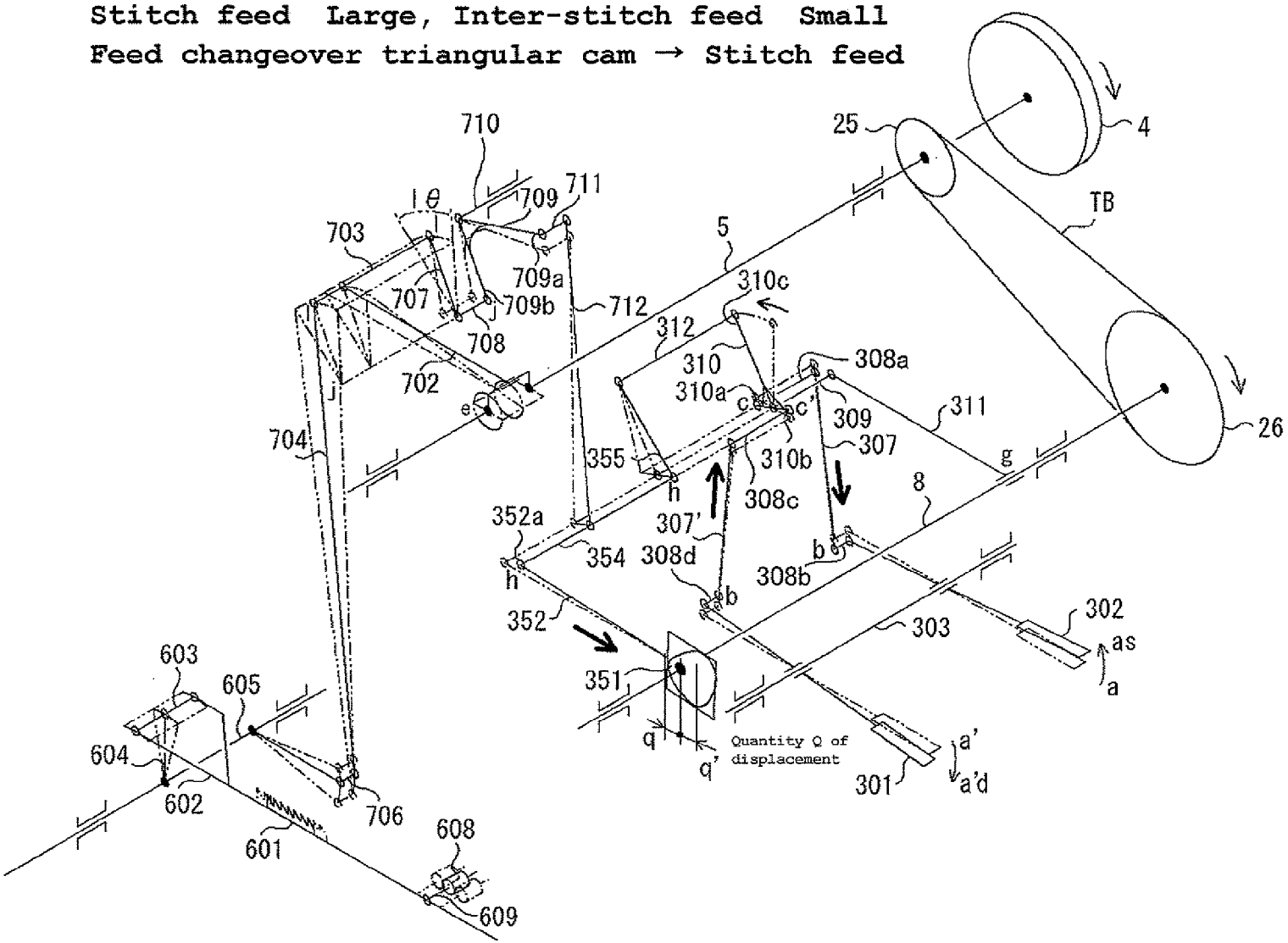

Next, as shown in FIG. 8 (C), the case that one stitch length P1 of the stitch feed is the maximum feed and one inter-stitch pitch P2 of the inter-stitch feed is the minimum feed is explained based on FIGS. 24 (A) and (B).

As shown in FIG. 24 (A), when setting the stitch feed adjusting lever 301 at the lowermost position a'd of the maximum feed pitch and when setting the inter-stitch feed adjusting lever 302 at the uppermost position ad of the minimum feed pitch by operating respectively, the portion b' which becomes the operating point of the stitch feed adjusting lever 301 is positioned at the uppermost position and the portion b which becomes the operating point of the inter-stitch feed adjusting lever 302 is positioned at the lowermost position. The adjusting lever link 307' which is connected to the stitch feed adjusting lever 301 pushes up another horizontal arm end 310*b* of the reverse T-shaped feed adjuster 310, and the adjusting lever link 307 which is connected to the inter-stitch feed adjusting lever 302 pulls down one horizontal arm end 310*a* of the reverse T-shaped feed adjuster 310. Consequently, the reverse T-shaped feed adjuster 310 rotates counterclockwise around a pivotally supporting point d which is pivotally supported by the supporting arm 311.

In this state, the vertical arm end 310*c* of the reverse T-shaped feed adjuster 310 inclines to the left direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q of the left direction and stops intermittently, the point h which is one end of the stitch length changeover link 355 corresponds to the point c which is one horizontal arm end 310*a* of the counterclockwise rotated reverse T-shaped feed adjuster 310. That is, the point h which is one end of the stitch length changeover link 355 moves to the lower left direction by rotating clockwise around the linking pin 312. Therefore, the horizontal feed connection link 712 which is connected to another end of the stitch length changeover link 355 is pulled down to the lower direction, and the first arm 709*a* of the horizontal feed connection crank 709 which is connected to the horizontal feed connection link 712 is pulled down and rotates clockwise. Therefore, the point j which is the lower end of the second arm 709*b* of the horizontal feed connection crank 709 rocks to the left direction and is stopping. In this state, when the upper shaft 5 rotates clockwise, the horizontal feed drive rod 702 performs the reciprocating motion by the quantity e of eccentricity of the horizontal feed eccentric cam 701 in the almost horizontal direction. Thereby, the point j which is one end of the horizontal feed rod link 707 which is connected to the second arm 709*b* of the horizontal feed crank 709 becomes the rocking center, and the horizontal feed vertical rod 704 which is connected to another end 1 of the horizontal feed rod link 707 rocks to the right-and-left direction. In addition, the position that the second arm 709*b* of the horizontal feed crank 709 rocks to the left direction and stops is set so that the point j which is one end of the horizontal feed rod link 707 corresponds to the rocking center of the horizontal feed vertical rod 704. And because the rocking center of the horizontal feed rod link 707 and the rocking center of the horizontal feed vertical rod 704 overlap, even if the quantity e of eccentricity of the horizontal feed eccentric cam 701 is transmitted, the up-and-down motion which is transmitted to the horizontal feed vertical rod 704 becomes extremely few. Therefore, because the horizontal feed quantity of the feed dog 601 also becomes extremely few, the cloth feed of the fabric workpiece 21 is few. That is, it becomes the feed quantity of the minimum feed pitch which is set by the inter-stitch feed adjusting lever 302.

On the other hand, as shown in FIG. 24 (B), the vertical arm end 310*c* of the reverse T-shaped feed adjuster 310 inclines to the left direction. In the stitch length changeover link 355 which is connected to the vertical arm end 310*c*, the intermediate shaft 8 rotates clockwise and the feed changeover triangular cam 351 performs the eccentric motion. Thereby, when the feed changeover rod 352 moves to the position q' of the right direction and stops intermittently, the point h which is one end of the stitch length changeover link 355 corresponds to the point c' which is another horizontal arm end 310*b* of the counterclockwise rotated reverse T-shaped feed adjuster 310. That is, the point h which is one end of the stitch length changeover link 355 moves to the upper right direction by rotating counterclockwise around the linking pin 312. Therefore, the horizontal feed connection link 712 which is connected to another end of the stitch length changeover link 355 is pushed up to the upper direction, and the first arm 709*a* of the horizontal feed connection crank 709 which is connected to the horizontal feed connection link 712 is pushed up and rotates counterclockwise. Therefore, the point j which is the lower end of the second arm 709*b* of the horizontal feed connection crank 709 rocks to the right direction and is stopping. In this state, when the upper shaft 5 rotates clockwise, the horizontal feed drive rod 702 performs the reciprocating motion by the quantity e of eccentricity of the horizontal feed eccentric cam 701 in the almost horizontal direction. Thereby, when the horizontal feed eccentric cam 701 is eccentric, rotates and moves to the left direction, by the horizontal feed drive rod 702, another end 1 of the horizontal feed rod link 707 rocks to the lower left direction. And when the horizontal feed eccentric cam 701 is eccentric, rotates and moves to the right direction, by the horizontal feed drive rod 702, another end 1 of the horizontal feed rod link 707 rocks to the upper right direction and is stopping. Consequently, the reciprocating rocking motion by the horizontal feed drive rod 702 is transmitted to the horizontal feed vertical rod 704 by being transferred to the maximum up-and-down reciprocating motion. Therefore, the inter-stitch feed which is set by the stitch feed adjusting lever 301 becomes the feed quantity of the maximum feed pitch.

As described above, each setup of each fabric workpiece feed mode can be changed over in sequence.

As described above, in each feed quantity of one stitch length feed and one inter-stitch pitch feed by the feed quantity setting mechanism 300 and the feed mode changeover mechanism 350, by changing over the feed quantity which is respectively set by the position setting of each adjusting lever 301, 302 alternately, the cloth feed of the fabric workpiece 21 can be performed by the feed dog 601. And, because the single-thread locked handstitches is formed by the cooperation of the open eye needle 13, the rotary hook 200 and the thread draw out actuator 401, the stitch length and the inter-stitch pitch can be set freely.

Next, the feed quantity which is set by the feed quantity setting mechanism 300, that is, the thread tightness adjusting operation of the thread tightness adjusting mechanism 420 which adjusts the thread tightness quantity of the thread draw out actuator 401 corresponding to the stitch length is explained based on FIG. 16 (A), (B), FIG. 17 (A), (B).

FIG. 17 (A) is the drawing which is looking from the underneath of the sewing machine. The stitch length is shown as the maximum setting, and the guide direction of the guide groove 425*a* of the thread draw out actuator adjusting grooved block 425 is located in accordance with the movement direction of the thread draw out actuator adjusting rod 424. In (i), the cam follower 406 is the maximum radial position of the cam groove 407*a*, and the thread draw out actuator drive rod base 405 and the thread draw out actuator adjusting rod 424 are most retreated positions, and the thread draw out actuator 401 is the retreated waiting position. In (ii), the cam follower 406 is the minimum radial position of the cam groove 407*a*, and the thread draw out actuator drive rod base 405 and the thread draw out actuator adjusting rod 424 are most advanced positions, and the thread draw out actuator 401 is the advanced thread tightness position.

FIG. 17 (B) is the drawing which is looking from the underneath of the sewing machine. The operation of the case that the stitch length is set short is shown. The operation is shown as follows. The thread draw out actuator adjusting vertical rod 431 which is connected to the stitch feed adjusting lever 301 performs the up-and-down motion when the stitch length is set short by the stitch feed adjusting lever 301. And the connected thread draw out actuator adjusting bell crank 432 slides the slide link 433, engages to the pin 426*b* which is assembled integrally to the thread draw out actuator adjusting grooved block 425 and swivels the thread draw out actuator adjusting grooved block 425. In (i), the cam follower 406 is the maximum radial position of the cam groove 407*a*, and the thread draw out actuator drive rod base 405 and the thread draw out actuator adjusting rod 424 are most retreated positions, and the thread draw out actuator 401 is the retreated waiting position.

In this case, the point e' of the rotation center of the square piece 421 corresponds to the point e of the swiveling center of the thread draw out actuator adjusting grooved block 425 and is located, and the eccentric adjusting arm 423 faces the same direction as the movement direction of the thread draw out actuator adjusting rod 424. In (ii), the cam follower 406 is the minimum radial position of the cam groove 407*a*, and the thread draw out actuator drive rod base 405 and the thread draw out actuator adjusting rod 424 are most advanced positions, and the thread draw out actuator 401 is the advanced thread tightness position. In this case, the eccentric adjusting arm 423 pushes the square piece 421 by the advance of the thread draw out actuator drive rod base 405, and the square piece 421 shows the point e' of the rotation center which is guided and slid in the inside of the guide groove 425*a*.

The point a is the rotation center of the thread draw out actuator drive cam 407, the point b is the rotation center of the cam follower 406, the point c is the rotation center of the thread draw out actuator eccentric shaft 422, the point d is the center point of the eccentricity of the thread draw out actuator eccentric shaft 422, the point e is the rotation center of the thread draw out actuator adjusting grooved block 425, the point is the rotation center of the central shaft 421*a* of the square piece 421, the point f is the rocking center of the thread draw out actuator 401 and the point g is the connecting point of the thread draw out actuator drive arm 403 and the thread draw out actuator adjusting rod 424. Besides, L1 shown in FIG. 17 (B) is the length from the point a to the point b, and L2 is the length from the point d to the point g. The length L1, L2 is the unchanging basic size which decides the waiting position of the thread draw out actuator 401. L3 is the length from the point c to the point g. H is the maximum value-minimum value of the trace of the cam groove 407*a*.

When the rotation center b of the cam follower 406 is the maximum radial basic point of the cam groove 407*a*, the thread draw out actuator 401 is the most retreated position, that is, the waiting position.

By being connected to the pin 426*b* which is provided at the protruded end of the thread draw out actuator adjusting grooved block 425 through the thread draw out actuator adjusting vertical rod 431 which is connected to the stitch feed adjusting lever 301, the thread draw out actuator adjusting bell crank 432 and the slide link 433, the thread draw out actuator adjusting grooved block 425 inclines with the inclined angle θ by the setting quantity of the stitch feed adjusting lever 301.

When the stitch length is set maximum by the stitch feed adjusting lever 301, the inclined angle θ of the thread draw out actuator adjusting grooved block 425 becomes 0 degree, and the guide groove 425*a* guides the square piece 421 on the reference line. The setting quantity H of the thread draw out actuator drive cam 407 rocks the thread draw out actuator drive arm 403 with the length L1+L2 (basic size) of the thread draw out actuator drive rod base 405 and the thread draw out actuator adjusting grooved block 425, and rocks the thread draw out actuator 401 which is fixed to the thread draw out actuator drive arm 403.

When the stitch length is set minimum by the stitch feed adjusting lever 301, the inclined angle θ of the thread draw out actuator adjusting grooved block 425 becomes the maximum angle, and the guide groove 425*a* guides the square piece 421 to the direction of the inclined angle θ from the reference line.

When the square piece 421 is guided along the guide groove 425*a*, the eccentric adjusting arm 423 inclines with the angle β around the thread draw out actuator eccentric shaft 422.

When the eccentric adjusting arm 423 inclines with the angle β around the thread draw out actuator eccentric shaft 422, the thread draw out actuator eccentric shaft 422 that the eccentric direction is fixed to the eccentric adjusting arm 423 with the right angle rotates with the angle β, and the eccentric direction also inclines.

The quantity J of the eccentricity inclines to the angle β, and the position of the connecting point d of the thread draw out actuator adjusting rod 424 moves only by $K=\sin\beta\cdot J$ for the rotation center c of the thread draw out actuator drive rod base 405, and the thread draw out actuator adjusting rod 424 slides on the thread draw out actuator drive rod base 405.

Thereby, the length L2 between c and g of the respective connecting points shortens to L2−k=L3.

That is, when the stitch length is set minimum by the stitch feed adjusting lever 301, the maximum value-minimum value H of the trace of the cam groove 407*a* shortens to the length L1+L3 of the thread draw out actuator drive rod base 405 and the thread draw out actuator adjusting rod 424, and rocks the thread draw out actuator drive arm 403, and the stroke of the thread draw out actuator 401 which is fixed to the thread draw out actuator drive arm 403, that is, the rocking quantity Pa becomes few to the rocking quantity Pb, and adjusts the thread tightness quantity.

As described above, in the thread tightness adjusting mechanism 420, a thread draw out actuator drive rod expands and contracts by the rotation of the thread draw out actuator eccentric shaft 422 which rotates corresponding to the feed quantity of the fabric workpiece 21, and adjusts the stroke of the thread draw out actuator. Thereby, the thread tightness quantity of the thread draw out actuator can be adjusted corresponding to the feed quantity which is set by the feed quantity setting mechanism 300, that is, corresponding to the stitch length. Therefore, the waiting position before the thread draw out actuator hooks the thread which is drawn out from the thread exit of the bobbin case can be stabilized by the thread tightness adjusting mechanism even if the stitch length and the inter-stitch pitch fluctuate. And, because the thread tightness quantity of, the thread draw out actuator can be adjusted corresponding to the set feed quantity from the stabilized waiting position, the beautiful handstitches finish.

Heretofore, the explanation was performed by the particular mode of embodiment shown in the drawing about this invention. However, this invention is not limited to the mode of embodiment shown in the drawing. And, any constitution which is known heretofore can be adopted obviously insofar as the effect of this invention is achieved.

The invention claimed is:

1. A method for forming single-thread locked handstitches, comprising the steps of:

(a) contacting circumferentially on an open eye needle and tightening a thread which is drawn out from a thread exit by rocking the thread exit of a bobbin case which houses a bobbin that the thread which is incorporated in a bobbin casing is wound by rocking the bobbin casing which is loaded in the rotative outer rotary hook of a rotary hook positioned under a throat plate by the time the open eye needle which is provided with the thread capturing open eye laterally and performs a linear reciprocating motion vertically comes down from an upper dead center, pierces a fabric workpiece which is placed on the throat plate, and goes up from the brink of reaching a lower dead center in a first stroke, (b) capturing the thread which is contacted circumferentially on said open eye needle and is tightened by said thread capturing open eye when said open eye needle goes up from said lower dead center, (c) feeding said fabric workpiece with one stitch length while said open eye needle slips out from said fabric workpiece, goes up, and passes through the upper dead center in said first stroke, (d) scooping the thread which is captured by said thread capturing open eye by a loop-taker point of said rotative outer rotary hook, and releasing the captured thread by the rotation of said rotary hook from said thread capturing open eye when said open eye needle comes down from the upper dead center, pierces said fabric workpiece, and goes up from the lower dead center in a second stroke, (e) guiding in the thread which is scooped by the loop-taker point of said rotary hook and released by the further rotation of said rotary hook to said rotary hook, interlacing the thread to the thread which is wound in said bobbin, and tightening the thread which guides out from said rotary hook, (f) feeding said fabric workpiece with one inter-stitch pitch while the open eye needle slips out from said fabric workpiece, goes up, and passes through the upper dead center in said second stroke, and (g) forming a handstitch on a front surface and a locked stitch on a back surface of said fabric workpiece by repeating the steps from said (a) to (f).

2. The method for forming single-thread locked handstitches according to claim 1, wherein said thread exit is provided at said bobbin case so that it rocks to the direction in parallel with the opening part direction of said thread capturing open eye astride a needle dropping position of said open eye needle.

3. The method for forming single-thread locked handstitches according to claim 1, wherein the thread which is scooped by the loop-taker point is guided in to said rotary hook after the thread which is captured by said thread capturing open eye is scooped by the loop-taker point of said outer rotary hook, the thread which is drawn out from the thread exit of said bobbin case is hooked just before guiding out from said rotary hook, the thread which is guided out from said rotary hook is tightened, and said thread which is hooked is released after said thread is captured by said thread capturing open eye.

4. The method for forming single-thread locked handstitches according to claim 1, wherein the thread captured by said thread capturing open eye is shifted to the unopened direction of said thread capturing open eye between a tip of said open eye needle and said fabric workpiece when said open eye needle comes down from said upper dead center in said second stroke.

5. The method for forming single-thread locked handstitches according to claim 1, wherein the thread tightness quantity is adjusted depending on the feed quantity of said fabric workpiece when tightening the thread which guides out from said rotary hook.

6. A method forming single-thread locked handstitches, comprising the steps of:

forming a handstitch on a front surface and a locked stitch on a back surface of a fabric workpiece as a skip stitch set by cooperation of an open eye needle which is provided with a thread capturing open eye laterally, a rotary hook which is composed by a rocking bobbin casing which is loaded at a rotative outer rotary hook and a thread draw out actuator, setting a stitch length feed quantity of a stitch length feed and an inter-stitch pitch feed quantity of an inter-stitch pitch feed respectively, when the stitch length feed of said fabric workpiece for said handstitch is performed by a feed mechanism in a first stroke of said open eye needle, and the inter-stitch pitch feed of said fabric workpiece for the inter-handstitch is performed by said feed mechanism in a second stroke of said open eye needle, changing over to each fabric workpiece feed mode corresponding to said stitch length feed and said inter-stitch pitch feed respectively every one skip stitch set in sequence, transmitting said set stitch length feed quantity and inter-stitch pitch feed quantity to a feed drive mechanism in each fabric workpiece feed mode respectively, and feeding said fabric workpiece by said feed mechanism.

7. A single-thread locked handstitch sewing machine, comprising:

an open eye needle, which is provided with a thread capturing open eye laterally which captures a thread in a first stroke which performs a linear reciprocating motion vertically by coming down from the upper dead center, piercing the fabric workpiece which is placed on a throat plate, slipping out from said fabric workpiece from the lower dead center, going up when coming down from an upper dead center, piercing a fabric workpiece, and going up from a lower dead center, and which releases the captured thread when coming down from the upper dead center, piercing said fabric workpiece, and going up from the lower dead center in a second stroke, a rotary hook, which is the rotary hook which contacts circumferentially on an open eye needle and tightens a thread which is drawn out from a thread exit by rocking the thread exit of a bobbin case which houses a bobbin that the thread which is incorporated in a bobbin casing is wound by rocking the bobbin casing which is loaded in the rotative outer rotary hook of the rotary hook positioned under a throat plate by the time the open eye needle goes up from the brink of reaching a lower dead center, and that said fabric workpiece is fed with one stitch length while said open eye needle slips out from said fabric workpiece, goes up and passes through the upper dead center in said first stroke, and that the open eye needle has a loop-taker point of the rotative outer rotary hook for scooping the thread which is captured by said thread capturing open eye when said open eye needle comes down from the upper dead center, pierces said fabric workpiece, and goes up from the lower dead center in the second stroke, and that the captured thread is released from said thread capturing open eye by the rotation of said rotary hook, and the released thread which is scooped by the loop-taker point of said rotary hook is guided in to said rotary hook by the further rotation of said rotary hook and is interlaced to the thread which is wound in said bobbin, a thread draw out actuator, which tightens the thread which guides out from said rotary hook by the further rotation of said rotary hook, a feed mechanism, which feeds said fabric workpiece with one stitch length while said open eye needle slips out from said fabric workpiece, goes up, and passes through the upper dead center in said first stroke, and feeds said fabric workpiece with one inter-stitch pitch while said open eye needle slips out from said fabric workpiece, goes up, and passes through the upper dead center in the second stroke, and thereby a handstitch on a front surface and a locked stitch on a back surface of said fabric workpiece are formed respectively.

8. The single-thread locked handstitch sewing machine according to claim 7, wherein said outer rotary hook is provided with a outer rotary hook deviator which deviates the thread of the brink of guiding out from said rotary hook to the direction of letting go from the plane of rotation of said loop-taker point, and avoids that said loop-taker point hooks the thread which guides out from said rotary hook.

9. The single-thread locked handstitch sewing machine according to claim 7, wherein a bobbin casing rocking mechanism which drives swingably said bobbin casing by a rocking actuator is provided.

10. The single-thread locked handstitch sewing machine according to claim 7, wherein said thread exit is provided at said bobbin case so that it rocks to the direction in parallel with the opening part direction of said thread capturing open eye astride a needle dropping position of said open eye needle.

11. The single-thread locked handstitch sewing machine according to claim 7, wherein said thread draw out actuator has functions for guiding in said thread which is scooped by the loop-taker point to said rotary hook after scooping the thread which is captured by said thread capturing open eye by the loop-taker point of said outer rotary hook, hooking the thread which is drawn out from the thread exit of said bobbin case just before guiding out from said rotary hook, tightening the thread which is guided out from said rotary hook, and releasing the thread which is hooked after capturing said thread by said thread capturing open eye.

12. The single-thread locked handstitch sewing machine according to claim 7, wherein a thread shifting mechanism which shifts the thread which is captured by said thread capturing open eye to the unopened direction of said thread capturing open eye between a tip of said open eye needle and said fabric workpiece when said open eye needle comes down from said upper dead center in said second stroke is provided.

13. The single-thread locked handstitch sewing machine according to claim 7, wherein an open eye needle-latch wire drive mechanism for driving a latch wire which closes said thread capturing open eye in the period that said thread capturing open eye of said open eye needle comes down from said upper dead center of said open eye needle, pierces said fabric workpiece, and passes through said throat plate, and in the period that said thread capturing open eye passes through said throat plate, slips out from said fabric workpiece, and reaches said upper dead center after said thread capturing open eye goes up from said lower dead center and captures said thread is provided.

14. A single-thread locked handstitch sewing machine which forms a handstitch on a front surface and a locked stitch on a back surface of a fabric workpiece as a skip stitch set by cooperation of an open eye needle which is provided with a thread capturing open eye laterally, a rotary hook which is composed by a rocking bobbin casing which is loaded at a rotative outer rotary hook and a thread draw out actuator, and performs a stitch length feed of said fabric workpiece for said handstitch by a feed mechanism in a first stroke of said open eye needle and performs an inter-stitch pitch feed of said fabric workpiece for said inter-handstitch by said feed mechanism in a second stroke of said open eye needle, comprising:

a feed quantity setting mechanism which sets a stitch length feed quantity of said stitch length feed and an inter-stitch pitch feed quantity of an inter-stitch pitch feed respectively, a feed mode changeover mechanism which changes over to each fabric workpiece feed mode corresponding to said stitch length feed and said inter-stitch pitch feed respectively every one skip stitch set in sequence, and a feed drive mechanism which transmits said set stitch length feed quantity and inter-stitch pitch feed quantity in each fabric workpiece feed mode respectively, and feeds said fabric workpiece by said feed mechanism.

15. The single-thread locked handstitch sewing machine according to claim 14, wherein a thread tightness adjusting mechanism which adjusts a thread tightness quantity of said thread draw out actuator depending on the feed quantity which is set by said feed quantity setting mechanism is provided.

16. The single-thread locked handstitch sewing machine according to claim 15, wherein said thread tightness adjusting mechanism is provided with a thread draw out actuator eccentric shaft which rotates depending on the feed quantity of said fabric workpiece, and a thread draw out actuator drive rod which expands and contracts by the rotation of said thread draw out actuator eccentric shaft and adjusts the stroke of said thread draw out actuator.

17. The single-thread locked handstitch sewing machine according to claim 14, wherein said feed quantity setting mechanism comprises a reverse T-shaped feed adjuster which is pivotally attached to a supporting arm which is pivotally supported to an intermediate shaft that one-half is decelerated from an upper shaft which drives said open eye needle, and a stitch length feed quantity operating member and an inter-stitch pitch feed quantity operating member are pivotally attached to both arms of said reverse T-shaped feed adjuster respectively.

18. The single-thread locked handstitch sewing machine according to claim 14, wherein said feed mode changeover mechanism comprises a feed changeover cam which is firmly fixed to said intermediate shaft and has at least two even-numbered deviating points and a feed changeover rod which contacts to the outside of said feed changeover cam, and a connecting end of said feed changeover rod is pivotally attached to one end of a stitch length changeover link, and another end is pivotally attached to a vertical arm end of said reverse T-shaped feed adjuster.

* * * * *